US007316139B2

(12) United States Patent
Nakazima et al.

(10) Patent No.: US 7,316,139 B2
(45) Date of Patent: Jan. 8, 2008

(54) BUTTON LOCK

(75) Inventors: Susumu Nakazima, Hiki-gun (JP); Koichi Takahashi, Hiki-gun (JP); Kenji Naitou, Hiki-gun (JP)

(73) Assignee: Nagasawa Manufacturing Co., Ltd., Saitama (JP)

( * ) Notice: Subject to any disclaimer, the term of this patent is extended or adjusted under 35 U.S.C. 154(b) by 213 days.

(21) Appl. No.: 10/487,200

(22) PCT Filed: Jun. 5, 2003

(86) PCT No.: PCT/JP03/07111

§ 371 (c)(1),
(2), (4) Date: Feb. 18, 2004

(87) PCT Pub. No.: WO2004/003321

PCT Pub. Date: Jan. 8, 2004

(65) Prior Publication Data

US 2005/0086982 A1 Apr. 28, 2005

(30) Foreign Application Priority Data

Jun. 26, 2002 (JP) ..... 2002-185965
Apr. 8, 2003 (JP) ..... 2003-103735

(51) Int. Cl.
*B65D 55/14* (2006.01)

(52) U.S. Cl. ..... 70/214; 70/220; 70/304; 70/312

(58) Field of Classification Search ..... 70/214, 70/220, 298, 301–306, 312, 287–290
See application file for complete search history.

(56) References Cited

U.S. PATENT DOCUMENTS 1,598,506 A * 8/1926 Riddle ..... 70/298

(Continued)

FOREIGN PATENT DOCUMENTS

JP 62-54951 11/1987

*Primary Examiner*—Suzanne Dino Barrett
*Assistant Examiner*—Christopher Boswell
(74) *Attorney, Agent, or Firm*—Jordan and Hamburg LLP

(57) ABSTRACT

There is provided a button-operated lock device capable of increasing a setting amount of information in response to operation of a control button, obtaining a large setting amount and a wide-range of selection thereof, enhancing safety performance, simplifying the structure and achieving a small size and a light-weight, thereby achieving a low manufacturing cost, executing such various operations as setting or inputting information and altering thereof correctly, safely, easily and rationally, and preventing decoding or perceiving of preset or inputted information so that any third party is prevented from making a falsification and/or conversion of this device.

The button-operated lock comprises a plurality of control buttons (10) axially displacedly arranged and capable of setting or inputting a predetermined information; a control plate (128) for allowing an unlocking procedure at the time of setting or imputing the predetermined information; a driving cam (16) linked to the control plate (128) and capable of being operatively connected to a pair of door handles (4, 5); and a lock element linked to the driving cam (16), wherein a plurality of same or different information can be set or inputted to each of the control buttons (10) and the plurality of same or different information can be set or inputted every time the control button (10) is operated.

19 Claims, 36 Drawing Sheets

U.S. PATENT DOCUMENTS

| | | | | | |
|---|---|---|---|---|---|
| 3,115,765 | A | | 12/1963 | Fengler | |
| 3,462,981 | A | * | 8/1969 | Leblanc | 70/220 |
| 4,027,508 | A | * | 6/1977 | McGourty | 70/214 |
| 4,640,110 | A | * | 2/1987 | Fish et al. | 70/214 |
| 4,748,833 | A | | 6/1988 | Nagasawa | |
| 4,794,768 | A | * | 1/1989 | Moser et al. | 70/220 |
| 4,936,894 | A | * | 6/1990 | Larson et al. | 70/298 |
| 5,186,032 | A | * | 2/1993 | Chia | 70/289 |
| 5,730,014 | A | * | 3/1998 | Berger et al. | 70/224 |
| 6,026,665 | A | * | 2/2000 | Raybary | 70/214 |
| 6,298,698 | B1 | * | 10/2001 | Nakajima et al. | 70/214 |
| 6,334,346 | B1 | * | 1/2002 | Wang | 70/214 |
| 6,575,004 | B2 | * | 6/2003 | Berton et al. | 70/214 |
| 6,755,059 | B1 | * | 6/2004 | Nall | 70/298 |
| 2004/0261477 | A1 | * | 12/2004 | Wang | 70/214 |

* cited by examiner

RELATION BETWEEN MEMORY NUMBER AND CONTROL CAM

BUTTON LOCK

TECHNICAL FIELD

This invention relates to a button-operated lock device capable of increasing a setting amount of information in response to operation of a control button, obtaining a large setting amount and a wide-range of selection thereof, enhancing safety performance, simplifying the structure and achieving a small size and a light-weight, thereby achieving a low manufacturing cost, executing such various operations as setting or inputting information and altering thereof correctly, safely, easily and rationally, and preventing decoding or perceiving of preset or inputted information so that any third party is prevented from making a falsification and/or conversion of this device.

BACKGROUND ART

Recently, a keyless lock of the type requiring the use of no key has been popularized as a door lock to be used for individual dwelling houses, companies, shops, hospitals and the like.

As a keyless lock of the type mentioned above, there are a so-called mechanical lock in which the locking and unlocking procedure is made by a structural means and an electric or electronic lock in which the locking and unlocking procedure is made by an electrical means.

Of these two types of keyless locks, the mechanical lock, when compared with the electronic or electric lock, has such advantages that there is no worry about power failure or battery exhaustion because no wiring work is required, the user of such a lock is free from electrical trouble such as malfunction, and in addition, the mechanical strength is large.

The mechanical lock, in general, includes a plurality of control buttons. Memory information corresponding to the control buttons is stored in association with a cam or link mechanism or a gear train, the memory information of the respective control buttons is combined by the same number as the number of the control buttons, and a password number consisting of the number of digits of the control buttons is set or inputted. At the time of unlocking, the control buttons corresponding to the password number are operated so that the lock can be unlocked.

For example, in the invention disclosed in Japanese Patent Publication No. S62-54951 the present applicant previously filed, the respective control buttons are inserted in the slits formed in a case frame in their erected or inverted states, and the numbers of the respective control buttons are set to 1 or 0, i.e., two modes of either "set" or "unset". Then, it is selectively decided whether the number setting for the respective control buttons is necessary or not so that the password number can be set or inputted by a combination of the corresponding numbers. At the time of unlocking, the control buttons for which the number setting has been made are depressed to engage the slits formed in those buttons with the keyplate. On the other hand, the control buttons for which the number setting has not been made are not depressed to maintain the engagement relation between the slits and the keyplate. Owing to this arrangement, the cam pin can be turned to allow the handle to turn, so that the lock can be unlocked.

However, in this conventional device, since only two modes, i.e., number setting and number unsetting, can be obtained for each control button and the setting amount of information for each control button is limited, the number of the password number depends on the number of the control buttons and thus, a sufficient setting amount of information is unobtainable. Since the range of selection thereof is limited, a large enough safety performance is unobtainable.

In order to solve those problems, if the number of the control buttons should be increased, the number of the component parts would be increased to that extent. Thus, the construction and the locking and unlocking procedure becomes complicated, and the case frame and the packing plate become large in size, thus resulting in large size and heavy weight of the entire button-operated lock. Moreover, the outer appearance of the door is degraded.

Those problems are also common in U.S. Pat. No. 3,115,765.

That is, the lock disclosed in the above U.S. patent includes a generally elongate box-like casing. This casing is retractably provided at a face plate thereof with a plurality of key systems which are linked to the control buttons. A plurality of shafts are turnably suspended in the longitudinal direction of the casing. The respective gears are engageably arranged in such a manner as to face with the key system positions of those shafts. The gears are intermittently turned through the pressing operation of those key systems. A control shaft, which is linked to a door handle is disposed at one end of the casing. A slide plate is provided in such a manner as to be engageable with a cam disposed at the control shaft. A plurality of engagement elements disposed at the slide plate are engageable with and disengageable from the respective gears which are fixed to the above-mentioned shaft. The memory system by the key system can be stored in the gear train or reset.

However, the lock taught by the above U.S. patent has the following problems. Since each control button can set only a single memory information, a combination of memory information achievable through each control button is limited, and selection of password numbers and safety performance are limited. Moreover, since the number setting of the control buttons is linked to the number setting of the adjacent control buttons and the password number is stored in order of the setting input, the number setting lacks in versatility and the smooth execution of the locking and unlocking procedure is jeopardized. Moreover, since the turning force of the door handle acts on the slide plate, it can easily be perceived whether or not memory setting has been made through the respective control buttons. This, together with the above-mentioned disadvantage in limitation of the memory capacity, tends to create such a fear that repeated evil attempt should be made on the control buttons, the lock could be unlocked comparatively easily.

On the other hand, a long time use of a same password number leads gives a chance to a third party to perceive and decode the number. This is not desirable in view of protection of the password number. Therefore, it is desirable that the password number is altered frequently. However, since the alternation mechanism and operation thereof requires a time-consuming troublesome work in view of its structure, the simplification and easiness are demanded.

For example, the lock proposed by the present applicant in Japanese Patent Publication No. S62-54951 is designed such that at the time for altering the password number, a case frame and a packing plate, which are arranged at the inside and the outside of the door, is removed therefrom, the corresponding control buttons are pulled out in their exposed states, and inserted into a slit in their erected or inverted states and then reassembled.

However, this method has such problems that since the case frame and the backing plate are required to be detached from the door and the buttons are required to be detached or replaced, complicated and time-consuming work is required.

In the lock of the above-mentioned U.S. Pat. No. 3,115,765, at the time for altering the password, the control buttons are operated to set or input the current password number and thereafter, the slide plate is moved to release the engagement between the engagement element and the groove. After the current password number is canceled, the control buttons are operated to set or input a new password number.

This method, when compared with the above-mentioned method, has such advantages that the troublesome work for removing the related parts from the door is no more required and thus, this operation can be made in a simple and convenient manner. However, it has such a problem that since the password number can be altered from the outside of the door, the third party can make a falsification relatively easily. Therefore, uneasiness in relation to protection and security occurs.

It is, therefore, a main object of the present invention, to provide a button-operated lock which is capable of solving the above-mentioned problems and in which the amount of information to be set to the control buttons is increased, a large setting amount of information and its wide selection can be obtained, and safety performance can be enhanced.

Another object of the present invention is to provide a button-operated lock, in which the structure can be simplified and made compact and light-weight, and the manufacturing cost can be reduced.

A further object of the present invention is to provide a button-operated lock, in which the setting or inputting of information to the control buttons, as well as an altering operation thereof, can be made correctly, safely, easily and rationally.

A still further object of the present invention is to provided a button-operated lock, in which decoding or perceiving of information, which would otherwise be made by the third party relatively easily, is prohibited so that the third party is prevented from making a falsification and/or conversion of such information.

A yet further object of the present invention is to provide a button-operated lock, in which a criminal unlocking procedure, which would otherwise be made by the third party comparatively easily through a control hole formed in a case, can be prevented from occurring.

DISCLOSURE OF THE INVENTION

A button-operated lock according to the present invention comprises a plurality of control buttons axially displacedly arranged and capable of setting or inputting a predetermined information; a control plate for allowing an unlocking procedure at the time of setting or imputing the predetermined information; a driving cam linked to the control plate and capable of being operatively connected to a pair of door handles; and a lock element linked to the driving cam, wherein a plurality of same or different information can be set or inputted to each of the control buttons and the plurality of same or different information can be set or inputted every time the control button is operated. Accordingly, a large number of combination of password numbers can be obtained compared with the conventional technique in which only one memory information is set or inputted to a plurality of control buttons and plural sorts of password numbers are obtained by changing the combinations of the control buttons. Since the range of selection can be widened, the safety performance can be enhanced and the number of the control buttons can be reduced to that extent. Moreover, no reset button is required contrary to the conventional technique. Thus, the number of component parts can be reduced and the structure can be simplified. In addition, the device according to the present invention can be manufactured easily and economically.

Accordingly, the case, etc. can be made short and small, and reduced in width by an amount equal to the reduction of the number of control buttons. Thus, the invented device can be made compact and light weight, and the appearances of the button-operated lock and the door can be improved. Moreover, the backset dimensions from the side end face of the door to the center of the lock can be made compact and thus, this lock can be suited to be used for a kitchen door.

Moreover, in the button-operated lock, plural sorts of memory information can be set or inputted in accordance with the number of times of depressing operation of the control buttons. Accordingly, there is no worry for being perceived the memory information from the finger prints printed on the surfaces of the control buttons and the wearing condition of the surfaces of the control buttons when compared with the conventional technique in which only one memory information is set or inputted to a plurality of control buttons. Thus, the safety performance can be enhanced.

Moreover, in the button-operated lock according to the present invention, the setting or inputting information can be controlled in association with the number of times of operation of the control buttons. Accordingly, the setting or inputting operation of information can be made correctly by sorting, counting and recognizing the information.

Moreover, in the button-operated lock according to the present invention, a part of the control means of the information to be set or inputted is built in the control button. Accordingly, the device can be made small in size and light in weight.

Moreover, in the button-operated lock according to the present invention, the control means includes a gear button which can be intermittently turned every time the control button is axially displaced. Accordingly, the displacement of the control button can be transmitted correctly and in a stable manner.

Moreover, in the button-operated lock according to the present invention, the plurality of information can be set or inputted during one turn of the control button. Accordingly, malfunction occurrable when the control button is turned by plural turns can be prevented, and correctness and safety of the locking/unlocking operation can be obtained.

Moreover, in the button-operated lock according to the present invention, a lock plate is interposed between the control plate and the driving cam, one end of the lock plate is swingably connected to the control plate, and the other end of the lock plate is arranged to be engageable with or disengageable from the driving cam. Accordingly, there is no worry that the password number is perceived by turning operation of the door handle as in the conventional technique in which the control plate and the driving cam are directly associated. Thus, the safety performance can be enhanced.

In the button-operated lock according to the present invention, a terminal gear is arranged to be engageable with the button gear, a reset gear is arranged to be engageable with the terminal gear, and the reset gear is biased in such a manner as to be able to rotationally return in accordance with a rotation angle displacement thereof. Accordingly, a plurality of information can be inputted correctly through a plurality of control buttons, and a correct and stable operation of the terminal gear can be obtained.

Moreover, in the button-operated lock according to the present invention, wherein the button gear and the terminal gear can be disengaged from each other, and the terminal gear and the reset gear can be normally engaged with each other. Accordingly, the setting or inputting of information through the control buttons and alternation thereof can be realized in a reliable manner.

Moreover, in the button-operated lock according to the present invention, the reset gear is provided with a stopper which is unable to engage the terminal gear. Accordingly, information can reliably be set or inputted in a range of one turn of the control button. Moreover, malfunction, which would otherwise be occurrable by more than one turn of the control button, can be prevented from occurring. In addition, by restricting the amount of information which can be set or inputted by only one control button, malfunction can be prevented from occurring.

In the button-operated lock according to the present invention, the terminal gear is provided with a square hole, a clutch shaft capable of rotationally support the terminal gear, the clutch shaft being provided with a square shaft which is engageable with and disengageable from the square hole, and the square shaft being biased for engagement with the square hole. Accordingly, the operation of the button gear and the reset gear can be transmitted to the control cam correctly and in a stable manner through the terminal gear and the clutch shaft.

Moreover, in the button-operated lock according to the present invention, a plurality of engagement parts engageable with the square shaft are formed at the square hole, and the number of the engagement parts is set to be equal to an amount of information which can be set or inputted by only one control button. Accordingly, information can be set or inputted reliably through the control button.

Moreover, in the button-operated lock according to the present invention, a plurality of control holes are formed in a surface of a case which is exposed to the outside, so that a control tool can be inserted in the control holes, and one end part of the clutch shaft is faced with an inner side opening part of the control hole. Accordingly, information can be altered from the outdoor side through the control buttons by realizing a clutching operation of the clutch shaft by using the control tool.

In the button-operated lock according to the present invention, the clutch shaft is axially displaceable through the control tool, so that the engagement between the square shaft and the square hole can be released, and the terminal gear is rotatably supported by the clutch shaft. Accordingly, the setting or inputting of information and alternation thereof can be realized smoothly through the control buttons by realizing a clutching operation of the clutch shaft by suing the control tool.

Moreover, in the button-operated lock according to the present invention, a cam shaft is projected from the other end of the clutch shaft, a control cam is attached to the cam shaft such that the control cam is simultaneously movable with the cam shaft, an engagement claw of the control plate is removably received in a cutout groove formed in the control cam, and the engagement claw is biased such that the engagement claw is engageable with and disengageable from the cutout groove. Accordingly the engagement claw is brought into engagement with and disengagement from the cutout groove depending on where the cutout groove is located. By doing so, the operation of the control plate is controlled to realize the locking/unlocking operation.

Moreover, in the button-operated lock according to the present invention, a plurality of passage holes are formed in a back plate, which is attached to a back part of the case, in such a manner as to face with an end part of the cam shaft, and a plurality of check marks are arranged on the outside of the passage holes in isometric positions. Accordingly, the memory number of the control cam or the input information of the control button can correctly and easily be confirmed by referring the position of the end part of the cam shaft to the check mark. In this way, the inputting of information and alternation thereof can correctly be made.

In the button-operated lock according to the present invention, at the time of setting or inputting information through the control buttons, the cutout grooves are directed toward the engagement claw side and positioned in the same phase as the engagement claw, and the engagement claws are brought into engagement with the cutout grooves, respectively, so that the control plate can allow an unlocking procedure. Accordingly, the lock can be unlocked only when the set information is available. By doing so, safety at actual use can be ensured.

Moreover, in the button-operated lock according to the present invention, at the time of setting or inputting information through the control buttons, the engagement claws are brought into engagement with the control cam and prohibited from being engaged with the cutout grooves, so that the control plate is unable to allow an unlocking procedure. Accordingly, the lock can be prohibited from being unlocked by false operation and safety at actual use can be ensured.

Moreover, in the button-operated lock according to the present invention, a block main body on which the terminal gear and the reset gear can be mounted is provided, a memory releasing link is engaged with the block main body, the block main body is biased in such a manner as to be able to move toward the control button side, so that the terminal gear and the button gear can be engaged with each other, one end part of the memory releasing link is engaged with the driving cam, so that the block main body is brought away from the control button side through the turning motion of the driving cam, thereby allowing the terminal gear and the button gear to be disengaged from each other. Accordingly, any falsification and erroneous operation which could otherwise be achieved by operating the driving cam or door handle, namely, by resetting operation after setting information by the control buttons, can be obviated, and the state at the time of setting the information can be recovered easily. By doing so, any malfunction can be prevented from occurring thereafter, and a smooth and reliable locking/unlocking operation can be realized. On the other hand, by realizing the resetting operation through the door handle, the conventional reset button can be eliminated. Thus, the lock of this type can be simplified and made small in size and light in weight.

Moreover, in the button-operated lock according to the present invention, the block main body is provided with a guide groove, the memory releasing link is provided with a pin projecting therefrom and engageable with the guide groove, the pin is positioned such that it can normally engage one side edge of the guide groove, the guide groove is provided at the other end edge thereof with a locking projection engageable with the pin, and at the time of engagement between the pin and the locking projection, operation of the memory releasing link is prohibited and engagement between the terminal gear and the button gear is prohibited from releasing. Accordingly, any false unlocking operation using, for example, the control hole can be prohibited, and safety at actual use and security can be ensured.

Moreover, in the button-operated lock according to the present invention, the memory releasing link is turnably provided at the other end side thereof with a changeover shaft which is linked to a changeover knob on the indoor side, the changeover shaft is provided with two cams which are different in length, and the two cams is selectively engageable with the other end part of the memory releasing link. Accordingly, the use of so-called empty lock for this type of a lock and the use at the time of alternation of information can be met by only one changeover shaft.

Moreover, in the button-operated lock according to the present invention, the separation distance between the block main body and the control button is made different in accordance with the lengths of the two cams, the two cams are each capable of releasing engagement between the terminal gear and the button gear, at the time of engagement with the long side cam, engagement between the engagement claw and the control cam cutout groove can be maintained, and at the time of engagement with the short side cam, engagement between the engagement claw and the cutout groove can be maintained. Accordingly, at the time of the engagement of the elongate side cam, the use of so-called empty lock of this type of a lock can be obtained, and at the time of the engagement of the short side cam, the reasonable use at the time of alternation of information can be obtained.

In the button-operated lock according to the present invention, the case is provided at an inner side surface side thereof with a protection plate such that the protection plate can move along the control holes, and a plurality of through-holes, which can communicate with the control holes, are formed in the protection plate, such that one end of the protection plate can engage the driving cam. Accordingly, a false unlocking operation through the control hole can be prevented from occurring.

Moreover, in the button-operated lock according to the present invention, engagement between the terminal gear and the button gear is released through turning operation of the door handles or the changeover shaft, and the terminal gear is turned by elastic force of a set spring which is formed after the information is set or imputed, so that the control cam or its cutout groove can be returned to its original position. Accordingly, the resetting operation can be realized through the door handle or changeover shaft. Thus, the current information can easily be reproduced, and the setting of information or alternation thereof can rapidly be attained.

Moreover, in the button-operated lock according to the present invention, after the control cam or its cutout groove is returned to its original position, current information of the control button is set or imputed to turn the button gear by an amount of the set or inputted information, the terminal gear and the reset gear are moved in operative connection to the turning motion of the button gear, the terminal gear is biased to return to its original position by an amount of the set or inputted information, the engagement between the terminal gear and the button gear is released through the turning operation of the door handles, the terminal gear is reversely turned for offset by an amount of the set or inputted information, thereby releasing the set or inputted current information so that the lock can be unlocked. Accordingly, a reliable unlocking operation can be obtained.

In the button-operated lock according to the present invention, after the control cam or its cutout groove is returned to its original position, the terminal gear is rotatably supported on the clutch shaft through the control tool, and the engagement between the square shaft and the square hole is released, so that the original position of the control cam or its cutout groove can be maintained. Accordingly, it can eliminate such elaboration that at the time of altering information, the information which has been set or inputted by operating the control buttons is once deleted and the information which has been set or inputted is inputted once again by operating the control buttons.

Moreover, in the button-operated lock according to the present invention, after the original position of the control cam or its cutout groove is maintained through the control tool, at the time for altering information where the button gear is turned in the same direction as at the setting or inputting time of information, the control button is operated by an amount equal to the difference between the turning angles of the button gear before and after the alternation of information, then the terminal gear and the reset gear are operatively connected thereto, the terminal gear is biased such that it can turningly return by an amount equal to the difference between the turning angles, the square shaft and the square hole are engaged with each other after the button gear is turned, and the original position of the control cam or its cutout groove is linked to the terminal gear, the engagement between the terminal gear and the button gear is released through turning operation of the door handles, the terminal gear is turned by an amount equal to elasticity of the reset spring formed after the alternation of information, and an amount equal to the turning angle of the terminal gear is added to the position of the control cam or its cutout groove, so that the setting or inputting information can be altered. Accordingly, the information altering operation achieved by turning the button gear in the same direction as at the time of setting or inputting the information can be made from the outer side of the door safely, reasonably and rapidly.

Moreover, in the button-operated lock according to the present invention, the number of times of operation of the control button is a quotient obtained by dividing the difference of turning angles of the button gear before and after the alternation of information by a unit operation turning angle of the turning button. Accordingly, the above-mentioned information altering operation can be made reasonably and easily.

In the button-operated lock according to the present invention, at the time for altering information where the button gear is turned in a reverse direction to the direction at the time of setting or inputting information, the changeover shaft is turned to bring the cam on its short side into engagement with an end part of the memory releasing link and to release the engagement between the terminal gear and the button gear, the engagement between the cutout groove and the engagement claw is maintained to maintain the original position of the control cam or its cutout groove, the terminal gear is turnably supported on the clutch shaft through the control tool, the terminal gear is turningly returned by an amount of elasticity of the reset spring equal to the amount of elasticity necessary for forming the original position, after the original position of the control cam or its cutout groove is released, the changeover shaft is turningly returned to the original position to bring the terminal gear into engagement with the button gear, the button gear is turned by an amount equal to the amount of angle of the alternation of information by operating the control button through the control tool, then the terminal gear and the reset gear are operatively connected thereto, so that the terminal gear is biased such that it can turningly return by an amount equal to the difference between the turning angles, the square shaft and the square hole are engaged with each other after the button gear is turned, the clutch shaft is linked to the terminal gear to release the engagement between the terminal gear and the button gear through turning operation of the door handles, the terminal gear is turned by an amount equal to elasticity of the reset spring formed after the alternation of information, the position of the control cam or its cutout groove is reset by an amount equal to the turning angle of the terminal gear, so that the setting or inputting information can be altered. Accordingly, the information altering operation achieved by turning the button gear in the reverse direction to that at the time of setting or inputting the information can be realized. In addition, by making it necessary to turn the changeover shaft, it becomes indispensable that the information changing operation is made from the indoor side and it becomes impossible to make such information changing operation from the outdoor side. Thus, this type of operation can be made safely.

Moreover, in the button-operated lock according to the present invention, a ball retainer for disengageably receiving therein a ball biased toward the inner side of the door handles and adapted to normally turn the door handles and the driving cam but idly turn the door handle and prohibit the turning of the driving cam when excessively large torque acts on the door handle, is formed in the shape of a plate, and the ball retainer is mounted on a surface part of the case. Accordingly, the ball retainer or button-operated lock can be made small in size and light in weight.

Moreover, in the button-operated lock according to the present invention, the arrangement of the door handles and the control buttons can be selectively or symmetrically altered together with their inside mechanisms. Accordingly, the outer appearance or design of the lock can easily be changed in accordance with the circumstance under which the lock is used and the condition under which the lock is attached to the door.

The above-mentioned objects, features and advantages of the present invention will become more manifest from the following detailed description with reference to the attached drawings.

BEST MODE FOR CARRYING OUT THE INVENTION

Figure 1:
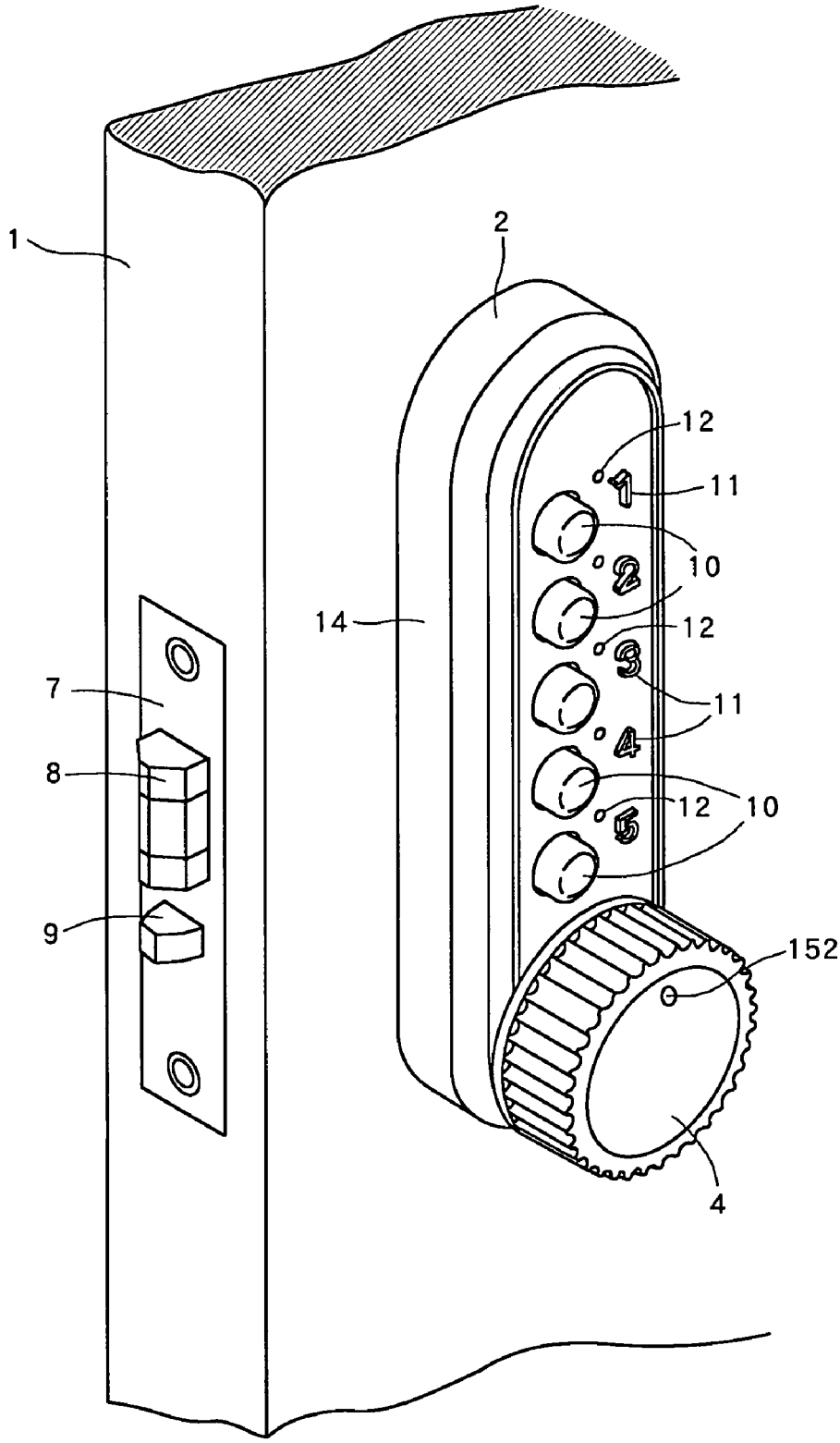
FIG. 1 is a perspective view showing one embodiment of the present invention, in which a button-operated lock according to the present invention is mounted on an entrance door.

The present invention will be described hereinafter in the form of one preferred embodiment with reference to the accompanying drawings. In FIGS. 1 through 36, reference numeral 1 denotes a left suspension type door, which one end part on the suspending base side is turnably attached to a framework (both of them are not shown) through a hinge, and a main lock (not shown) of the present invention is embedded in the other side end part.

A vertically elongated oval-shaped button-operated lock 2 is disposed at the other side end part of the outdoor of the door 1. A seat plate 3 having a generally same configuration as the button-operated lock 2 and having a small thickness is disposed at the indoor side of the door 1.

The button-operated lock 2 and the seat plate 3 are provided at lower end parts thereof with door handles 4, 5, respectively, such that the door handles 4, 5 can turn independently. A changeover knob 6 such as a thumb turn knob is attached to an upper end part of the seat plate 3 such that the knob 6 can turn by a predetermined angle.

The changeover knob 6 and the door handle 5 are turnably attached to the seat plate 3 through a stop ring (not shown) and engaged in and attached to a changeover shaft and a connection bar as later described.

In the Figures, reference numeral 7 denotes a front plate attached to the other side end face of the door 1. A dead bolt 8 and a latch trigger 9, which are operatively connected to the main lock, are retractably disposed at an intermediate part of the front plate 7. The latch trigger 9, when retracting, causes the dead bolt 8 to project in association with a cam mechanism of the main lock, so that the lock can be locked automatically.

The button-operated lock 2 uses numerical figures as set or inputted information, and it includes a plurality of control buttons 10 (five control buttons in this embodiment) through which the password number can be set or inputted. Those control buttons 10 are one-sidedly and vertically arranged in a row. Each control button 10 is provided at one side thereof with an indication part 11 for specifying this particular control button 10. In this embodiment, numerical FIGS. 1 through 5 are assigned as the indication parts 11 to the respective control buttons 10 in this order from the top.

Basically, the button-operated lock 2 is designed such that a certain password number consisting of numerical figures of the number of digits (five digits in this embodiment) corresponding to the number of the control buttons 10 can be set or inputted. In this embodiment, the password number "12345" are set or inputted from the top.

In the Figures, reference numeral 12 denotes control holes which are arranged between the control buttons 10 and the button indication parts 11, respectively. In this embodiment, a plurality of through-holes are formed, as the control holes 12, at locations where they can face with the information altering elements as later described.

The button-operated lock 2 includes a back plate 13 and a case 14 which are made of diecast zinc alloy and which form an outer jacket of the lock 2. A block assembly 15 and a driving cam 16 are received in the case 14.

The back plate 13 is formed in a shape of an elongated thin oval. A recess 17 capable of supporting a pivot part of the driving cam 16 is formed in the inner side surface of the back plate 13. A through-hole 18 is formed in the center of the recess 17. A barrel part (not shown) projects from the outer side edge part of this hole 18.

Referring back to the Figures, reference numeral 19 denotes a pair of left and right screw holes formed at opposite end parts of the back plate 13; 20, pipe shaft insertion holes formed at generally end parts of the back plate 13; and 21, 22, control windows for adjusting a suspending base position of a door 1 which is installed at a proximal position to the recess 17 and allowing a tool such as a screw driver to be inserted therein, respectively.

A plurality of elliptical recess grooves 23 are formed in a central part of the inner side surface of the back plate 13 along the longitudinal direction of the back plate 13. A control cam, as later described, is received in each recess groove 23 such that the control cam can slide in a direction orthogonal to the longitudinal direction of the back plate 13.

Each recess groove 23 has an elongate hole 24 as a passage hole which is formed therein in such a manner as to be offset to one side of the recess groove 23. One end of a crutch shaft, as later described, can be received in the elongate hole 24.

A bottomed cylindrical button retainer 25 projects from a proximal position to each recess groove 23. A guide shaft (not shown) of the control button 10 and its biasing spring can be received in the button retainer 25.

In the Figures, reference numeral 26 denotes a bead-like hooking projection projects from one side end part of the inner side surface of the back plate 13, and a pair of long grooves 27 are formed at the other side surface. An engagement pin of a memory releasing link as later described can be received in each long groove 27. Reference numeral 28 denotes a passage hole formed in the opposite side end part to the passage hole 20 of the back plate 13, and a changeover shaft as later described can be received in the passage hole 28. Reference numeral 29 denotes a hooking projection arranged proximate to button retainer 25 at the lowest position.

On the other hand, the case 14 is formed in a generally elongate oval box-like configuration from a diecast zinc alloy of the same quality as the button-operated lock 2. A plurality of button insertion holes 30 are one-sidedly arranged in a row on the surface of the case 14. The control buttons 10 are axially displaceably inserted in the button insertion holes 30 (in this embodiment, the control buttons 10 are inserted in the holes 30 such that they are displaceable when pressed).

Each control button 10 can set or input 8 sorts of memory information from "0" to "7" through a predetermined depressing operation. The memory information is defined by the number of times of a depressing operation.

That is, when the control button 10 is depressed once, a memory information of "1" is set or inputted, when the button 10 is depressed twice, a memory of "2" is set or inputted, and when the button 10 is depressed three times, a memory information of "3" is set or inputted. When a zero-times operation is made, i.e., when no depressing operation is made, a memory information of "0" is set or inputted.

Accordingly, the password number of "12345" in this embodiment can be set or inputted by depressing the control buttons 10 once, twice, three times, four times and five times in this order from the top down.

By means of combination of the memory information of those control buttons 10, the password number is set. A combination of the password number obtained by depressing the five control buttons as in the embodiment, is the fifth power of 8. In other words, 32768 sorts can be set or inputted.

In this case, of the password number of 5 digits, the digit of 10000-places is set or inputted with the memory information of the uppermost place, i.e., through the control button 10 which is indicated by the indication number "1" in the button indication part, the digit of 1000-places is set or inputted with the memory information through the control button 10 which is indicated by the indication number "2" in the button indication part, the digit of 100-places is set or inputted with the memory information through the control button 10 which is indicated by the indication number "3" in the button indication part, the digit of 10-places is set or inputted with the memory information through the control button 10 which is indicated by the indication number "4" in the button indication part, and the digit of 1-place is set or inputted with the memory information through the control button 10 which is indicated by the indication number "5" in the button indication part.

A short tubular guide ring 31 is press-fitted in or integrally formed with the inner side of an opening edge part of each button insertion hole 30. A plurality (eight in this embodiment) of guide ribs 32 project in the axial direction of the tubular guide ring 31.

A button case 33, which is made of diecast zinc alloy and which forms the control button 10, and a button gear 34 which forms control means which is composed of a gear train mechanism as later described, are engageably fitted to the guide rib 32

The button case 33 is formed in a bottomed cylindrical shape. A plurality (eight in this embodiment) of hook elements 35 project from the peripheral surface of the lower end part of the button case 33. Each of the eight guide ribs 32 is engageably interposed between every adjacent hook elements 35 such that the up and down movement the button case 33 can be enhanced.

The upper ends of the hook elements 35 are engageable with the inner side opening edge part of the button insertion hole 30 for the purpose of prevention of coming-off.

A plurality (eight in this embodiment) of serrated dogs 36 project from the peripheral edge of the lower end part of the button case 33. The corresponding number of dogs 37 of the button gear 34 are removably engaged with those dogs 36.

The button gear 34 is provided with 16 teeth and slide shaft parts 38, 39, which are different in diameter, project from opposite sides in the direction of the width of the tooth of the button gear 34. The upper side slide shaft part 38, which is large in diameter, is slideably inserted in the button case 33.

The corresponding number of serrated dogs 37 engageable with the dogs 36 project from the peripheral surface of the slide shaft part 38. A plurality (four in this embodiment) of tapered cams 39 project from the outer peripheral surfaces of the dogs 37.

The length in the peripheral direction of each cam 39 is set to a pitch which is generally equal to two teeth of the button gear 34. The cams 39 are arranged such that the cam faces are engageable with the end parts of the guide ribs 32. When the cam faces of the cams 39 are in engagement with the end parts of the guide ribs 32, the button gear 34 can intermittently turn by one pitch portion, i.e., 45 degrees which correspond to the distance between the adjacent guide ribs 32, 32, in one direction.

The lower side slide shaft part 39, which is small in diameter, is formed in a hollow cylindrical shape and slideably inserted in the button retainer 25. Through the elasticity of a set spring 40 received in the button retainer 25, the button case 33 and the button gear 34 are biased upward and the button case 33 is projected forward of the case 14.

A long elliptical guide groove 41 is formed adjacent to each button insertion hole 30 in the left and right direction. A generally oval slide groove 42 is formed in the groove 41 on the side of the button insertion hole 30. A barrel part 44 of a reset gear 43 and an information altering element 45, which form the block assembly 15, are slideably received in the guide groove 41 and the slide groove 42.

The block assembly 15 is composed of a diecast zinc alloy-made block main body 46 received in the button-operated lock 2 such that it can move leftward and rightward, a cover plate 47 attached to the upper surface of the main body 46 by screw fixing or the like, the same number of information altering units 48 and reset gears 43 as the control buttons 10 which are mounted over the block main body 46 and the cover plate 47.

Figure 21:
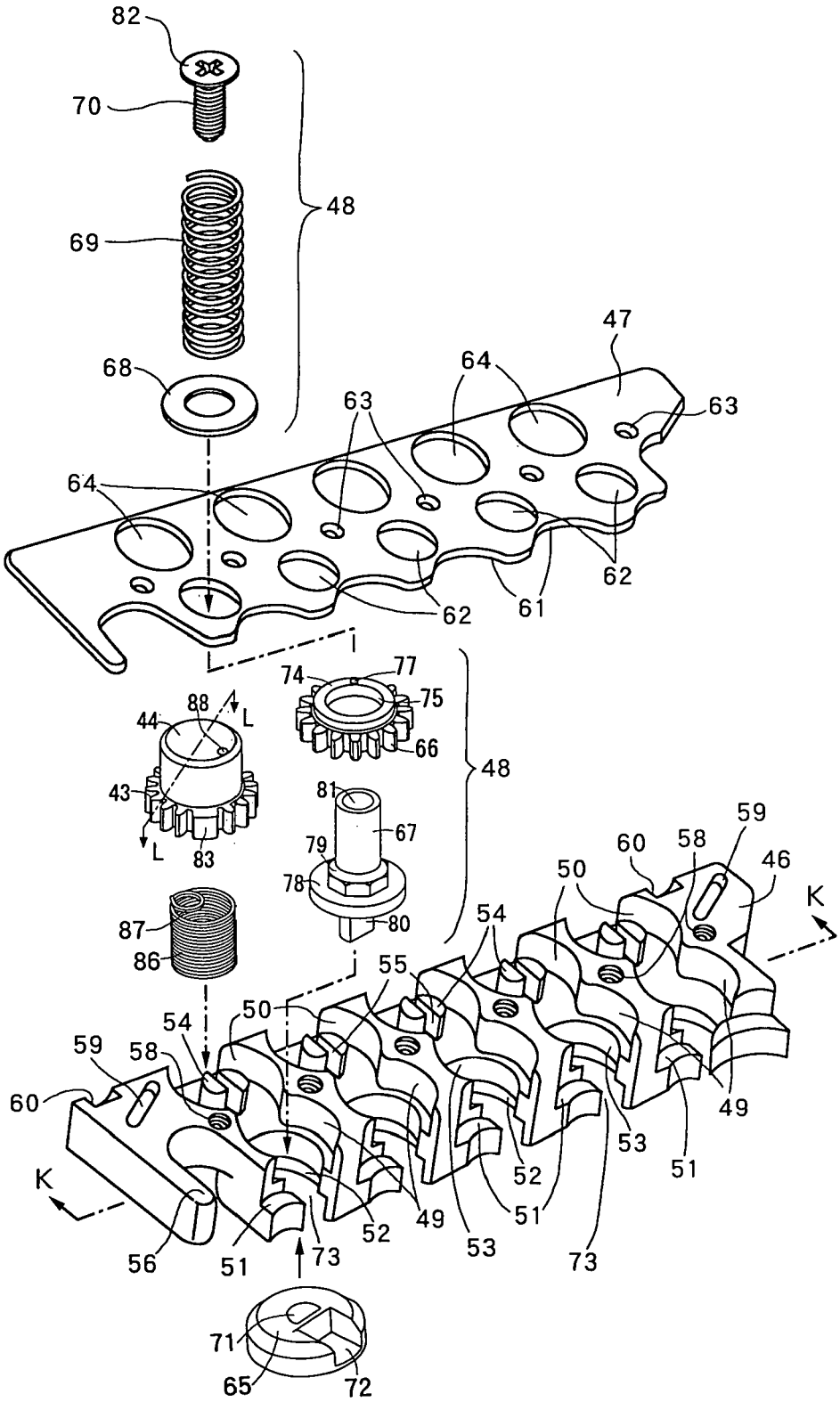
FIG. 21 is a perspective view showing the block assembly to which the present invention is applied, in an exploded manner.
Figure 22:
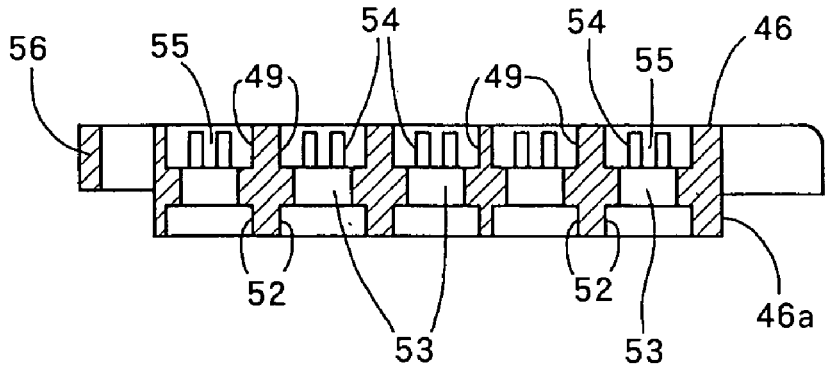
FIG. 22 is a sectional view taken on line K-K of FIG. 21.
Figure 23:
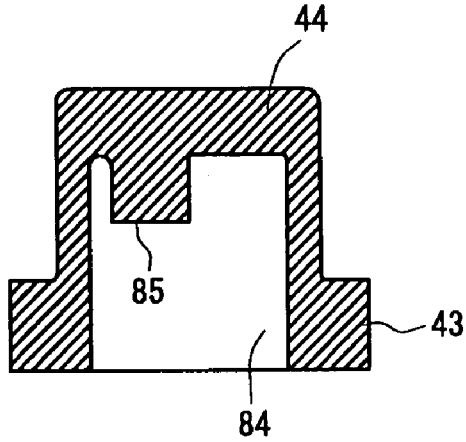
FIG. 23 is an enlarged sectional view taken on line L-L of FIG. 21.
Figure 24:
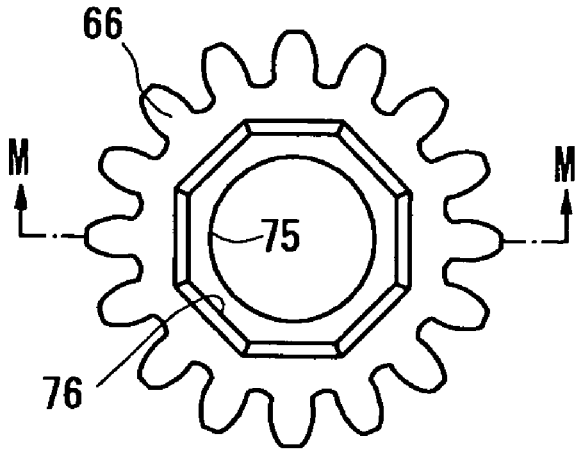
FIG. 24 is a front view showing a terminal gear to which the present invention is applied.
Figure 25:
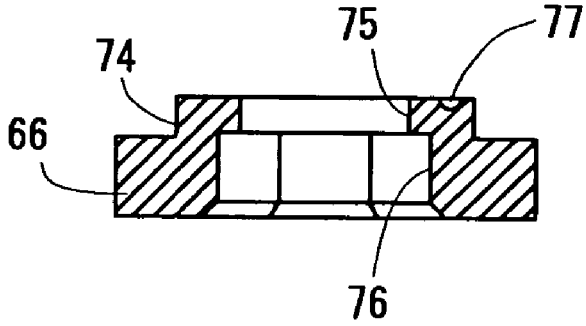
FIG. 25 is a sectional view taken on line M-M of FIG. 24.

The block main body 46 is composed of an elongate rectangular plate upper and lower surfaces of which are flat and smooth, and thin. As shown in FIGS. 21 and 22, the same number of bottomed first gear insertion holes 49 as the control buttons 10 are formed at one side of the upper surface of the block main body 46, and the same number of bottomed second gear insertion holes 50 as the first gear insertion holes 49 are formed at the other side.

The first and second gear insertion holes 49, 50 are communicated at an intermediate part of the block main body 46 with each other, and parts of the outer peripheral surfaces of those holes 49, 50 are open to the opposite side surfaces of the block main body 46.

A bottomed cutout hole 51 is formed in one side end part of the block main body 46 at an area slightly offset from the first gear insertion hole 49, and a part of the button gear 34 can be received in the cutout groove 51, so that the button gear 34 and a terminal gear as later described can be engaged with each other.

A cam hole 52 having the same diameter as the insertion hole 49 is formed at one side end part of the block main body 46 immediately under the first gear insertion hole 49. The cam hole 52 and the first gear insertion hole 49 are communicated with each other through a passage hole 53.

Moreover, a cutout groove 73 communicated with the passage hole 53 of each cam hole 52 is formed at one side end part of the block main body 46, such that an engagement claw of a control plate, as later described, can be inserted therein.

In the Figures, reference numeral 54 denotes a shaft-like spring hook projecting from a bottom part of the second gear insertion hole 50. The spring hook 54 is provided at its center with a slitting 55 in which a reset spring, as later described, can hook.

Reference numeral 56 denotes a hook part disposed at one end of the block main body 46. This hook part 56 is engageable with an expanded part 57 of the case 14. Reference numeral 59 denotes diagonal guide grooves disposed at opposite end parts of the block main body 46.

Reference numeral 60 denotes a recessed spring retainer disposed at the other side end part of the block main body 46. A shift spring 153 is interposed between the spring retainer 60 and the inner surface of the side wall of the case 14. The block assembly 15 is biased toward the control button 10 side through the elasticity of the spring 153, so that the terminal gear 66 is engageable with the button gear 34.

The cover plate 47 is formed in a generally same shape as the planar shape of the block main body 46. A plurality of arcuate cutouts 61 are formed at one side end part of the cover plate 47. Those cutouts 61 are arranged immediately above the cutout hole 51.

In the Figures, reference numeral 62 denotes an attachment hole for the information altering unit 48; 63, a screw hole; and 64, an insertion hole for allowing a boss 44 of the recess gear 43 to be inserted therein, formed in the cover plate 47, respectively.

The information altering unit 48 is, as shown in FIG. 21, composed of an information altering cam 65 received in the cam hole 52, a terminal gear 66 receiving in the first gear insertion hole 49, a clutch shaft 67 opposite shaft end parts of which are inserted in the information altering cam 65 and the terminal gear 66, a washer 68 disposed on an opening edge part of the attachment hole 62, a set spring 69, and an information altering element 70 linked to the clutch shaft 67.

Of those components, the information altering cam 65 is formed in a generally truncated cone shape from a synthetic resin which is excellent in wear-resisting property. A generally half moon-like shaft hole 71 is formed in the center of the information altering cam 65. A bottomed cutout groove 72 is formed in the side surface of the information altering cam 65 and directed toward the shaft hole 71, so that an engagement claw of a control plate, as later described, is removably engageable with the groove 72.

The information altering cam 65 is turnably received in the cam hole 52 with the cutout groove 72 facing upward. The flat undersurface of the information altering cam 25 is received on the recessed groove 23 of the back plate 13 and a lower part of the clutch shaft 67 is inserted in the shaft hole 71 of the information altering cam 25 so that the position of the cutout groove 72 is regulated.

That is, the position of the cutout groove 72 is changed in operative connection to the turning motion of the clutch shaft 67. Before the password number is set, the cutout groove 72 is open directing toward the position of the password number zero (0), i.e., toward the cutout part 73.

The terminal gear 66 is engageable with the button gear 34 and the set gear 43, and the diameter of its pitch circle is same as the diameter of the button gear 34 and as the same number of teeth as the button gear 34. The terminal gear 66 is slightly smaller in diameter than the set gear 43 and has a boss 74 projecting from its upper surface.

A stepped hole 75 is formed from the inside of the boss 74 to the inside of the terminal gear 66. A square hole 76 having a plurality of engagement parts, for example, polygonal (octagonal in this embodiment) is formed on an enlarged diameter part at the lower step of the stepped hole 75.

In the Figures, reference numeral 77 denotes an assembling counter mark which is formed on the upper surface of the boss 74.

The clutch shaft 67 is obtained by machining a brass rod and has a circular hook plate 78 formed at an intermediate part thereof. A regular octagonal cylindrical square shaft 79, which is removably engageable with the square hole 76 is projected from the upper surface of the hook plate 78.

The square shaft 79 allows the clutch shaft 67 to intermittently turn by an equal angle at a time which is equal to an amount of a turning angle, i.e., 45 degrees, of the button gear 34 and the terminal gear 66 and also allows a cam shaft 80 having a generally half moon like shape in section and projecting from the undersurface of the hook plate 78 to move together with the clutch shaft 67.

In the Figures, reference numeral 81 denotes a threaded hole which is formed at the inside of the clutch shaft 67. A machine screw serving as the information altering element 70 is screwed into this threaded hole.

The information altering element 70 is provided at one end thereof with a wide input retainer 82 which is engageable with a rod-like control tool as later described. The input retainer 82 is faced with the rear part of the control hole 12.

In this embodiment, a commercially available machine screw is used as the information altering element 70, and the head part of this machine screw is used as the input retainer 82. By screwing its threaded shaft, the information altering element 70 is connected to the clutch shaft 67.

At the time for rational assembly, in the information altering unit 48, the terminal gear 66 is retained with its boss 74 facing upward, and the clutch shaft 67 is inserted into the stepped hole 75 from below. Then, the square shaft 79 is fitted to the square hole 76 and the altering shaft 67 is inserted in the cover plate 47 from below.

Then, the washer 68 and the set spring 69 is inserted to the clutch shaft 67 projecting from the cover plate 47 and the threaded shaft of the information altering element 70 is screwed in the threaded hole 81 of the clutch shaft 67. By doing so, a set of information altering unit 48 only excluding the control cam 65 is attached to the cover plate 47.

All the other information altering units 48 are attached to the cover plate 47 in the same manner, and the respective terminal gears 66 in their assembled states are received in the first insertion holes 49 and the cover plate 47 is fixed to the block main body 46 by machine screws.

Thereafter, the block main body 46 is counter-rotated and the shaft holes 71 of the control cams 65 are inserted to the cam shafts 80 projecting into the respective cam holes 52. Then, the whole block main body 46 is received in the back plate 13 and the lower end parts of the cam shafts 80 are received in the passage holes 24.

In the information altering unit 48 thus assembled, the clutch shaft 67 and the information altering element 70 are biased forward, i.e., toward the case 14 side by the elasticity of the set spring 69, and the square shaft 79 is engaged with the square hole 76 so that the terminal gear 66 and the clutch shaft 67, and the cam shaft 80 and the control cam 65 can be moved altogether.

On the other hand, the clutch shaft 67 is displaceable in the axial direction against the elasticity of the set spring 69 by the depressing operation of the information altering element 70. At the time of displacement of the clutch shaft 67, the engagement between the square shaft 79 and the square hole 76 is released, so that power transmission from the terminal gear 66 to the clutch shaft 67 can be cut off.

Then, at the time of setting or inputting the password number of the information altering unit 48, the cam shaft 80 and the control cam 65 mounted on the cam shaft 80 are turned by an amount equal to the turning angle of the control button 10 by setting or inputting of the respective control buttons 10 and the position of the cutout groove 72 is made correspondence thereto, so that a state is created whether the engagement between the cutout groove 72 and the engagement claw of the control plate can be engaged with each other as later described.

That is, the clutch shaft 67 or cam shaft 80 of each information altering unit 48 is turned by an amount equal to the turning angle of the corresponding control button 10 to determine the position of the cutout groove 72. The relation between the memory information and the control cam at that time is as shown in FIG. 26.

Figure 26:
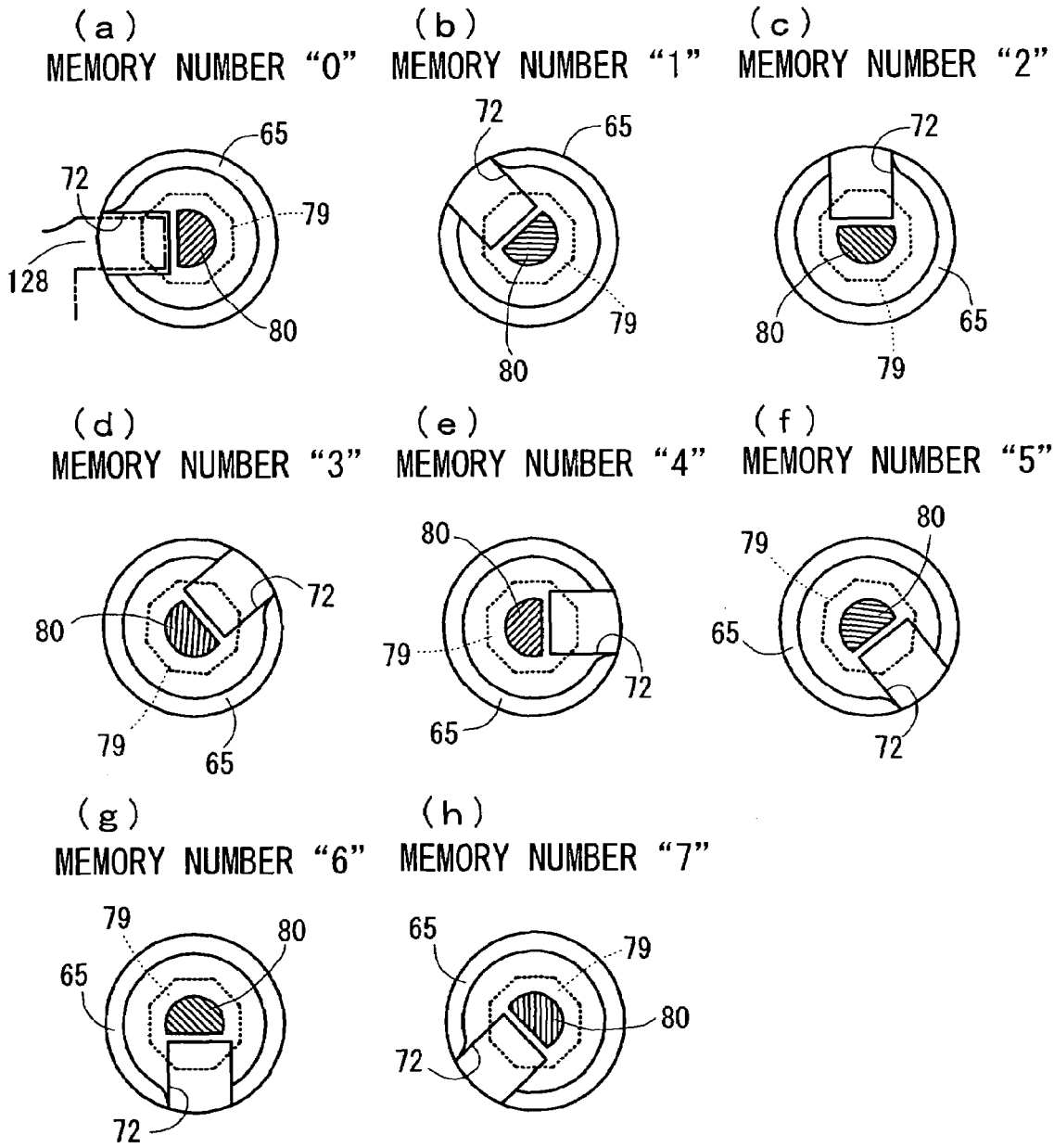
FIG. 26 is an explanatory view showing a relation between a control cam to which the present invention is applied and a cutout groove thereof, and a cam shaft and memory information in sequential order.
Figure 27:
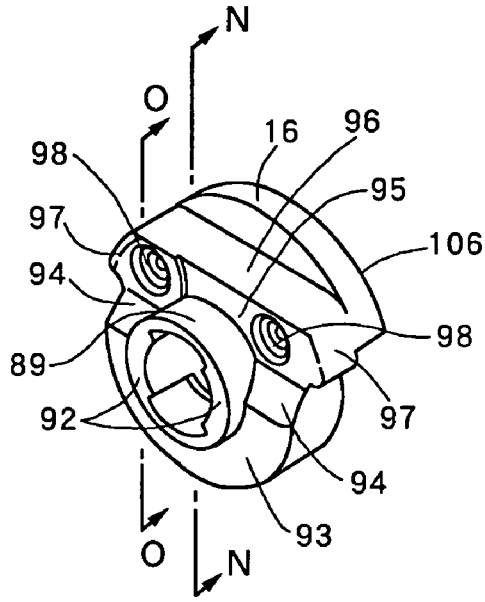
FIG. 27 is a perspective view showing a state of a driving cam to which the present invention is applied.
Figure 28:
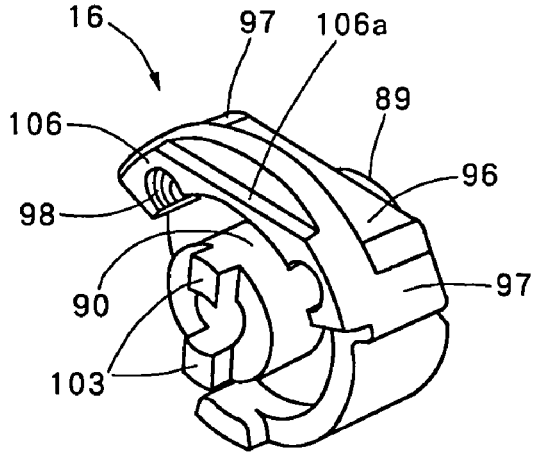
FIG. 28 is a perspective view showing a state of the driving cam to which the present invention is applied, but when view from the opposite side of FIG. 27.

For example, at the time of setting or inputting the memory information "1" obtained by depressing the control button 10 only once, as shown in FIG. 26(*b*), the button gear 34 is turned by an amount equal to the controlling operation made only once, i.e., 45 degrees, thereby turning the cutout groove 72 by the same angle.

Figure 15:
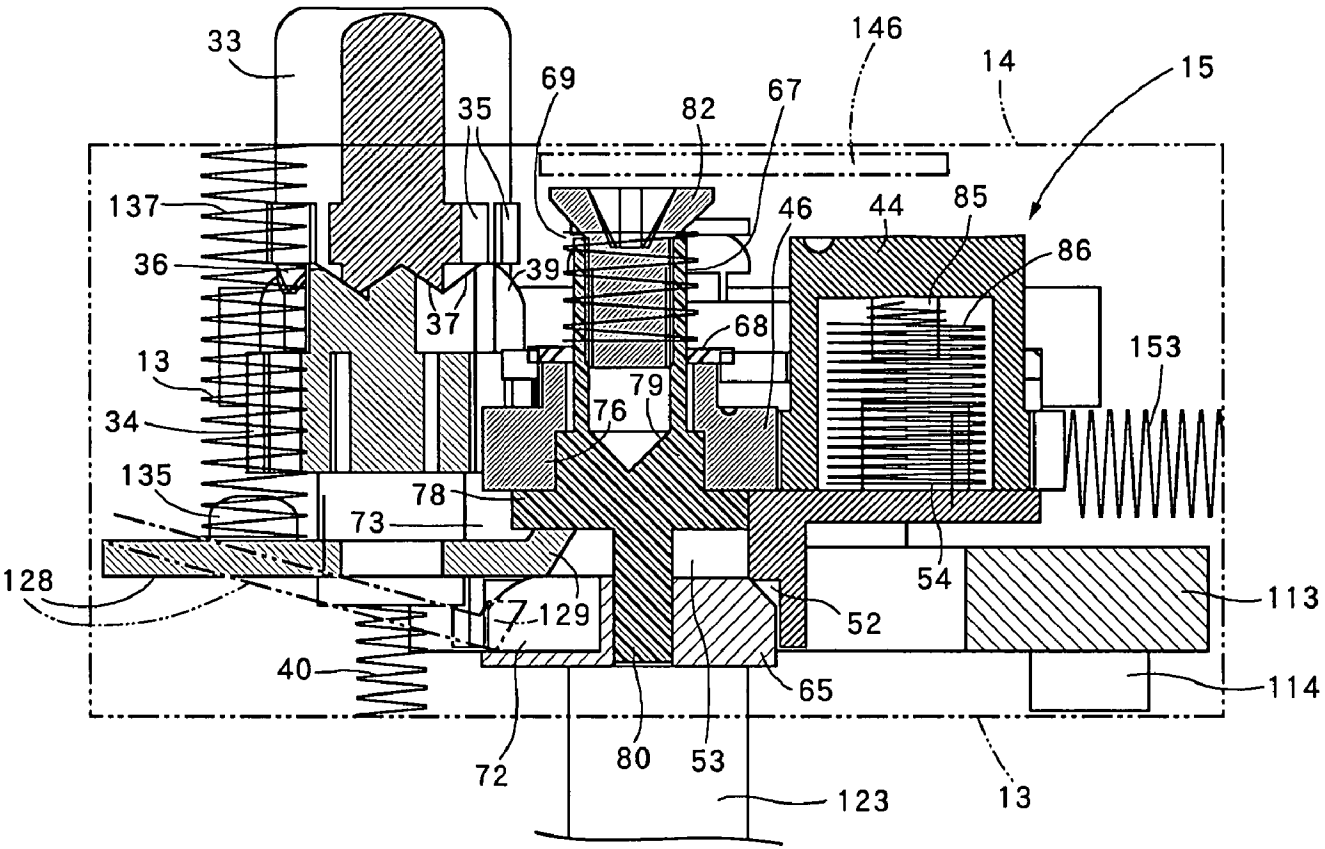
FIG. 15 is an enlarged sectional view taken on line H-H of FIG. 11.
Figure 16:
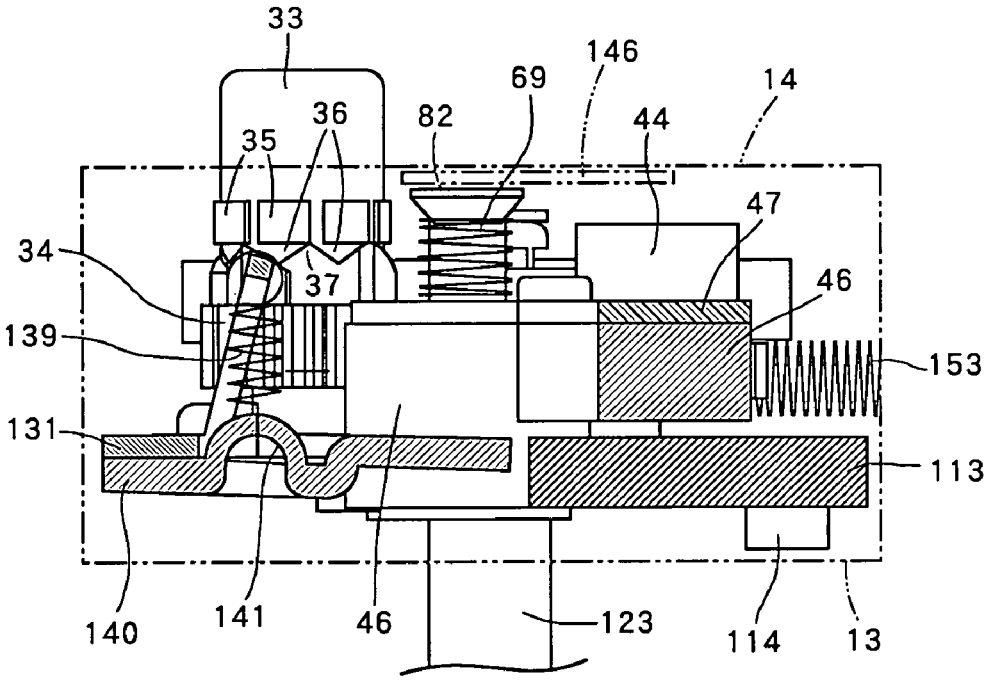
FIG. 16 is an enlarged sectional view taken on line I-I of FIG. 11.

In that case, the cutout groove 72 is in a position unable to engage the engagement claw of the control plate as later described, and the engagement claw is, as shown in FIG. 15, located generally vertically between the hook plate 78 and the control cam 65.

At the time of setting or inputting the memory information "2" obtained by depressing the control button 10 twice, as shown in FIG. 26(*c*), the button gear 34 is turned by an amount equal to the controlling operation made twice, i.e., 90 degrees, and at the time of setting or inputting the memory information "3" obtained by depressing the control button 10 three times, as shown in FIG. 26(*d*), the button gear 34 is turned by an amount equal to the controlling operation made three times, i.e., 135 degrees, thereby turning the cutout groove 72 by the same angles, respectively.

In those cases, the cutout groove 72 is in a position unable to engage the engagement claw, and the engagement claw is, as in the above-mentioned case, is located generally vertically between the hook plate 78 and the control cam 65.

Similarly, the cutout groove 72 is turned by an amount equal to a turning angle obtained by multiplying 45 degrees to the number of times of depressing operation of the control button 10. Also in this case, the cutout groove 72 is in a position unable to engage the engagement claw, and the engagement claw is, as in the above-mentioned case, is located generally vertically between the hook plate 78 and the control cam 65.

On the other hand, at the time of setting or inputting the memory information "0" obtained by not depressing the control button 10, the button gear 34 is not turned, and as shown in FIG. 26(*a*), the cutout groove 72 is correctly faced with the engagement claw and in a position engageable with the engagement claw.

At that time, only when the cutout grooves 72 of all the control cams 65 are correctly faced with the respectively engagement claws and in positions engageable with the engagement claws, they can be engaged with each other and the control plate can be swung.

On the other hand, the set gear 43 is formed of a same material as the terminal gear 66 such that the diameter of the set gear 43 is slightly larger than the diameter of a pitch circle of the terminal gear 66 and the set gear 43 has an increased number of teeth by two (2) than the terminal gear 66. A wide stopper 83, which is synthesized of two teeth, is formed on a part of the set gear 43. This stopper 83 is unable to engage the terminal gear 66. Moreover, owing to this stopper 83, an amount of information which can be set or inputted by only one control button 10 is restricted.

Accordingly, the set gear 43 substantially has the same number of teeth as the terminal gear 66 and therefore, the set gear 43 is engageable with the terminal gear 66.

The barrel part 44 is integrally formed with the set gear 43, and a recessed hole 84 is formed therein. A pin 85 eccentrically projects from an inner part of the recessed hole 84.

A set spring 86, that is a torsion spring, is received in the recessed hole 84. One end of the set spring 86 is hooked to the slitting 54 and a hook part 87 at the other end of the set spring 86 is hooked to the pin 85.

And the elasticity of the set spring 86 is accumulated in accordance with the turning angle of the set gear 43, and the set gear 43 is rotationally biased in the counter-rotating direction by its elasticity so that this rotational motion may act on the terminal gear 66.

In the Figures, reference numeral 88 denotes an assembling counter mark which is formed on the surface of the barrel part 44.

The driving cam 16 is turnably received in a cam hole 101 which has a large diameter and which is formed on the inner surface of the case 14. The driving cam 16 is normally biased by a cam spring (not shown) so that it can turnably return to the original position.

The driving cam 16 is formed in a thin generally disc-like shape from a diecast zinc alloy. The driving cam 16 has turnable shafts 89, 90 projecting from its front and rear surfaces, respectively. Those shafts 89, 90 are turnably supported in the passage hole 18 of the back plate 13 and the passage hole 102 of the case 14.

Of them, the turnable shaft 89 on the rear side is turnably inserted in the recessed hole 17 of the back plate 13. A connection bar 91 associating with the main lock and its inner side handle door 5 is turnably inserted in the turnable shaft 89 and its turning angle is restricted by a pair of projections 92.

One end of the connection bar 91 is disposed between the projections 92, 92 with a tolerance such that the above-mentioned one end of the connection bar 91 is substantially unable to engage the projection 92, thus making it unable to turn the driving cam 16 through turning operation of the inner side door handle 5.

The driving cam 16 is provided at its rear end part with a generally half moon-like slide surface 93. The slide surface 93 is slideably received in the periphery of an inner side opening part of the recessed hole 17, and tapered engagement parts 94, 94 engageable with a lock plate as later described are formed on its opposite sides. A block cam 95 projects from a skirt part of the engagement part 94.

The block cam 95 has a flat cam end 66 engageable with a memory releasing link as later described. Cam edges 97, 97 project from the opposite sides of the cam end 96. One of the cam edges 97 is engageable with the memory releasing link at the time of turning operation of the block cam 95.

In the Figures, reference numeral 98 denotes a pair of left and right threaded holes formed at the opposite sides of the block cam 95. A door suspending base setting thread (not shown) can be crewed in one of the threaded holes 98. Reference numeral 99 denotes a connection bolt received in an inner part of the turnable shaft 89, and a threaded shaft of the connection bolt 99 can be screwed in a threaded hole 100 of the door handle 4.

The turnable shaft 90 is turnably inserted in the passage hole 102, and it has a pair of dogs 103 projecting from its one end face. This pair of dogs 103 can be fitted between a pair of dogs 105 projecting from one end part of the handle shaft 104 of the door handle 4.

In the Figures, reference numeral 106 denotes a slide surface formed on a front end face of the driving cam 16. This slide surface 106 is slideably received in the bottom surface of the cam hole 101. Reference numeral 107 denotes a recessed hole which is formed at a lower part of the outer surface of the case 14. A seal rib 108 of the door handle 4 can be inserted in the recessed hole 107.

Reference numerals 109, 110 denote threaded holes adapted to connect a pipe shaft which projects from the inner side of the case 14. Reference numeral 111 denotes a pair of right and left threaded holes disposed at upper and lower positions of the cam hole 101, and 112, a pair of left and right cutout grooves which are open to the peripheral surface of the lower part of the cam hole 101, respectively. Opposite ends of the cam spring can be hooked to the cutout grooves 112.

Figure 31:
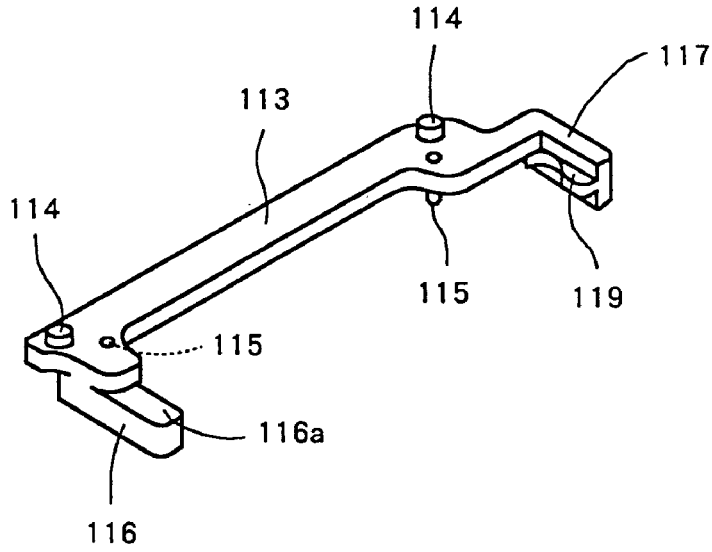
FIG. 31 is a perspective view showing a memory releasing link to which the present invention is applied.
Figure 32:
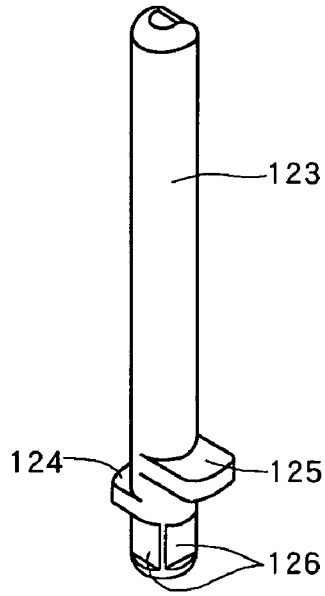
FIG. 32 is a perspective view showing a changeover shaft to which the present invention is applied.

The memory releasing link 113 is formed in a generally horizontal "U" shape from diecast zinc alloy, and it has, as shown in FIG. 31, an inner side surface which is engageable with the stepped part of the block main body 46. The memory releasing link 113 is provided with two kinds of pins 114, 115 projecting from opposite side surfaces of its opposite end parts.

Of those two kinds of pins 114, 115, the pin 114 is engageably inserted in the long groove 27 of the back plate 13, and the other pin 115 is engageably inserted in the guide groove 59 of the block main body 46.

Engagement arms 116, 117 project from the opposite end parts of the memory releasing link 113. Of those engagement arms 116, 117, the engagement arm 116 is arranged such that its outer peripheral part is engageable with the cam end 96 of the driving cam 16.

In the Figures, reference numeral 116*a* denotes an engagement stepped part disposed at a distal end part of the engagement art 116 and engageable with a lock plate as later described.

The engagement arm 116 is operatively connected to the turning motion of the driving cam 16 to thereby move the memory releasing link upward and move the block main body 46 or block assembly 15 outward, so that the engagement between the button gear 34 and the terminal gear 66 can be released.

On the other hand, the engagement arm 117 is slideably received in a guide groove 118 which is formed at an upper part within the case 14, and it has an engagement projection 119 projecting from the inner side of its forward end part. The engagement projection 119 can be engaged with a changeover shaft as later described.

In the Figures, reference numeral 120 denotes a set spring interposed between the engagement arm 117 and the inner side surface of the case 14. The memory releasing link 113 is biased downward through the elasticity of the set spring 120.

Reference numeral 121 denotes a partition wall formed proximal to the guide groove 118. The partition wall 121 is engageable with the outer surface of the hook part 56 of the block main body 46. A shaft hole 122 is formed in a basal part of the partition wall 121. A front end part of the changeover shaft 123 is turnably supported by the shaft hole 122.

The changeover shaft 123 is shaped in a rod-like shape from diecast zinc alloy. The changeover shaft 123 has two small and large cams 124, 125 which are slightly axially spaced apart and mutually diametrically projecting from its front end part.

Those cams 124, 125 are placed in their horizontal postures when in locked, and released their engagement with the inner surface of the engagement arm 117. By the normal/counter-rotational turning operation of the changeover shaft 123, the changeover shaft 123 can be engaged with the inner surface of the engagement arm 117 of the memory releasing link 113.

And at the time of engagement, the block main body 46 is separated outward to release the engagement between the terminal gear 66 and the button gear 34. At that time, an amount of separation displacement of the block main body 46 is set to an amount equal to the lengths of the cams 124, 125, so that empty lock can be used or the password number can be altered.

That is, at the time of using of the empty lock, the changeover shaft 123 is counter-rotated through the changeover knob 6 to thereby bring the long side cam 125 into engagement with the inner surface of the arm 117 and bringing the block main body 46 sufficiently outward, so that the engagement between the terminal gear 66 and the button gear 34 can be released. Moreover, the engagement between the cutout groove 72 of the control cam 65 and the engagement claw of the control plate is released so that the door handles 4, 5 can be turned.

On the other hand, at the time of altering the password number, the changeover shaft 123 is turned normally through the changeover knob 6 to bring the short cam 124 on the front end part side into engagement with the inner surface of the engagement arm 117, so that the block main body 46 is separated by an amount slightly smaller than at the time of using empty lock.

Then, only the engagement between the terminal gear 66 and the button gear 34 is released, and the engagement between the cutout groove 72 of the control cam 65 and the engagement claw of the control plate is maintained to maintain the current memory information, so that alternation of the password number can be made.

In the Figures, reference numeral 126 denotes a square shaft part which is formed on a front end part of the changeover shaft 123. The plate spring 127 is elastically pressurizeably disposed at the square shaft part 126, so that the turning angle of the changeover shaft 126 can be detected.

The control plate 128 is swingable toward the door 1 side at the time of unlocking of the button-operated lock 2 where an engagement claw 129 of a control plate 128 is inserted between the hook plate 78 within the block main body 46 and the control cam 65 through the cutout groove 73, and the opening directions of the cutout grooves 72 of the respective control cams 65 are aligned.

Figure 33:
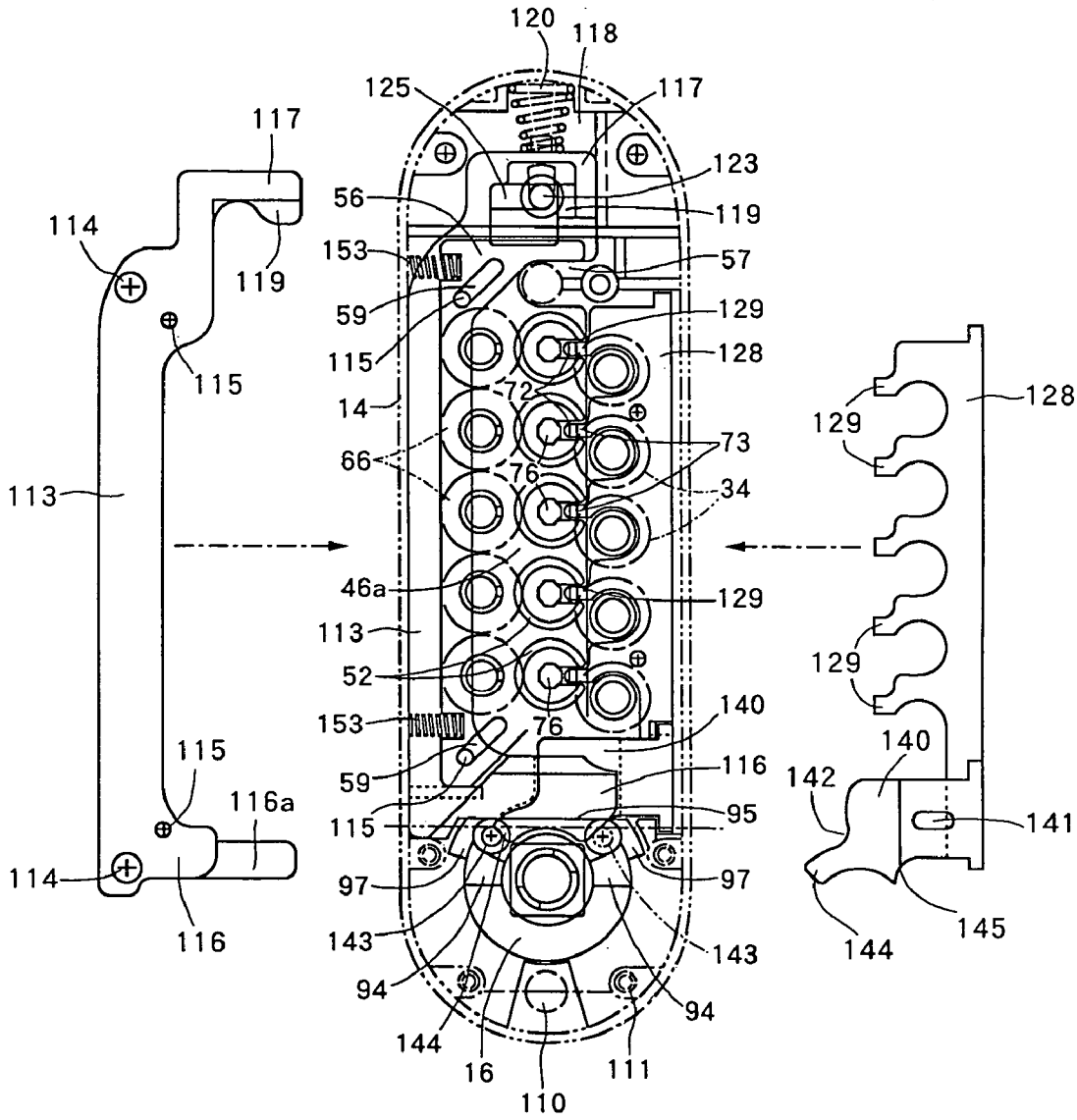
FIG. 33 is a front view showing an assembling state of the memory releasing line to which the present invention is applied and a control plate.
Figure 34:
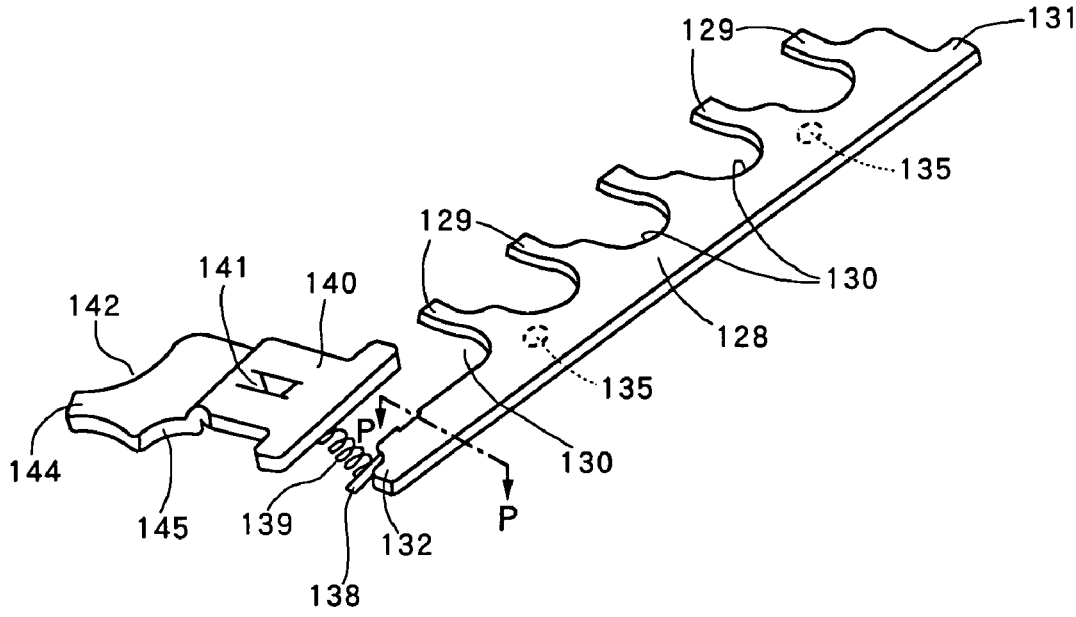
FIG. 34 is a perspective view showing a control plate to which the present invention is applied and a lock plate, in which an assembling state thereof is shown.
Figure 35:
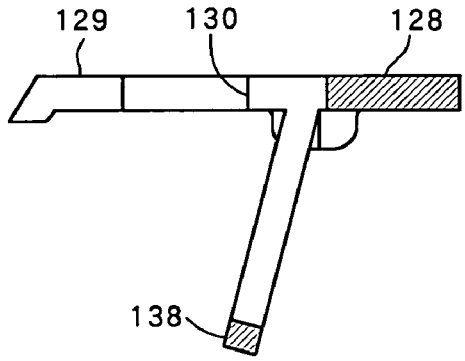
FIG. 35 is an enlarged sectional view taken on line P-P of FIG. 34.
Figure 36:
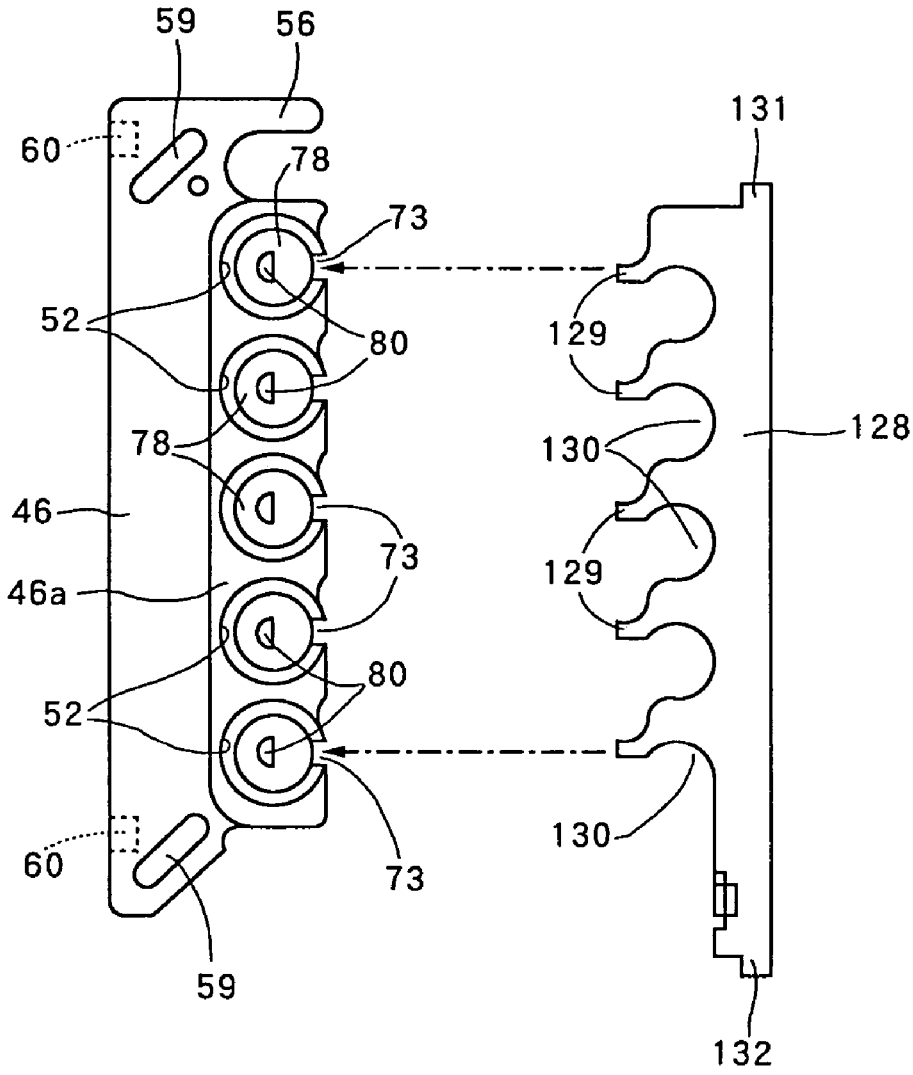
FIG. 36 is a front view showing an assembling state of the control plate to which the present invention is applied and a block main body.
Figure 37:
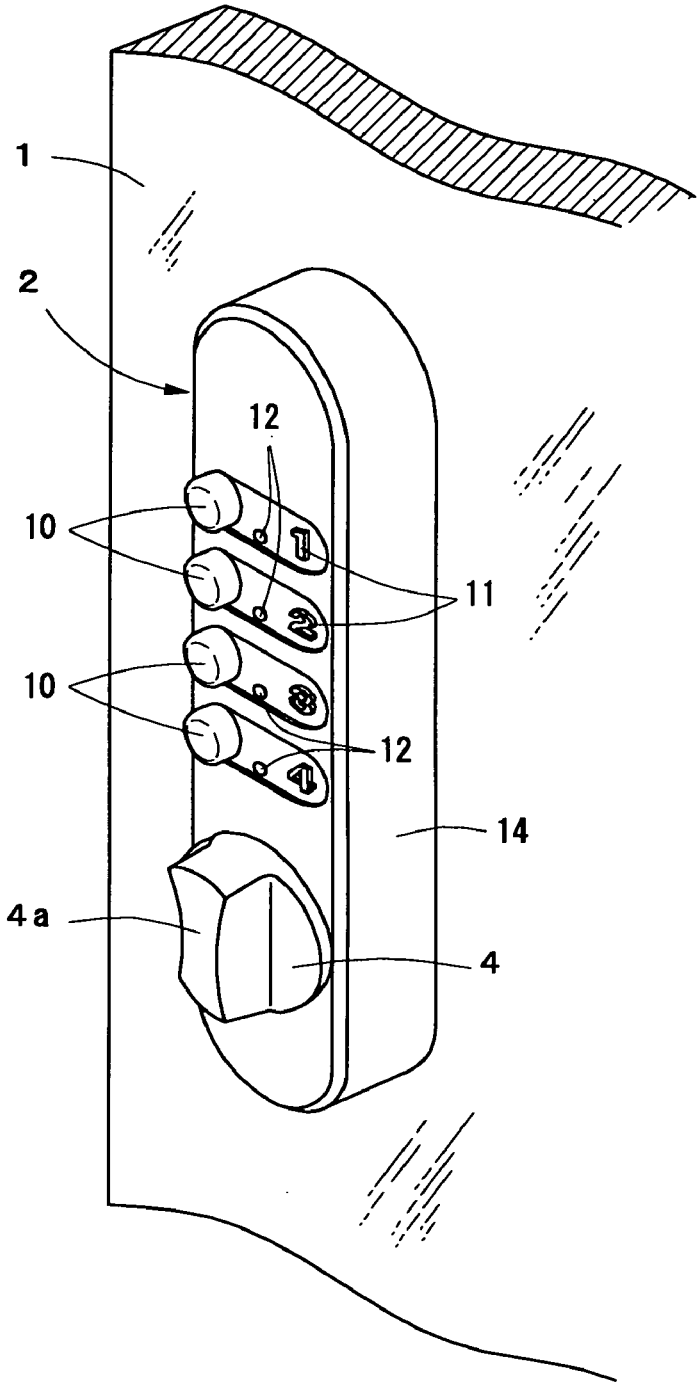
FIG. 37 is a perspective view showing a button-operated lock according to the second embodiment of the present invention, in which the button-operated lock is mounted on the entrance door.
Figure 38:
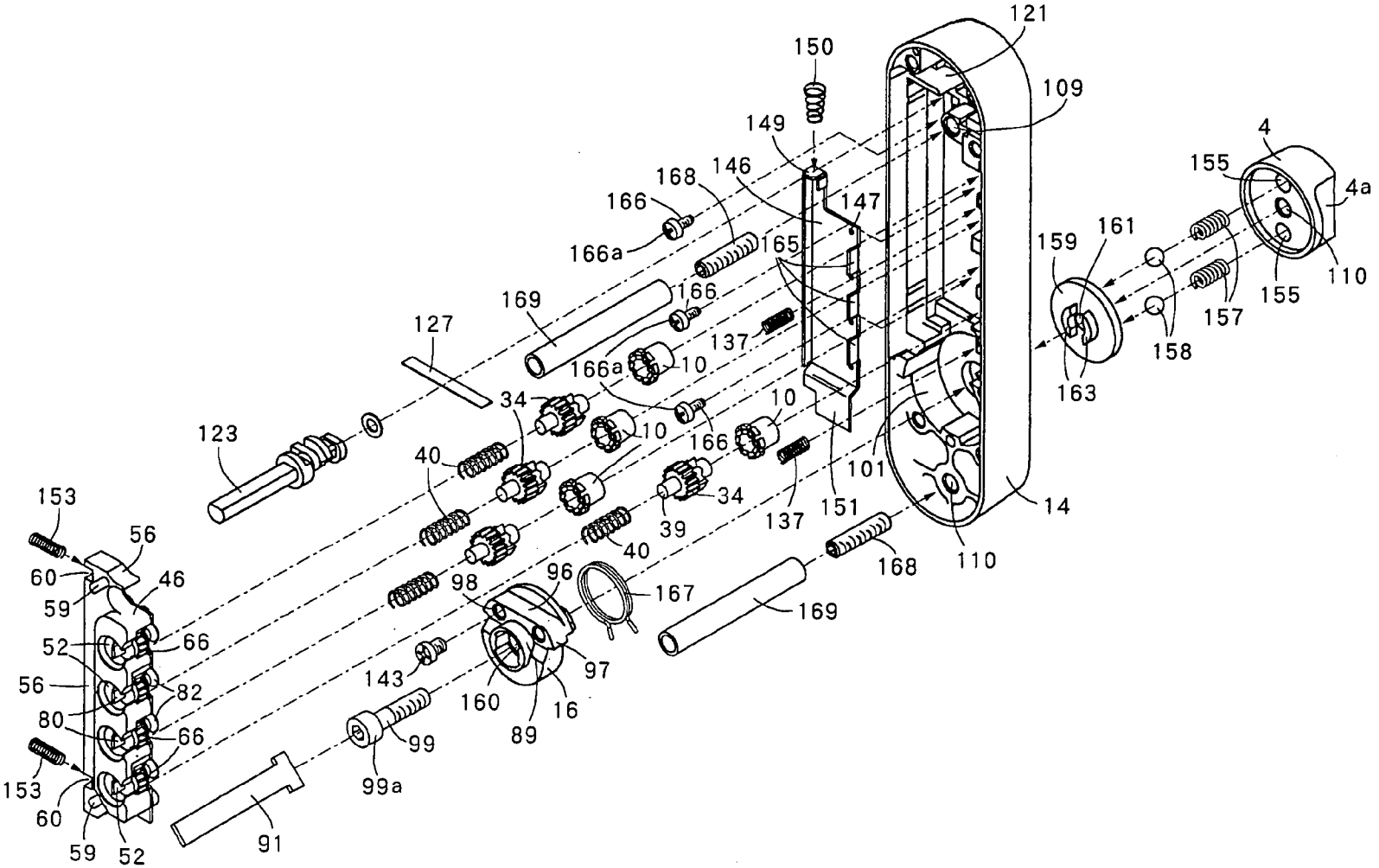
FIG. 38 is a perspective view showing an essential part of the button-operated lock according to the second embodiment in an exploded manner, in which a back plate is omitted.
Figure 39:
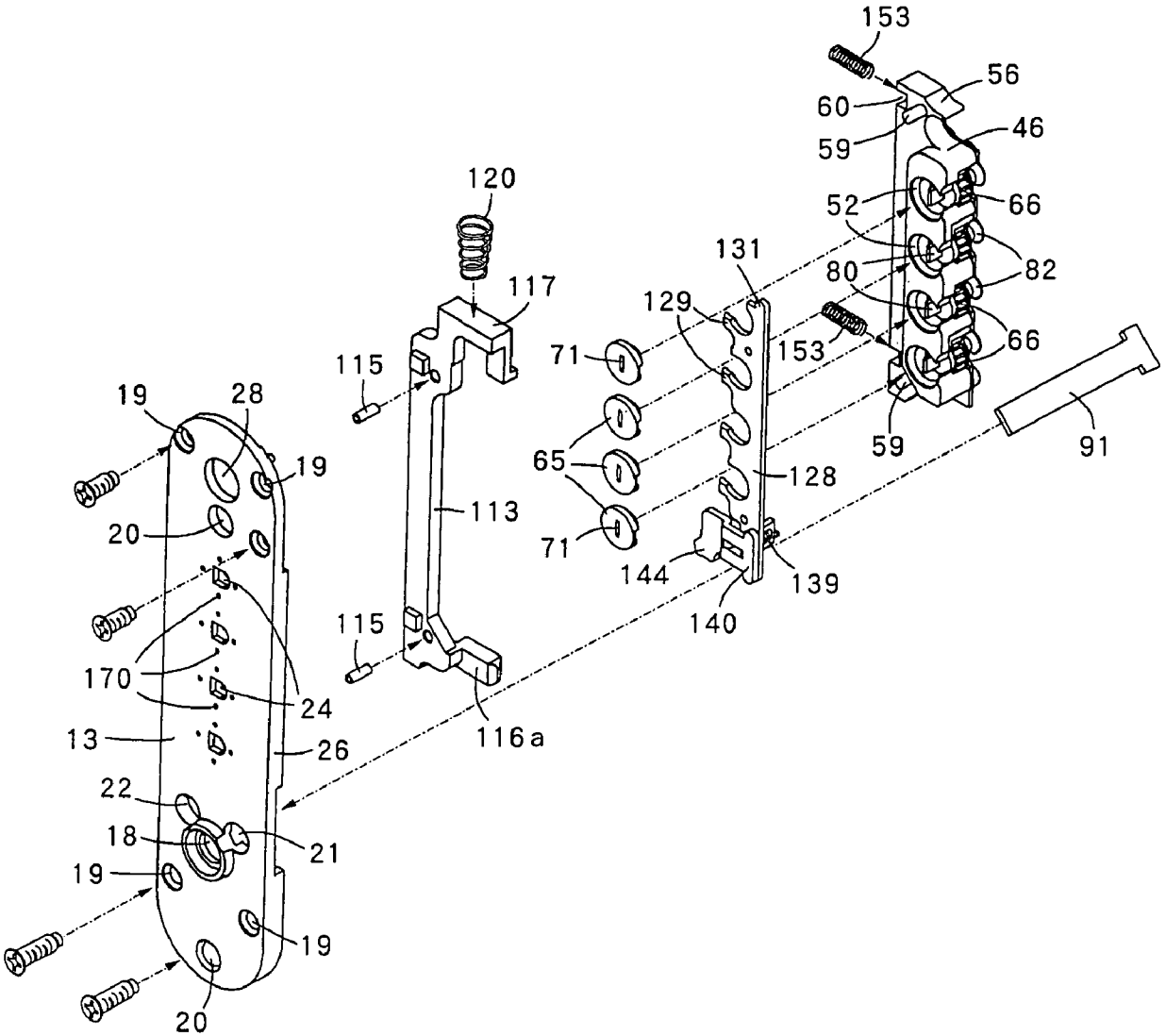
FIG. 39 is a perspective view showing the button-operated lock according to the second embodiment in an exploded manner, in which a case is omitted.
Figure 40:
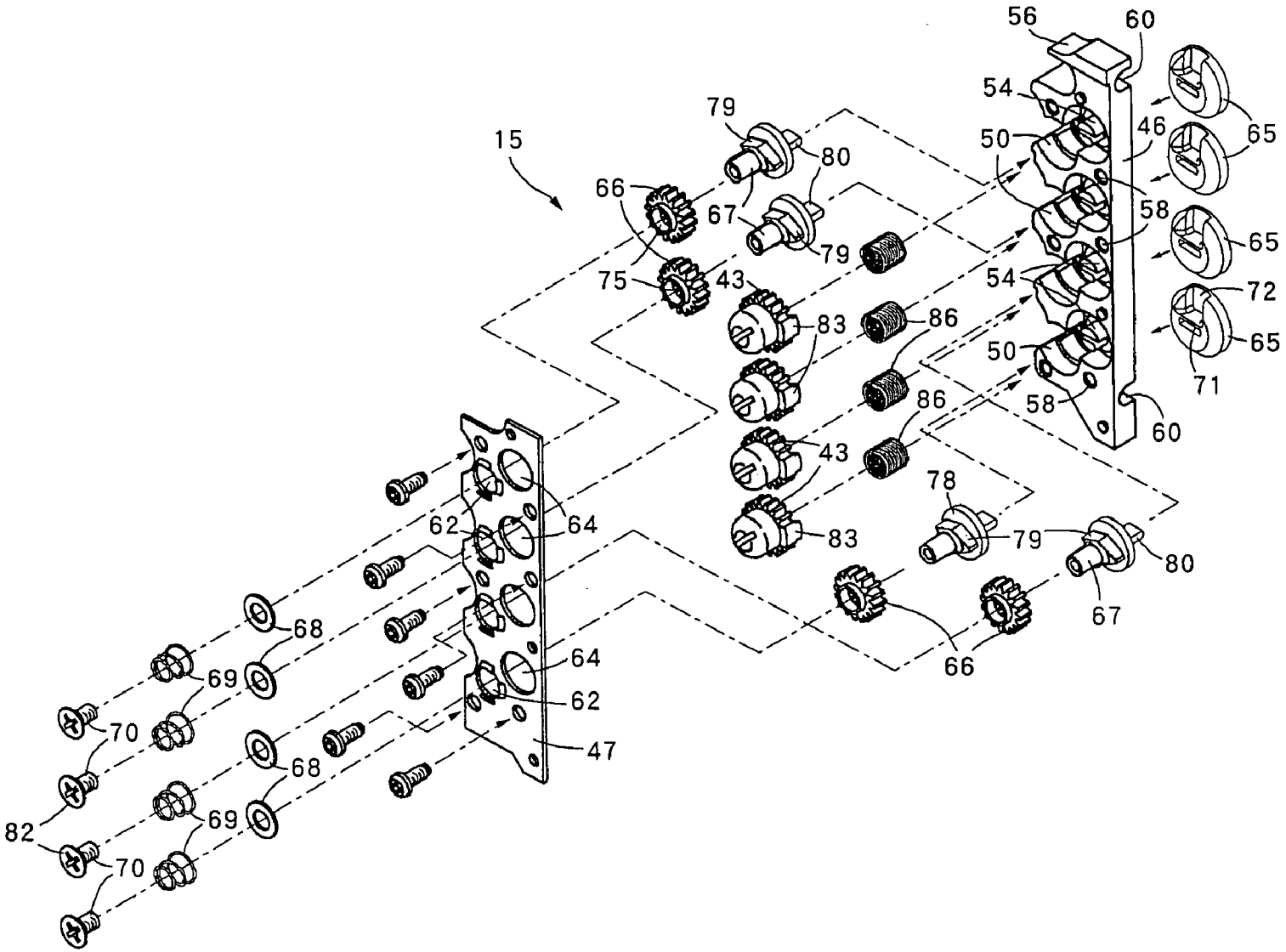
FIG. 40 is a perspective view showing, in an exploded manner, a block assembly which is applied to the button-operated lock according to the second embodiment.
Figure 41:
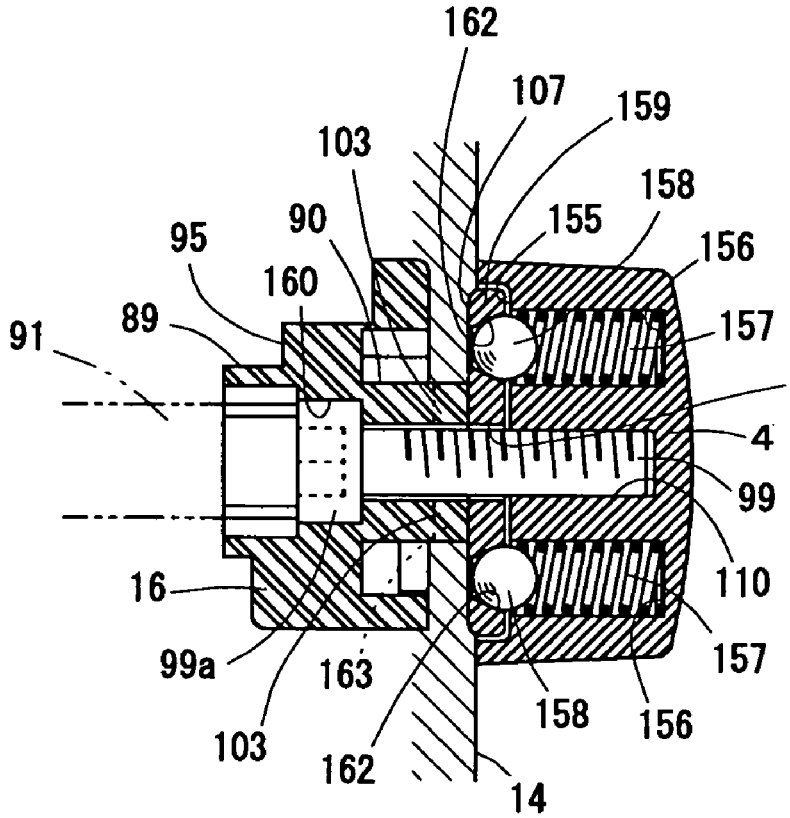
FIG. 41 is a sectional view showing an essential part of a safety mechanism of a door handle which is applied to the button-operated lock according to the second embodiment.
Figure 42:
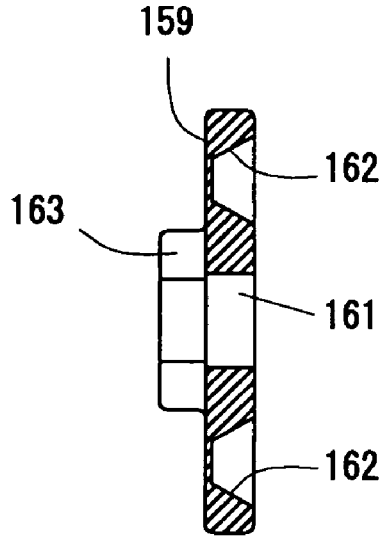
FIG. 42 is a sectional view showing an essential part of a ball retainer which is applied to the safety mechanism of the door handle according to the second embodiment.
Figure 43:
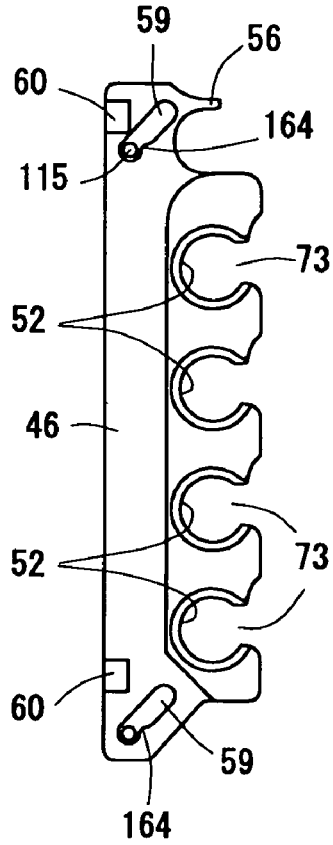
FIG. 43 is a front view showing an essential part of the safety mechanism which is applied to a block main body according to the second embodiment, in which a guide groove and a pin are in engagement relation.

That is, the control plate 128 is, as shown in FIGS. 33 through 35, formed in a generally elongated rectangular plate shape by pressing a steel plate The control plate 128 has the same number of circular or semi-circular cutouts 130 as the number of the control buttons 10 which are formed at its lengthwise one side. The button retainer 25 can be received in the inner side of each cutout groove 130. An engagement claw 129 projects from an opening edge part of each cutout groove 130. The engagement claw 129 is removably inserted between the hook plate 78 within the block main body 46 and the control cam 65 through the cutout groove 73

A forward end part of the engagement claw 129 is acutely bent in the direction of the thickness of the control plate 128 and its bending end part can be engaged with the hook plate 78.

In the Figures, reference numerals 131, 132 denote pivot parts projecting from one side end parts of the control plate 128. The pivot parts 131, 132 are pivotably received in an engagement groove 133 which is provided at an inner side end part of the case 14. A hooking wall 134 projects from the inner side end part of the back plate 13 in such a manner as to face with the opening edge part of the engagement groove 133 and pivotably supported by one side edge part of the control plate 128.

That is, the control plate 128 is attached to the side parts within the back plate 13 and the case 14 such that it can swung in the back and forth direction about the hooking wall 134. A set spring 137 is interposed between a spring retainer 135 projecting from the surface of the control plate 128 and a spring retainer 136 formed on the case 14. The control plate 128 is backwardly swingably biased through the elasticity of the set spring 137. The engagement claw 129 is engageable with the control cam 65.

A spring hanger 138 is diagonally bent to one end part in the longitudinal direction of the control plate 128, and one end of a lock spring 139 is hooked to the spring hanger 138 and the other end of the lock spring 139 is hooked to a lock plate 140.

The lock plate 140 is shaped into a generally laterally long rectangular shape by pressing a steel plate. The longitudinal sectional configuration of the lock plate 140 is formed in a generally letter "Z" shape.

A spring hanger 141 is upwardly press-worked in a generally ring-like shape at an intermediate part of the lock plate 140. The lock plate 140 has recessed engagement parts 142, 144, 145 formed at its forward end part.

Of those engagement parts 142, 144 145, the engagement part 142 is engageable with the engagement stepped part 116*a* of the memory releasing link 113, and the remaining engagement parts 144, 145 are engageable with the head parts of left and right suspending base position setting machine screws 143.

One end of the lock plate 140 is placed behind a lower end part of the control plate 128 and the other end is placed on the engagement stepped part 116*a* of the engagement arm 116. The engagement part 142 is engageable with the engagement stepped part 116*a*. Normally, the lock plate 140 is engageably biased to the control plate 128 through the elasticity of the lock spring 139.

In the Figures, reference numeral 146 denotes an elongate rectangular protection plate which is made of a steel plate and which constitutes a first safety mechanism of the button-operated lock 2. The protection plate 146 is faced with the control hole 12 and vertically movably attached to the inner surface of the case 14. A plurality of through-holes 147 each having a same diameter as the control holes 12 are formed at one side end part of the protection plate 146 in such a manner as to correspond to the control holes 12, and elongate machine screw holes 148 are formed proximate thereto. The protection plate 148 is movably attached to the case 14 through machine screws and horizontal U-shaped metal pieces or washers (not shown), or the like.

A spring retainer 149 whose end edge is bent at right angles is formed at the upper end part of the protection plate 146. A push spring 150 is interposed between the spring retainer 149 and the partition wall 121. The protection wall 146 is biased toward the driving cam 16 side through the elasticity of the push spring 150.

An engagement piece 151 having a letter L-shape in section is formed at a lower end part of the protection plate 146. The end edge of the engagement piece 151 is engageable with the engagement stepped part 106*a* of FIG. 28 formed at a slide surface of the driving cam 16. Owing to this arrangement, the protection plate 146 can be moved up and down through the turning motion of the driving cam 16.

That is, any evil attempt should be made to insert a control tool as later described into the control hole 12 and to turn the door handle 4 for unlocking by means of falsification or the like while in the locked position, such an unlocking operation would be prohibited by preventing the turning of the driving cam 16 due to engagement between the engagement piece 151 and the engagement stepped part 106*a*.

In FIGS. 5 through 9, the protection plate 146 is attached to the guide groove 41 and the slide groove 42. It is also accepted that those grooves 41, 42, for example, are eliminated and those areas are flattened so that the protection plate 146 is slideably attached thereto and in addition, the protection plate 146 is attached as tightly as possible to the inner sides of the control holes 12. Thus, insertion of the control tool becomes impossible to thereby effectively prevent any attempt for picking.

Figure 29:
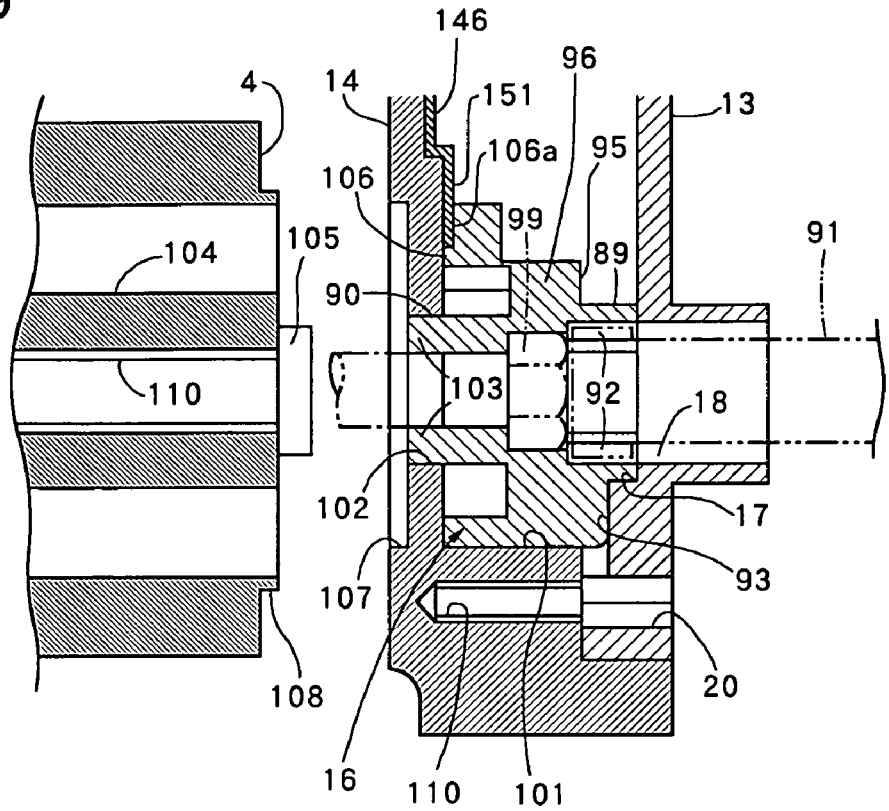
FIG. 29 is a sectional view taken on line N-N of FIG. 27, showing an assembling state of the driving cam to which the present invention is applied and a door handle on the outdoor side.
Figure 30:
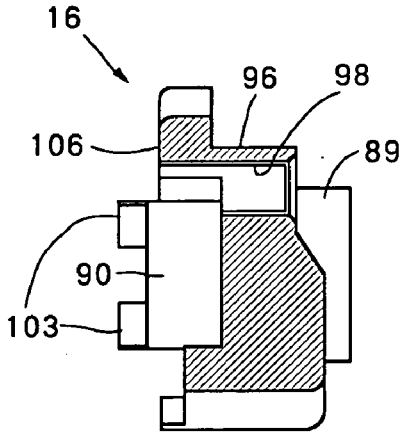
FIG. 30 is a sectional view taken on line O-O of FIG. 27.

It is also an interesting alternative that as shown in FIG. 29, the engagement element 151 is interposed between the driving cam 16 and the case 16, and the engagement piece 151 is engaged with the engagement stepped part 106*a*. Accordingly, even if the driving cam 16 should be subjected to an enormous turning force given by a thief, the engagement piece 151 would not be bent and prohibit the driving cam 16 from turning. Thus, the picking prevention effect is more enhanced.

In the Figures, reference numeral 152 denotes a recessed control mark and reference numeral 154 denotes a rod-like control tool which is used at the time of setting or inputting the password number and altering the same. The control tool 154 can be inserted in the control holes and through-holes 147.

In the button-operated lock 2 thus constructed, a plurality of information can be set or inputted to each of the plurality of control buttons 10. Accordingly, a large number of password numbers can be obtained compared with the conventional technique in which only one memory information is set or inputted to a plurality of control buttons 10 and plural sorts of password numbers are obtained by changing the combinations of the control buttons 10. Since the range of selection can be widened, the safety performance can be enhanced and the number of the control buttons 10 can be reduced to that extent. Moreover, no reset button as later described is required contrary to the conventional technique. Thus, the number of component parts can be reduced and the structure can be simplified. In addition, the device according to the present invention can be manufactured easily and economically.

Accordingly, the back plate 13 and the case 14 can be made short and small, and reduced in width. Thus, the invented device can be made compact and light weight, and the appearances of the button-operated lock 2 and the door 1 can be improved. Moreover, the backset dimensions $L_{BS}$ from the side end face of the door 1 to the center of the lock (not shown) can be made compact and thus, this lock can be suited to be used for a kitchen door.

Moreover, in the button-operated lock 2, plural sorts of memory information can be set or inputted in accordance with the number of times of depressing operation of the control buttons 10. Accordingly, there is no worry, when compared with the conventional technique, for being perceived the memory information from the finger prints printed on the surfaces of the control buttons 10 and the wearing condition of the surfaces of the control buttons 10. Thus, the safety performance can be enhanced.

Moreover, in the button-operated lock 2, the turning force of the door handles 4, 5 is transmitted to the memory releasing line 113 to move the block assembly 15 so that the engagement between the terminal gear 66 and the button gear 34 is maintained/cut off. Since the direct association of the door handles 4, 5 and the respective gears 34, 43, 66 is avoided, there is no worry that the password number is perceived by turning operation of the door handle 4. Thus, the safety performance can be enhanced in this respect, too.

Furthermore, the protection plate 146 is attached to the back of the case 14 so that entry of a picking tool to the driving cam 16 through the control hole 12 can be prevented. Moreover, since the driving cam 16 cannot be turned by up and down motion of the protection plate 146 attempted from the outside, even if it is attempted, for example, to insert a picking wire through the control hole 12 to turn the driving cam 16, false unlocking operation can be prevented because the engagement piece 151 is engaged with the engagement stepped part 106*a* to prohibit the turning motion of the driving cam 16.

Next, the procedure for making the button-operated lock 2 will be described. For example, the door handles 4, 5, the back plate 13, the case 14, the driving cam 16, the button case 33 and the button gear 34, the block main body 46, the memory releasing link 113, the changeover knob 123, etc. are shaped from diecast zinc alloy.

The terminal gear 66, the set gear 43 and the control cam are molded from synthetic resin, the seat plate 3, the cover plate 47, the control plate 128, the lock plate 140, the protection plate 146, etc. are press-molded from a sheet metal, and the clutch shaft 67 is machined. At that time, the guide ring 31 is integrally molded with or press-fitted to the opening edge part of the button insertion hole 30 which is formed in the case 14.

The procedure for reasonably assembling the component parts thus obtained will now be described. The block assembly 15 is preliminarily assembled. In that event, the same number, i.e., five (5), of the information altering units 48 as the control buttons 10 are assembled, and then the cover plate 47 is attached to the main body 46.

The procedure for assembling each information altering unit 48 is made in the manner as shown in FIG. 21. Firstly, the first and second gear insertion holes 49, 50 are placed in such a manner as to face upward and the block main body 46 is set to an assembling jig (not shown).

Next, the boss 74 is placed in such a manner as to face upward and the terminal gear 66 is retained by the boss 74. The clutch shaft 67 is inserted from below the stepped hole 75, the square shaft 79 is fitted to the square hole 76, and the upper part of the clutch shaft 67 is inserted in the machine screw hole 63 from below the cover plate 47.

Then, the washer 68 and the set spring 69 are inserted in the clutch shaft 67 projecting from the cover plate 47, the threaded shaft of the information altering element 70 is screwed in the threaded hole 81 of the clutch shaft 67, and one set of the information altering units 48 only excluding the control cam 65 is attached to the cover plate 47. Similarly, other information altering units 48 are attached to the cover plate 47.

Subsequently, the set spring 86 is inserted in the second gear insertion hole 50 of the block main body 46, one end of the set spring 86 is hooked to the spring retainer 54, the reset gear 43 is inserted in the spring 86 from above, and the inside pin 85 is inserted in the hook part 87 of the set spring 86.

Then, the cover plate 47 with the information altering unit 48 assembled thereto is retained, the terminal gear 43 and the hook plate 78 of each information altering unit 48 are received in the first gear insertion hole 49 and the passage hole 53, the terminal gear 43 and its adjacent reset gear 43 are engaged with each other.

The insertion hole 64 of the cover plate 47 is inserted in the boss 44 of the terminal gear 43, and the cover plate 47 is fixed to the block main body 46 by machine screws and then, the procedure is held in a standby state for assembling the same to the back plate 13 and the case 14.

Next, the guide groove 41 and the slide groove 42 are placed in such a manner as to face upward, the case 14 is set to an assembling jig (not shown), and the seal rib 108 of the door handle 4 is inserted in the recessed hole 107.

Then, the driving cam 16 with a cam spring mounted on the turnable shaft 90 is received in the cam hole 102 from the upper side of the case 14, and the turnable shaft 90 is inserted in the passage hole 102 and fitted with the dogs 103, 105. Then, the connection bolt 99 is screwed in the threaded hole 100 of the door handle 4, and the door handle 4 and the driving cam 16 are connected such that they can turn in synchronism.

Thereafter, the suspending base position setting machine screw 143 is screwed in one of the threaded holes 98, 98 of the driving cam 16 depending on the suspending base position of the door 1.

Then, the button case 33 is inserted in each guide ring 31 attached to the case 14 from the inner side, and the hooking element 35 is hooked to the opening edge part of the button insertion hole 30.

Figure 10:
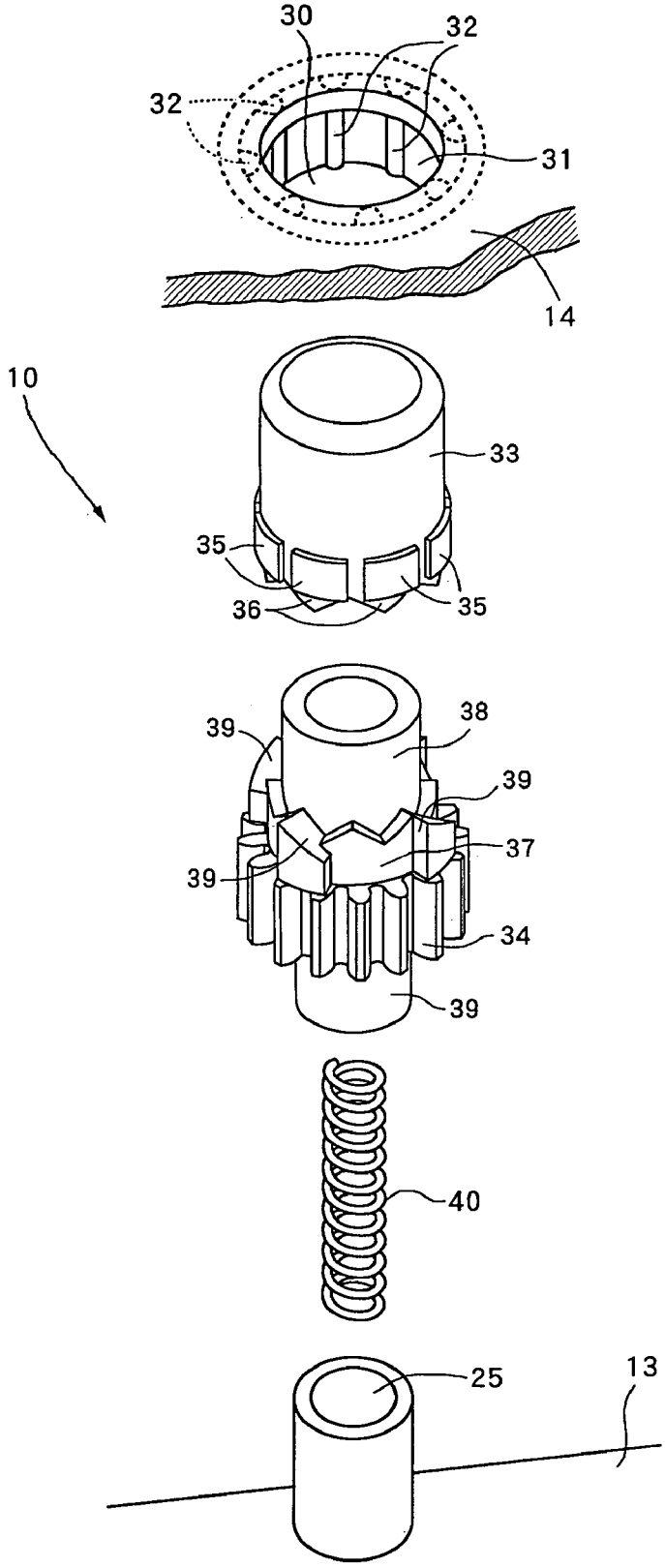
FIG. 10 is a perspective view showing a control button to which the present invention is applied, in an exploded manner.
Figure 11:
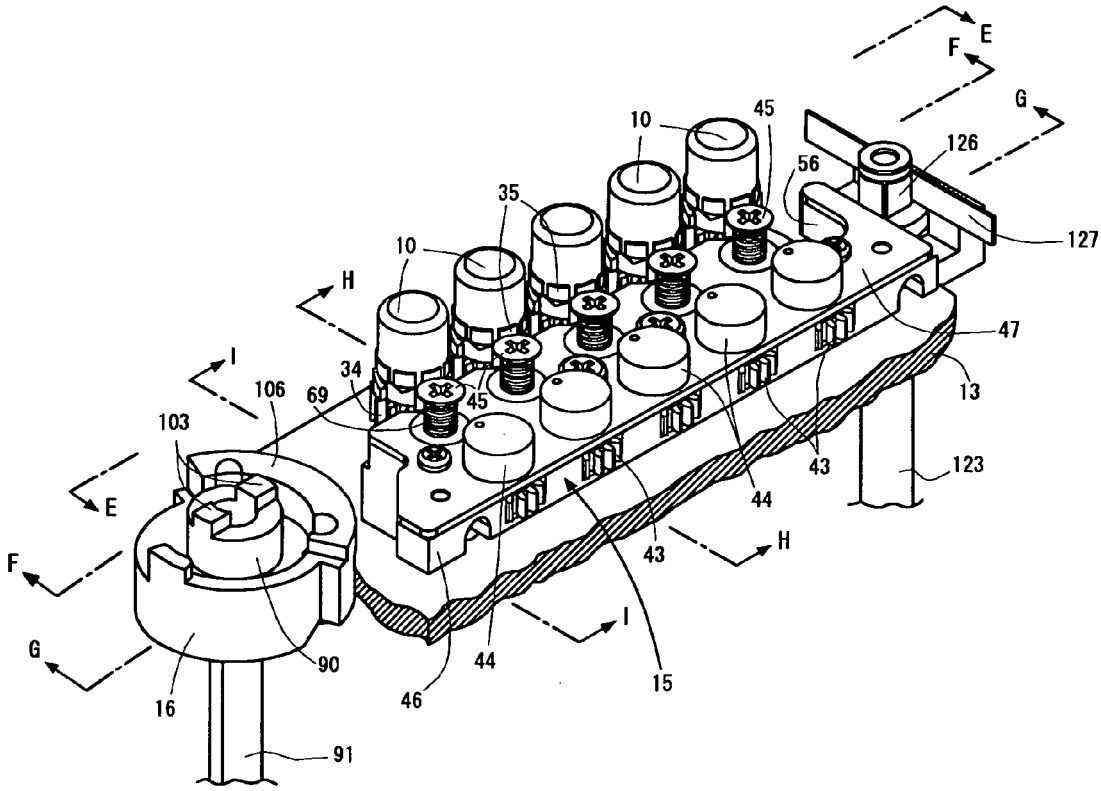
FIG. 11 is a perspective view showing an assembling state of a block assembly to which the present invention is applied, in which a case is omitted.
Figure 12:
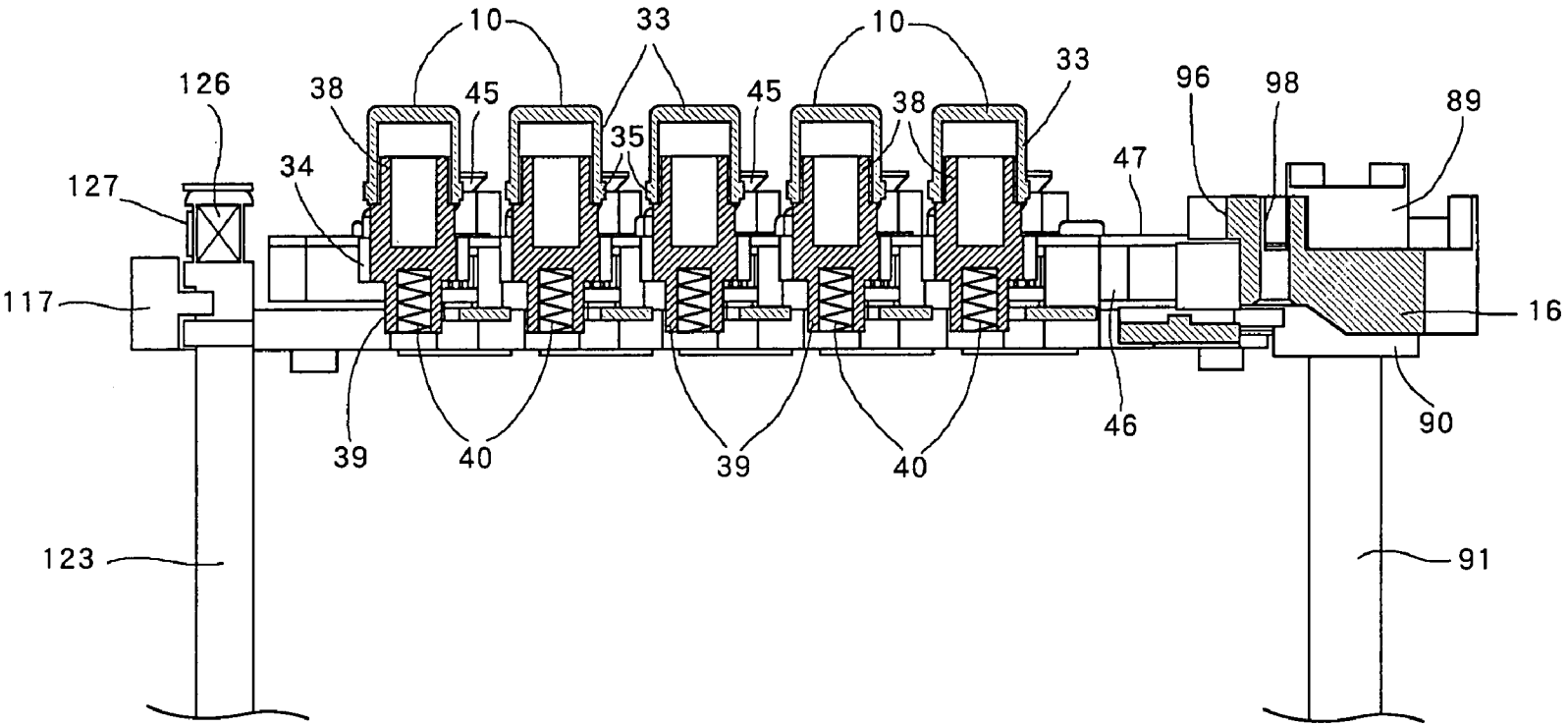
FIG. 12 is a sectional view taken on line E-E of FIG. 11, in which a part of a back plate is omitted.
Figure 13:
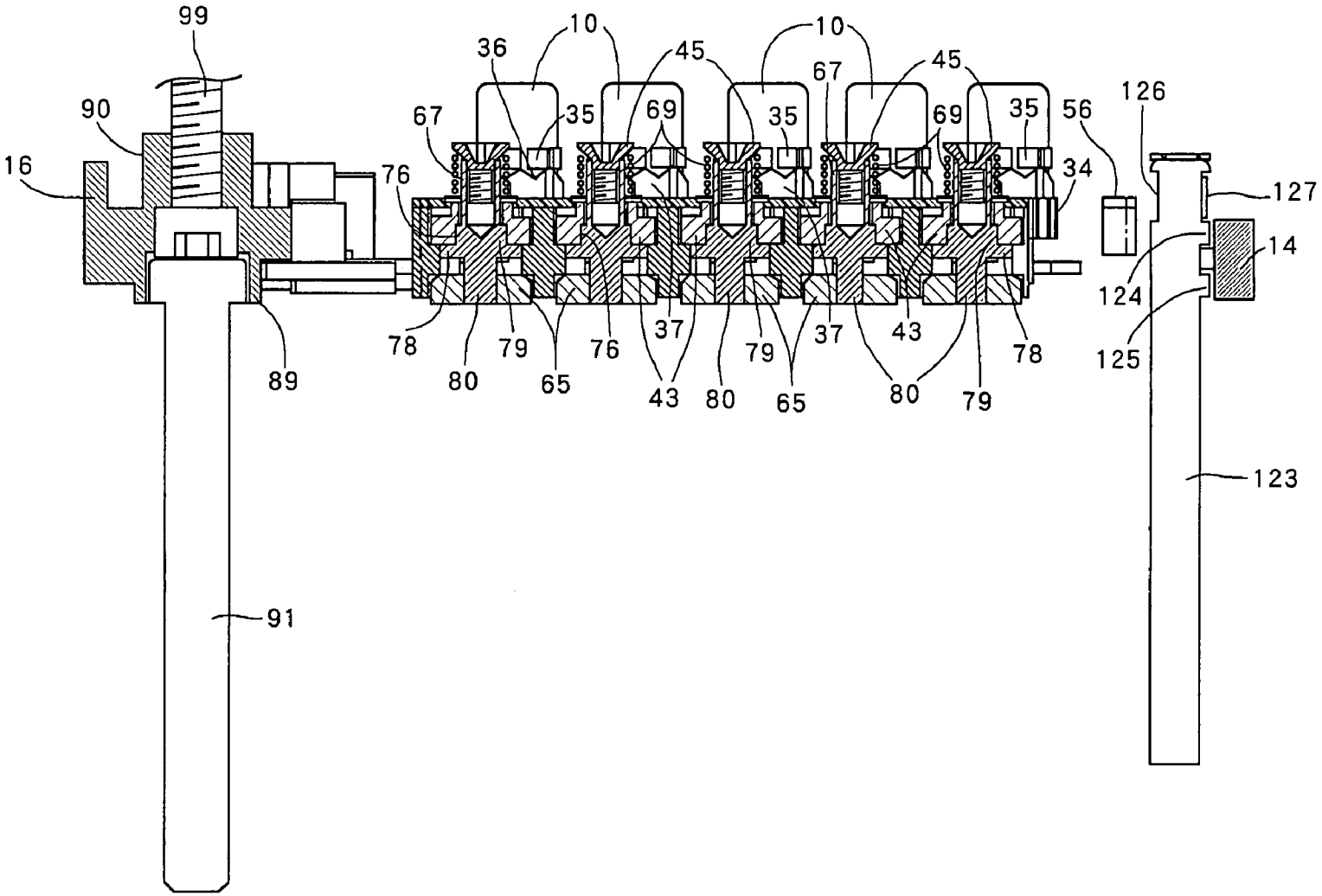
FIG. 13 is a sectional view taken on line F-F of FIG. 11, in which a part of the back plate is omitted.
Figure 14:
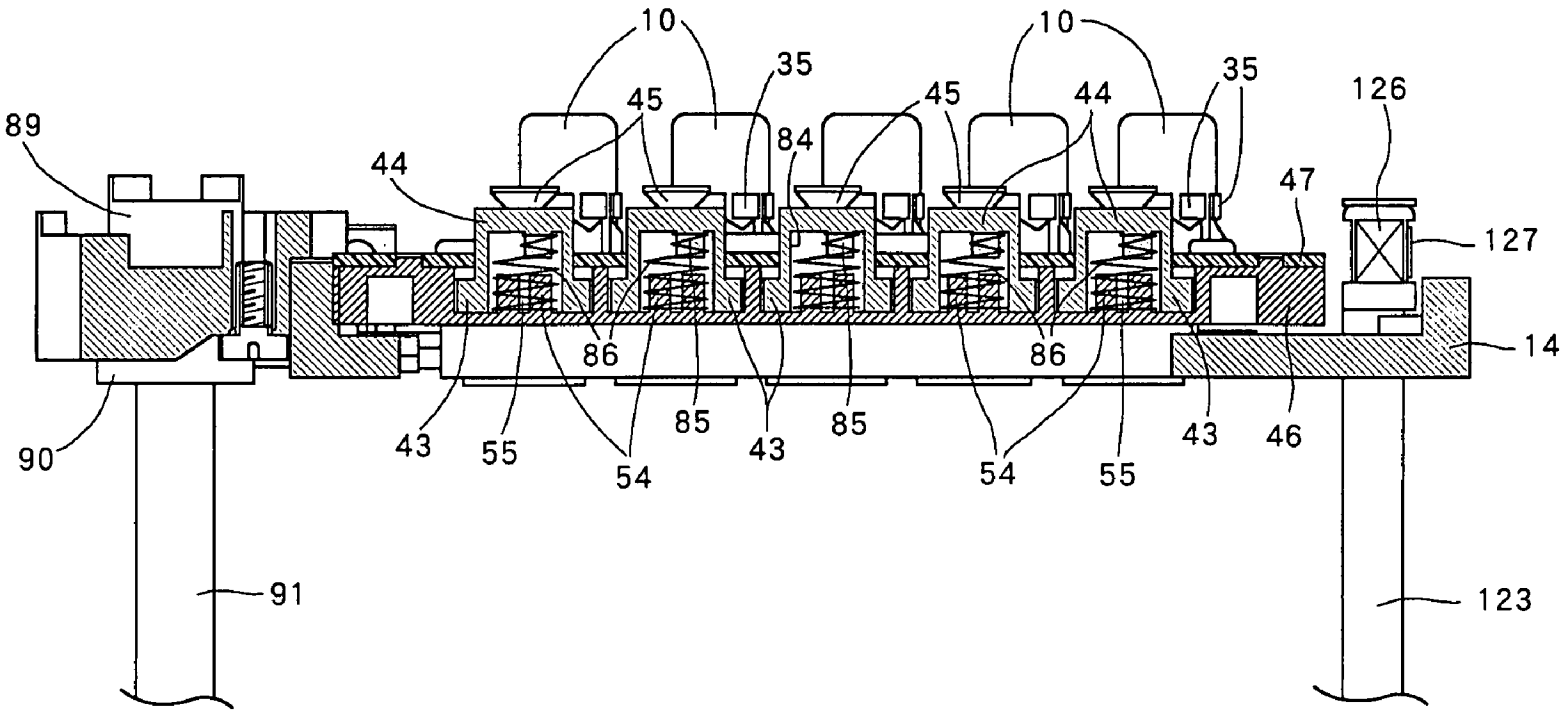
FIG. 14 is a sectional view taken on line G-G of FIG. 11, in which a part of the back plate is omitted.

This state is as shown in FIG. 10. The button gear 34 and the set spring 40 are inserted in the button case 33 in order and their dogs 36, 37 are engaged with each other.

Furthermore, the protection plate 146 is attached to each guide groove 41 over the entire length of each guide groove 41 such that the protection plate 146 can slide in the longitudinal direction of the case 14. The push spring 150 is interposed between one of the spring retainers 149 and the partition wall 121, and the other engagement element 151 is brought into engagement with the cam end 96 of the driving cam 16.

Then, the block assembly 15 is received onto the protection plate 146 with the cam groove 52 facing upward, and the shift spring 153 is interposed between the spring retainer 60 at the side end part of the block main body 46 and a side wall of the case 14.

The front end part of the changeover shaft 123 is inserted in the shaft hole 122 of the case 14, and the plate spring 127 is engageably disposed proximate to the square shaft part 126.

Then, the memory releasing link 113 is received onto the block main body 46, one of its pins 115, 115 is inserted in the guide grooves 59, 59 of the block main body 46, the engagement arm 117 is hooked to the changeover shaft 123, and a reset spring 120 is interposed between the engagement arm 117 and the inner side surface of the case 14.

Thereafter, the set spring 137 is received in the spring retainer 136 of the case 14, the pin 135 is inserted in the set spring 137 to retain the control plate 128, its respective engagement claws 129 are inserted in the cutout parts 73 of the block main body 46, and its respective forward end parts are inserted in the passage hole 53 and the cam hole 52.

Then, the control cam 65 is received in the cam hole 52 with the cutout groove 72 facing downward, the cam shaft 80 is inserted in its shaft hole 71, and the engagement claw 129 is received between the control cam 65 and the hook plate 78.

The control plate 128 is preliminarily connected with the lock plate 140 through the spring retainers 134, 141 and the lock spring 138.

One end part of the lock plate 140 is superimposed on the control plate 128, the engagement part 142 of the other end part is engagingly arranged at the engagement stepped part 116*a*, and the remaining engagement part 142 is engagingly arranged at the suspending base position setting machine screw 143.

Thereafter, the threaded shaft of the pipe shaft is screwed in the threaded holes 109, 110 of the case 14, and one end of the connection bar 91 is engaged in the shaft part 92 of the driving cam 16. Subsequently, the back plate 13 is attached to the case 14 and the machine screws are screwed in the machine screw holes 19, 111 so that the back plate 13 and the case 14 are connected to each other.

The button-operated lock 2 thus constructed has the plurality of control buttons 10 which are vertically one-sidedly arranged in one row one its surface, and the outer side door handle 4 are located at its lower end part. A vertically pair of pipe shafts project from its rear surface, the changeover shaft 123 projects from immediately above the pipe shaft on its upper side, and the connection bar 91 projects from immediately above the pipe shaft on its lower side. Of the passage holes 21, 22 opening to the back sheet 13, the head part of the door suspending base position setting machine screw 143 is located.

The procedure for attaching the button-operated lock 2 thus constructed to the door 1 will now be described. An attachment hole, a vertically pair of pipe shaft insertion holes and an insertion hole for the changeover shaft 123 are formed in a side end part of the door 1, and the main lock is embedded in the attachment hole.

Then, the button-operated lock 2 is placed at a predetermined position on the outer side of the door 1. The connection bar 91 is inserted in the square hole of the main lock and the pipe shaft is inserted in the pipe shaft insertion hole (not shown) so as to allow them to project inward of the door 1.

On the other hand, the seat plate 3 is placed in a predetermined position on the inner side of the door 1 and a machine screw is screwed in the pipe shaft from the outer side of the seat plate 3 to attach the seat plate 3 to the door 1. The changeover knob 6 and a door handle 5 are preliminarily, tumably attached to the seat plate 3 through a stop ring or the like. The changeover knob 6 is engaged in the projected-part of the changeover shaft 123, and the forward end part of the connection bar 91 is engaged in the door handle 5.

Figure 2:
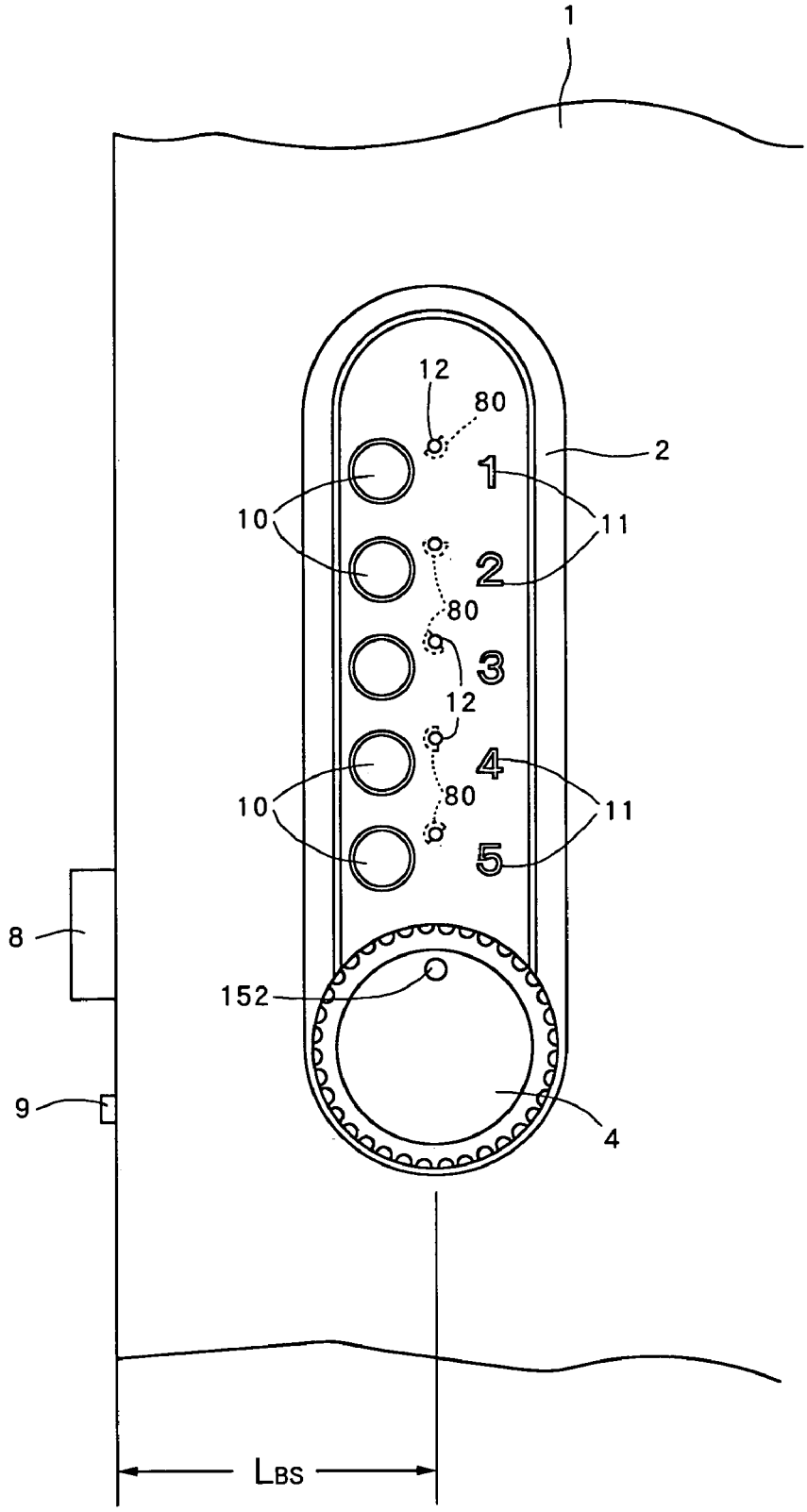
FIG. 2 is a front view showing the button-operated lock according to the present invention, in which the lock is mounted on the entrance door.
Figure 3:
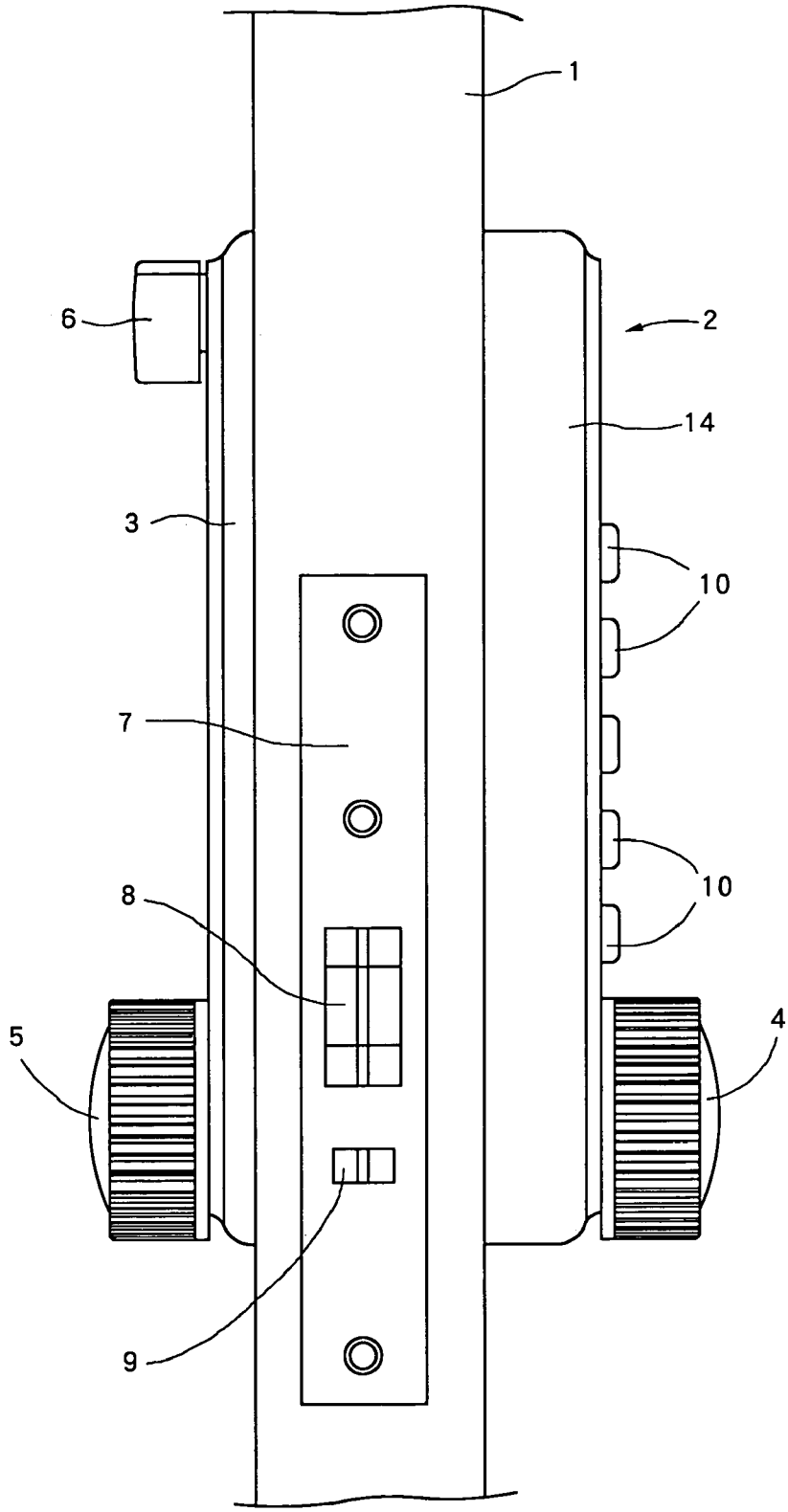
FIG. 3 is a left side view of FIG. 2.

The button-operated lock 2 thus attached to the door 1 is as shown in FIGS. 1 through 3. The plurality of control buttons 10 are vertically arranged in one row on one side of the outer surface of the case 14. The plurality of through-holes 12 serving as the control holes are vertically arranged in one row at a generally central area of the outer surface of the case 14. The outer side door handle 4 is located at the lower end part of the outer surface of the case 14.

The button-operated lock 2 is less in number of the control buttons 10 as previously mentioned. The reset button, which was conventionally needed, can be eliminated and therefore, the structure can be simplified. Since the entire device is compact, the appearance of the door 1 becomes good.

In this case, there are two types In the first type of the button-operated lock 2, the password numbers are preliminarily set on the maker's side at random and then such a button-operated lock 2 is supplied to the client. In the second type of the button-operated lock 2, no password numbers are preliminarily set or inputted on the maker's side and such a button-operated lock 2 is supplied to the client. However, there are no substantial difference in those two types.

Therefore, in order to avoid duplicated explanation, only the second type will be described hereinafter in which the password numbers are set or inputted on the client's side. Thus, the procedure for setting or inputting the password numbers on the maker's side is also executed substantially in the same manner as the manner described hereinafter.

In the button-operated lock 2, each control button 10 is biased forward by the elasticity of the set spring 40, and the button case 33 is projected from the case 14 only excluding the hook element 35.

Figure 18:
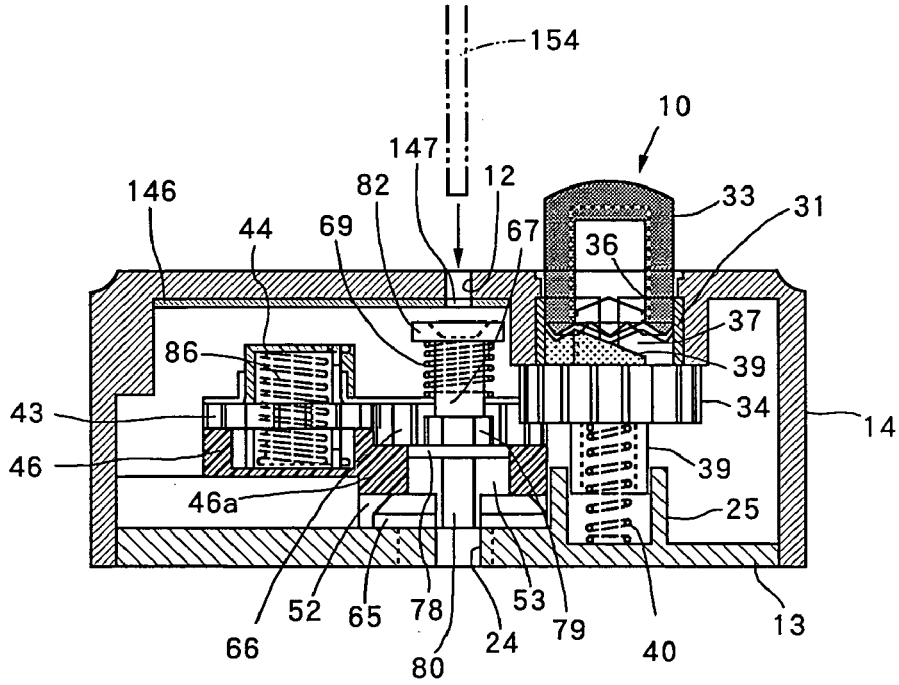
FIG. 18 is an enlarged sectional view taken on line J-J of FIG. 17, showing a state in which a control tool is not yet inserted.

In the button case 33, the hook element 35 is engaged with the inner side opening edge part of the button insertion hole 30, the guide rib 32 of the guide ring 31 is engaged between the hook elements 35, 35, the dog 36 is engaged with the dog 37 on the button gear 34 side received in the button case 33, the button gear 34 is engaged with the terminal gear 66 of the block assembly 15. This state is as shown in FIG. 18.

The block assembly 15 is biased toward the button gear 34 side by the elasticity of the shift spring 153 to facilitate the engagement between the afore-mentioned gears 34, 66. The hook part 56 of the block main body 46 is engaged with the expanded part 57 of the case 14.

The memory releasing link 11 is engaged with the block main body 46, the pin 115 of the link 113 is engaged with the guide groove 59 of the block main body 46, and the pin 114 is engaged with the long groove 27.

The memory releasing link 113 is normally biased downward, i.e., toward the driving cam 16 side by the elasticity of the set spring 123, the lower side engagement arm 116 is engaged with the cam end 96 of the driving cam 16, and the upper side engagement arm 117 is in a position engageable with the changeover shaft 123.

In the changeover shaft 123, the plate spring 127 is engaged and elastically contacted with the square shaft part 126, and the cams 124, 125 are normally in horizontal neutral positions.

In each information altering unit 48 mounted on the block assembly 15, the clutch shaft 67 and the information altering element 70 are biased forward by the elasticity of the set spring 69, and the information altering element 70 is located behind the inner side opening edge part of the through-hole 12.

The control cam 65 of the information altering unit 48 is located at the cam hole 52, and the engagement claw 129 of the control plate 128 is engaged between the control cam 65 and the hook plate 78.

The control plate 128 is located sideways of the block assembly 15 on the opposite side to the memory releasing link 113 and behind the button gear 34. The control plate 128 is normally biased toward the back plate 13 side, i.e., toward the door 1 side by the elasticity of the set spring 137.

Before the password numbers are set, as shown in FIG. 33, the cutout groove 72 of the control cam 65 is open in the same direction on the control plate 128 side, and the engagement claw 129 is engaged in the cutout groove 72 so that the control plate 128 is pushed and fallen backward.

The lock plate 140 connected to the control plate 128 is pushed and fallen together with the control plate 128 against the elasticity of the set spring 137, and the engagement part 144 is disengaged from the suspending base position setting machine screw 143 to form a small gap therebetween.

Figure 17:
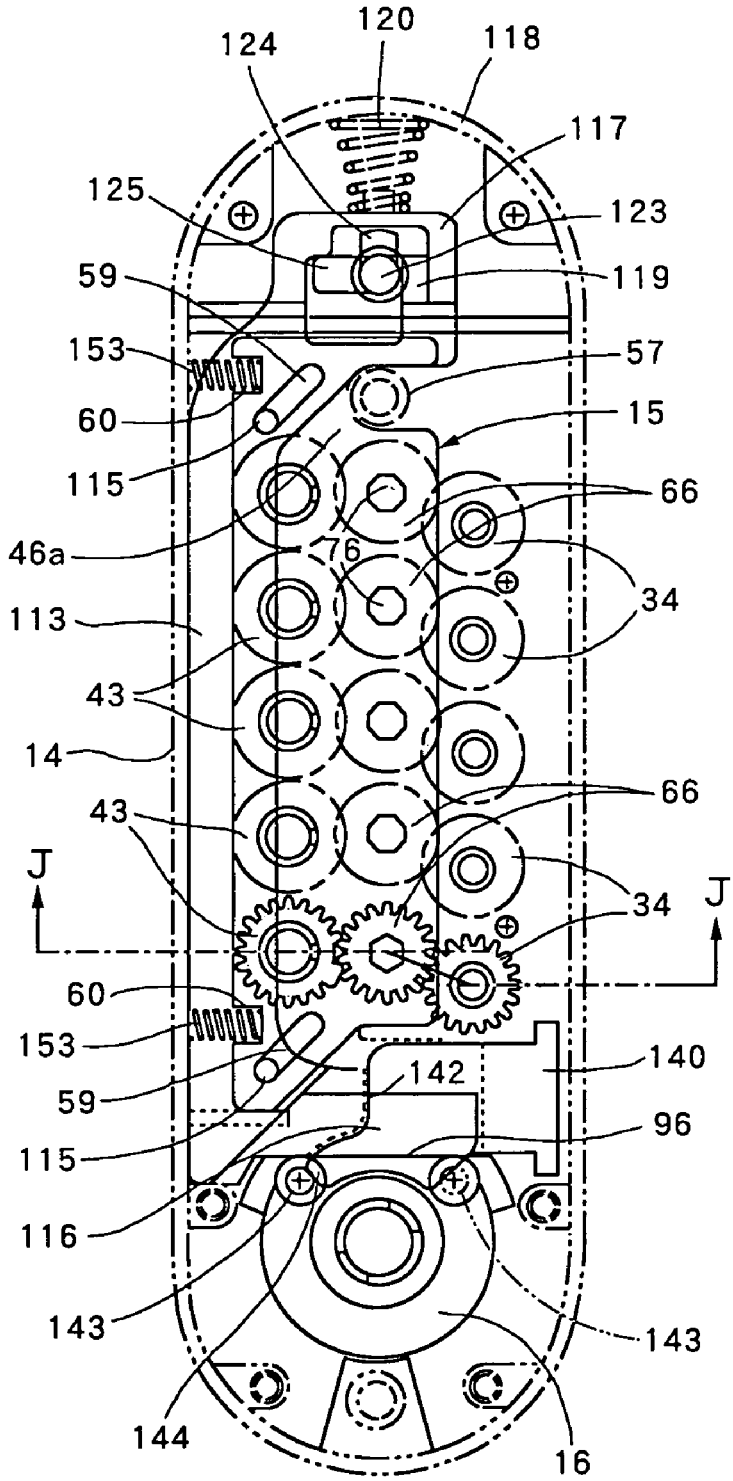
FIG. 17 is a front view showing an assembling state of the present invention, in a simplified manner.

The driving cam 16, as shown in FIG. 17, is assembled to the case 14 with the cam end 96 facing upward, such that the driving cam 16 can turn by 90 degrees leftward and rightward. The inner and outer door handles 4, 5 can make the same movement as the driving cam 16. And those component parts are biased by the elasticity of the cam spring (not shown) so as to be turningly returned to their original positions.

The protection plate 146, which constitutes the first safety mechanism of the button-operated lock 2, is slideably attached to the inner surface of the case 14. The engagement element 151 disposed at the lower end part is, as shown in FIG. 29, inserted between the case 14 and the driving cam 16, and then caused to engage the engagement stepped part 106*a* by the elasticity of the push spring 150. The respective through-holes 147 are located at the same positions as the corresponding control holes 12.

In case predetermined password numbers, five (5) digit password numbers "12345" in this embodiment, are to be set or inputted to the button-operated lock 2 in the above-mentioned condition, no memory information is inputted to the respective control buttons yet, in other words, the memory information of the respective control buttons are all "0". Since the numerical figures at the respective digits of the password numbers are larger than "0", the password numbers can be set or inputted from the outer side of the door 1 which is in a closed position.

The setting or inputting operation of the password numbers is executed in the following manner. The control tool 154 is inserted in the adjacent through-hole 12 which corresponds to each control button 10, the clutch shaft 67 is pushed down to release the engagement between square shaft 79 and the square hole 76, and the corresponding control button 10 is depressed while maintaining the above-mentioned state.

In this case, since an independent unlocking operation is attained for every control button 10 by means of one set of the control button 10 and the terminal gear 66 and the reset gear 43 corresponding to the control button 10, the operation of the control button 10 can be made at random irrespective of the depressing order of the control buttons 10 and the clutch shaft 67.

However, the operation of one set of the clutch shaft and the control button 10 must be made in an associated manner, and the control button 10 must be operated only after the clutch shaft 67 is depressed.

Although the protection plate 146 is attached to the inner surface of the case 14, insertion of the control tool 154 is not interfered by the protection plate 146 because each through hole 147 is located at the same position as the control hole 12.

That is, the control tool 154 is inserted in an optional through-hole 12. The control tool 154 is pushed in the through-hole 12 against the elasticity of the set spring 67, and the clutch shaft 67 is pushed down to push the square shaft 79 out of the square hole 76 so that their engagement is released.

Figure 19:
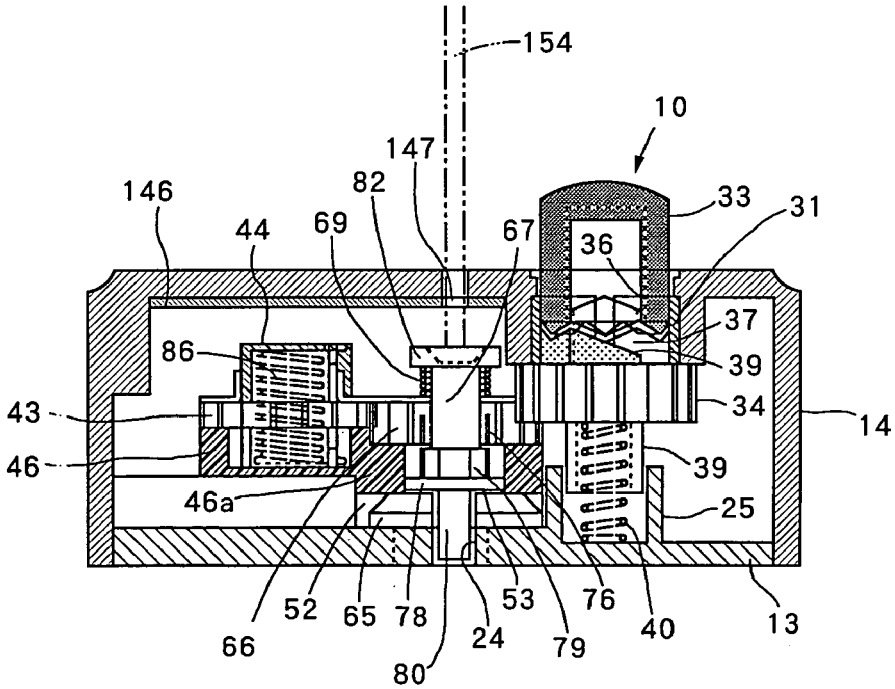
FIG. 19 is an enlarged sectional view showing a state in which the control tool is inserted and a crutch shaft is depressed in FIG. 18 and in which the control buttons are not yet depressed.

Thus, the terminal gear 66 is turnably supported by the clutch shaft 67, and the current turning angle, i.e., memory information, of the cam shaft 80 and the control cam 65 is maintained and the engaging relation among the terminal gear 6, the button gear 34 and the reset gear 43 is maintained. This state is as shown in FIG. 19.

Under the above-mentioned condition, the control button 10 corresponding to the through-hole 12 is depressed. This depressing operation is made as follows. Since the password numbers are "12345" of five digits in this embodiment, when the control tool 154 is inserted in the through-hole 12 in the highest position, the highest control button 10 indicated by "1" in the button indication part 11 is depressed only once, so that the numerical FIG. 1 of the digit of 10000-places is set or inputted.

When the control tool 154 is inserted in the second highest through-hole 12, the control button 10 indicated by "1" in the indication part 11 is depressed twice so that the numerical FIG. 2 of the digit of 1000-places is set or inputted.

Figure 4:
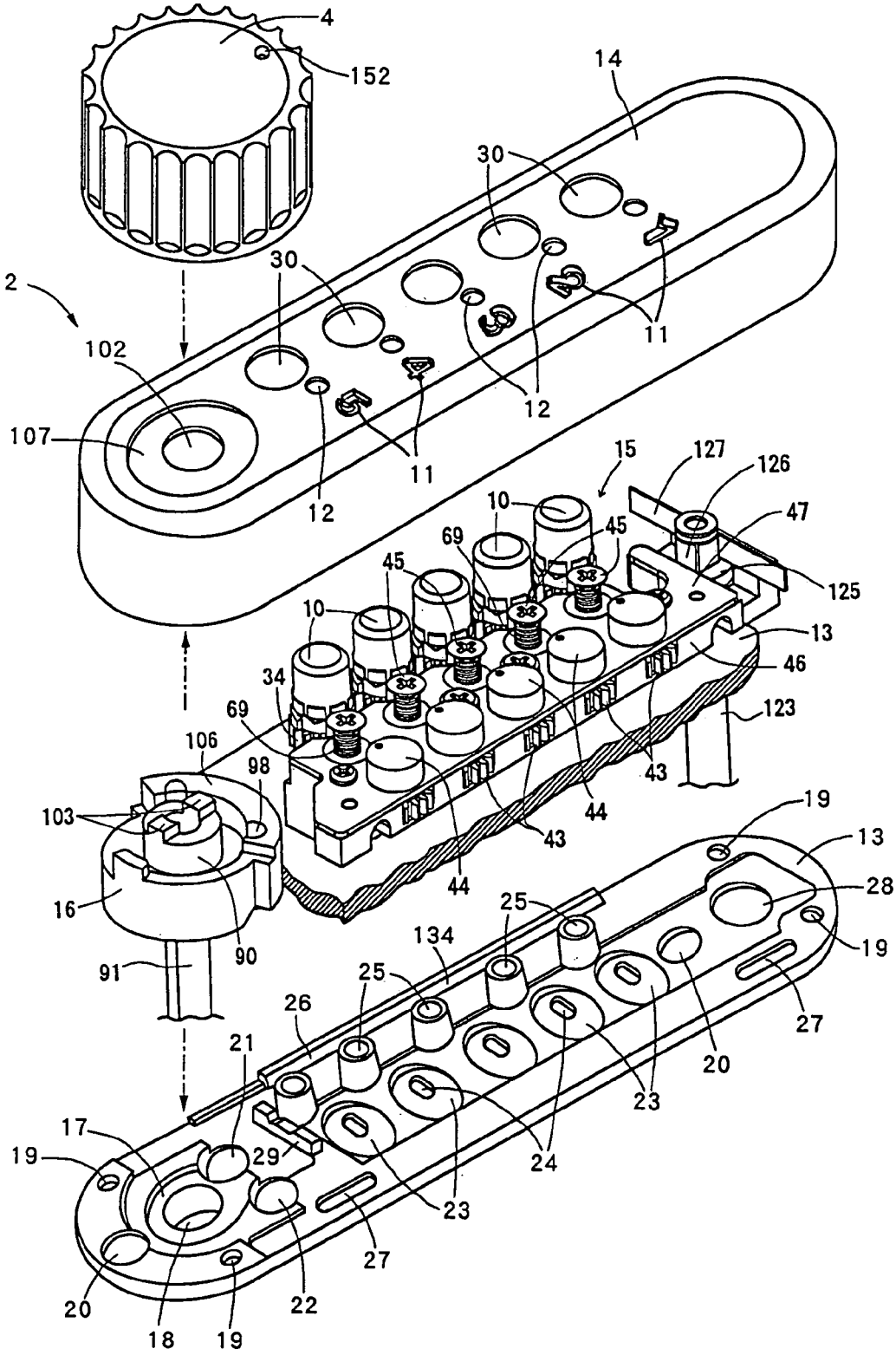
FIG. 4 is a perspective view showing an essential part of the present invention in an exploded manner.
Figure 5:
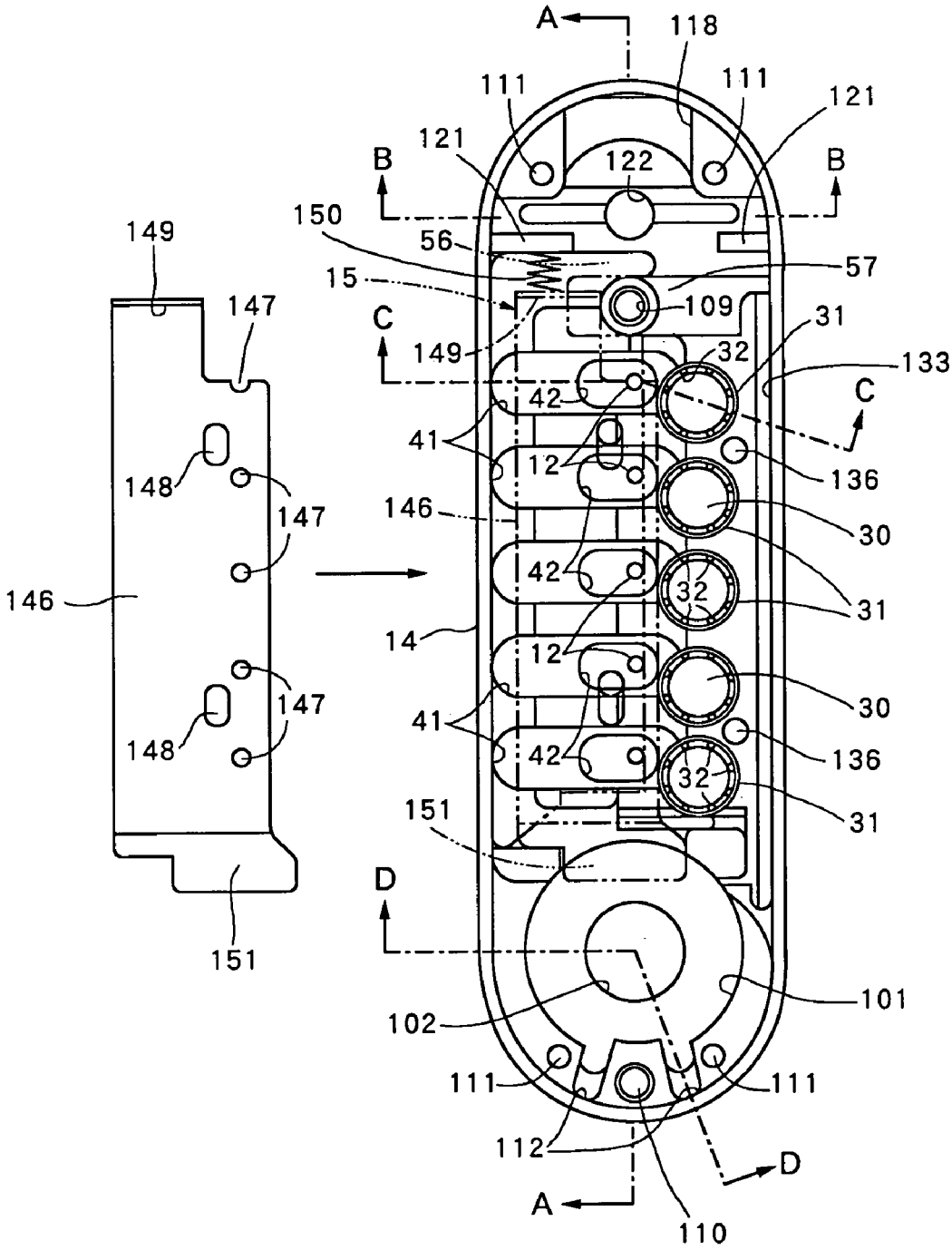
FIG. 5 is a front view showing a case and a protection plate to which the present invention is applied.
Figure 6:
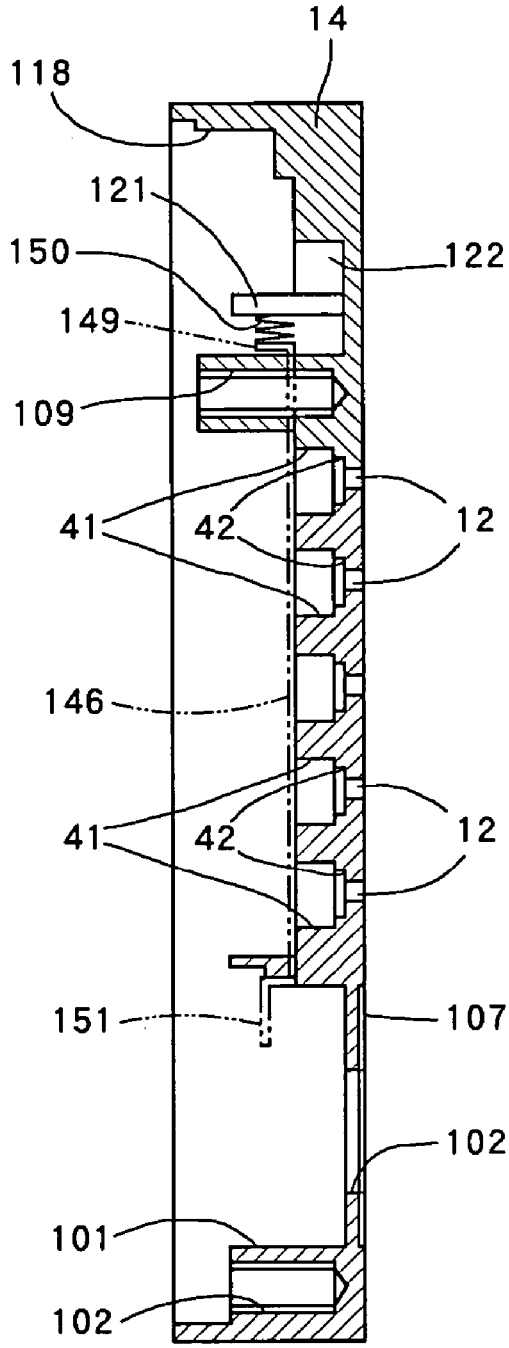
FIG. 6 is a sectional view taken on line A-A of FIG. 5.
Figure 7:
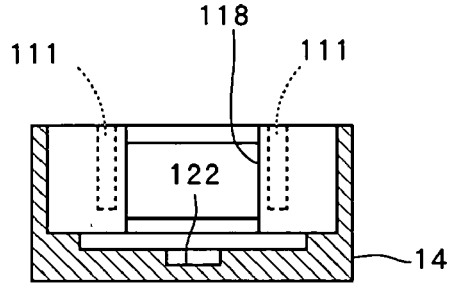
FIG. 7 is a sectional view taken on line B-B of FIG. 5.
Figure 8:
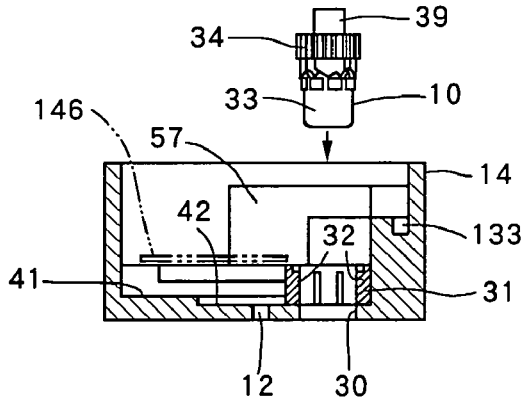
FIG. 8 is a sectional view taken on line C-C of FIG. 5, additionally showing an attaching state of a control button to the button-operated lock.
Figure 9:
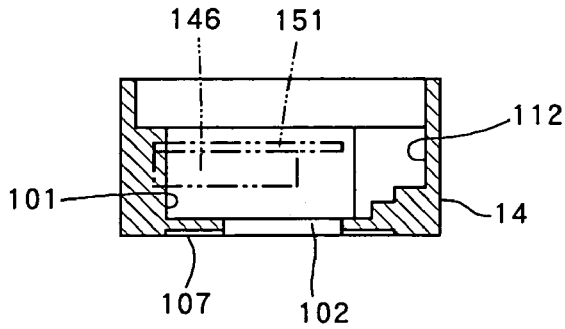
FIG. 9 is a sectional view taken on line D-D of FIG. 5.

Similarly, when the control tool 154 is inserted in the third highest through-hole 12, the control button 10 indicated by "3" in the indication part 11 is depressed three times so that the numerical FIG. 3 of the digit of 100-places is set or inputted, when the control tool 154 is inserted in the fourth highest through-hole 12, the control button 10 indicated by "4" in the indication part 11 is depressed four times so that the numerical FIG. 4 of the digit of 10-places is set or inputted, and when the control tool 154 is inserted in the through-hole 12 in the lowest position, the control button 10 indicated by "5" in the indication part 11 is depressed five times so that the numerical FIG. 5 of the digit of 1-place is set or inputted.

Figure 20:
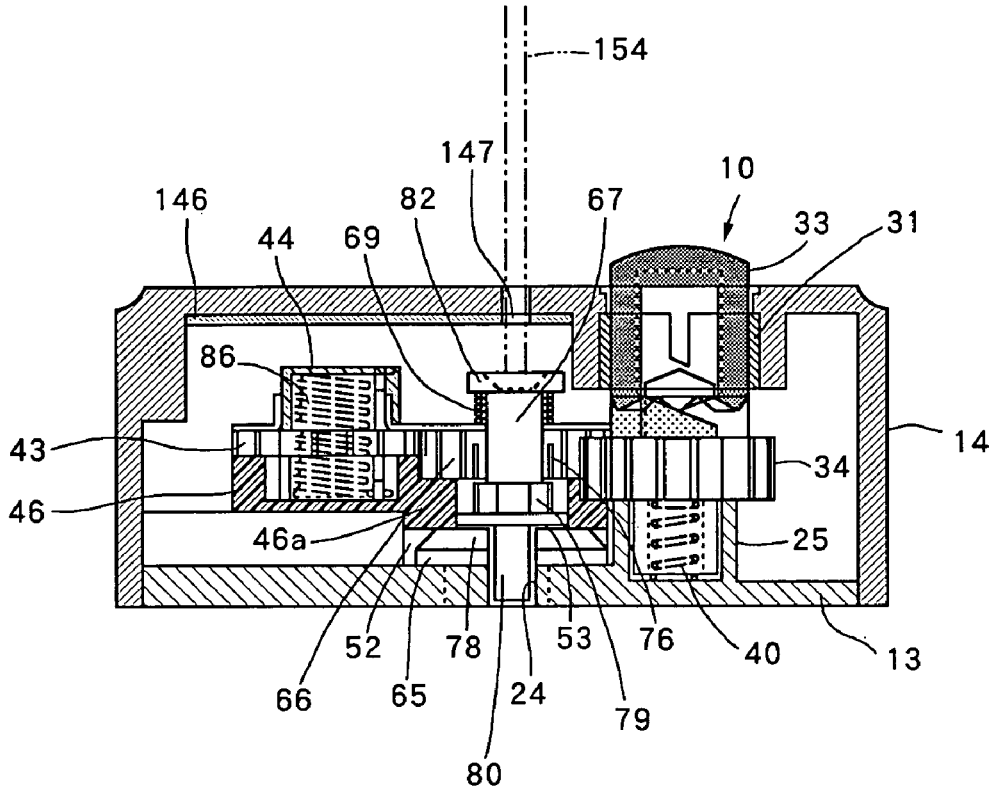
FIG. 20 is an enlarged sectional view showing a state in which the control tool is inserted and a crutch shaft is depressed in FIG. 19 and in which the control buttons are already depressed.

When, for example, the control button 10 in the highest position is depressed once, the button case 33 is pushed down along the guide rib 32 against the elasticity of the set spring 40 and the button gear 34 makes the same movement. This state is as shown in FIG. 20.

When the hand is released from the control button 10, the button gear 34 is pushed forward by the elasticity of the set spring 40, and the cam 34 projecting from the gear 34 is engaged with the inner side end part of the adjacent guide rib 32 and makes a helical turn.

Thus, the cam 39 is turned by an amount equal to one pitch of the guide rib 32, i.e., 45 degrees equal to two teeth of the button gear 34 and transmits its torque to the terminal gear 66 which is engaged with the button gear 34.

On the other hand, the button gear 34 is further pushed out, and the guide rib 32 is engaged between the hook elements 35, 35 to stop the turning motion of the button gear 34, so that the turning angle of the button gear 34 is maintained. The hook element 35 comes into engagement with the opening edge part of button the insertion hole 30, and the button case 33 is returned to its original position.

When the torque of the button gear 34 is transmitted to the terminal gear 66 as mentioned above, the terminal gear 66 is turned by 45 degrees, which are equal to two teeth, about the shaft of the clutch shaft 67 and transmits its torque to the reset gear 43 which is engaged with the terminal gear 66.

Thus, the reset gear 43 is turned by an amount equal to two teeth and the boss 44 integral with the gear 43 moves together with the reset gear 43, so that the reset spring 86 hooked to its inside is twisted therein. Then, the elasticity of the reset spring 86 is acted on the terminal gear 66 through the reset gear 43 and biases the gear 66 so that the gear 66 can return to its original position.

When the memory information "1" is set or inputted to the control button 10 in the highest position in the manner as mentioned above, the control tool 154 is pulled out of the through-hole 12 and the clutch shaft 67 is allowed to project forward to bring the square shaft 79 into engagement with the square shaft 76, so that the original state of the information altering unit 43 can be recovered.

Thereafter, for example, at the time of setting or inputting the memory information "2" to the second highest control button 10, the control button 10 is depressed twice, the button gear 34 is turned by 90 degrees equal to four teeth of the button gear 34 to turn the terminal gear 66 and the reset gear 43, which are linked to the gear 34, by the above-mentioned angle portion, so that the reset spring 86 is twisted therein. Then, an amount of elasticity equal to the turning motion of 90 degrees of the reset gear 43 is accumulated in the reset spring 86, and the control tool 154 is pulled out of the through-hole 12.

Similarly, the third highest control button 10 is depressed three times, the button gear 34 is turned by 135 degrees equal to six teeth portion of the button gear 34, so that an amount of elasticity equal to the turning motion of 135 degrees of the reset gear 43 is accumulated in the reset gear 86, and the control tool 154 is pulled out of the through-hole 12.

Similarly, the fourth highest control button 10 is depressed four times, the button gear 34 is turned by 180 degrees equal to eight teeth portion of the button gear 34, so that an amount of elasticity equal to the turning motion of 180 degrees of the reset gear 43 is accumulated in the reset gear 86, and the control tool 154 is pulled out of the through-hole 12.

Similarly, the control button 10 in the lowest position is depressed five times, the button gear 34 is turned by 225 degrees equal to ten teeth portion of the button gear 34, so that an amount of elasticity equal to the turning motion of 225 degrees of the reset gear 43 is accumulated in the reset gear 86, and the control tool 154 is pulled out of the through-hole 12.

When all memory information has been set or inputted through the control button 10, the outer side door handle 4 is reset and the handle 4 is turned clockwise by approximately 90 degrees.

By doing so, the driving cam 16, which moves together with the door handle 4, is turned clockwise in FIG. 17, the cam end 96 is brought into engagement with the engagement arm 116 of the memory releasing link 113, and the link 113 is pushed up against the elasticity of the set spring 120.

The memory releasing link 113 pulls back the block main body 46 or block assembly 15 which forms the guide groove 59 which is in engagement with the pin 115 at the time of upward movement of the memory releasing link 113 leftward in FIG. 17 against the elasticity of the shift spring 153.

Owing to this arrangement, the assembly 15 is brought away from the button gear 34, the engagement between the button gear 34 and the terminal gear 66 is released, and the engagement claws 129 of the control plate 128 are pulled away from the respective cutout grooves 73 of the block main body 46.

By doing so, the terminal gear 66 and the reset gear 43 become ready to turn, the reset gear 43 is turnably returned by the elasticity of the set spring 86, that is, the reset gear 43 is turned in a direction reverse to that at the time of depressing operation of the control button 10, and the terminal gear 66 which is in engagement with the gear 43 is turned.

The turning direction of the terminal gear 66 is the same direction as the turning direction at the time of the pressing operation of the button gear 34, its turning angle is in proportion to the amount of elasticity accumulated in the reset spring 86, and its angle displacement is transmitted to the cam shaft 80 through the square shaft 79 which is fitted to the square hole 76 formed in the gear 66.

Owing to this arrangement, the cam shaft 80 is turned by an approximately same angle as the terminal gear 66, the control cam 65 which is fitted to the shaft 80 moves together with the cam shaft 80 to position the cutout groove formed in the cam 65. That is, the positions of the respective cutout grooves 72 are established in accordance with the elasticity of the reset spring 76 or each memory information.

This state is as shown in FIG. 26(*b*) through (*f*). As apparent from this illustration, the positions of the respective cutout grooves 72 are shifted from the position of FIG. 26(*a*), i.e., position of the memory information "0", where the cutout groove 72 is engageable with the engagement claw of the control plate 128.

Owing to this arrangement, the engagement claws 129 which are engaged in the respective cutout grooves 72 are contacted with the control cams 65, and the engagement claws 125 are sprung out from the cutout grooves 72 against the elasticity of the set spring 103 and held in their generally vertical postures between the control cams 65 and the hook plates 78, i.e., on a plane parallel to the door 1.

Accordingly, one end of the lock plate 140 is pulled in the direction of the thickness of the control plate 128 by the elasticity of the lock spring 139 and superimposed on the control plate 128. The one end part of the lock plate 10 is engaged with the side wall of the case 14 and the engagement part 144 at the other end part becomes ready to engage the hanging base position setting machine screw 143. And the movement of the lock plate 140 is restrained.

Consequently, the door handle 4 or driving cam 16 becomes unable to turn, and the button-operated lock 2 is locked.

The procedure for unlocking the button-operated lock 2 will now be described. The outer side door handle 4 is reset to turn the handle 4 clockwise by approximately 90 degrees.

By doing so, as mentioned previously, the driving cam 16 which moves together with the door handle 4 is turned counterclockwise in FIG. 17, and the cam end 96 is brought into engagement with the engagement arm 116 of the memory releasing link 113 to push up the link 113 against the elasticity of the set spring 120.

The memory releasing link 113 pulls the block main body 46 or block assembly 15 having the guide groove 59 formed therein which guide groove 59 is in engagement with the pin 115, leftward in FIG. 17 during its upward movement, the assembly 15 is brought away from the button gear 34, the engagement between the button gear 34 and the terminal gear 66 is released, and the engagement claws 129 of the control plate 128 are pulled away from the respective cutout parts 73 of the block main body 46.

By doing so, the terminal gear 66 and the reset gear 43 are ready to turn, the reset gear 43 turningly returned by the elasticity of the reset spring 86, the terminal gear 66 which is in engagement with the gear 43 is turned to cancel the state created by falsification and erroneous depression of the control buttons 10 at the time of unlocking operation conducted by a third party after the password numbers are set or inputted, and the state of the terminal gear 66 or cam shaft 80 at the time of setting or inputting the password numbers is recovered.

That is, for example, when the control buttons 10 are depressed by falsification and erroneous operation made by a third party at the time of unlocking operation after the password numbers are set or inputted, the button gear 34 is turned by the number of times of depressing operation as mentioned above, and then the terminal gear 66 and the reset gear 43 are also turned so that the original password numbers are converted, thus making it unable to unlock the lock by unlocking operation using the regular password numbers.

So, as mentioned above, resetting operation is conducted before unlocking operation is made. The reset gear 43 and the terminal gear 66 are turned by the elasticity of the reset spring 86 accumulated after the password numbers are set or inputted, so that the elasticity is consumed and a state at the time of setting or inputting the password numbers is recovered.

The resetting operation is instantaneously made at the time of movement of the memory assembly 48. After the resetting operation is made, the memory assembly 48 is returned to the original position, the terminal gear 66 is engaged with the button gear 34, and the engagement claws 129 are engaged in the respective cutout parts 73.

Since the turning angle between the reset gear and the terminal gear 66 at the time of resetting is established based on the elasticity of the reset spring 86 accumulated after the password numbers are set or inputted, the gears 43, 66 will never turn more than or less than the consumption of the elasticity. Thus, the password numbers established at the time of setting or inputting originally will not be altered.

After the resetting operation is made, the password numbers "12345" are inputted from the outer side of the door 1 through the control buttons 10. That is, the control button 10 in the highest position is depressed once, the second highest control button 10 is depressed twice, the third highest control button 10 is depressed three times, the fourth highest control button 10 is depressed four times, and the control button in the lowermost position is depressed five times.

In this case, since an independent unlocking operation is attained for every control button 10 by means of one set of the control button 10 and the terminal gear 66 and the reset gear 43 corresponding to the control button 10, the operation of the control button 10 can be made at random irrespective of the depressing order of the control buttons 10 for respective digits.

By doing so, the button gears 34 corresponding to the respective buttons 10 are turned by 45 degrees, 90 degrees, 135 degrees, 180 degrees and 225 degrees, respectively, and the respective terminal gears 66 engaged with those button gears 34 are turned by the same angle but in the direction opposite to that of the button gears 34.

In this case, since the turning direction of the terminal gears 66 is opposite to the turning direction at the time of resetting operation at the time of setting or inputting the password numbers and the turning angle is all same, the respective terminal gears 66 are turned in the opposite direction to the direction at the time of setting or inputting the password numbers and the turning angle at the time of setting or inputting the password numbers is offset so that the memory information is canceled.

That is, the terminal gears 66 are all "zero" in turning angle, the respective control cams 65 or cutout grooves 73 are in the state as shown in FIG. 26(*a*), and the respective cutout grooves 73 become ready to engage the engagement claws 129 of the control plate 128.

Owing to this arrangement, the forward end parts of the respective engagement claws 129 are engaged in the respective cutout grooves 173 by the elasticity of the set spring 137, the control plate 128 is pushed and fallen backward and slantwise as indicated by imaginary lines of FIG. 15, the lock plate 140 follows the control plate 128, and the engagement part 144 of the lock plate 140 is brought away from the door suspending base position setting machine screw 143.

Thereafter, the door handle 4 is turned in the opening direction, that is, turned in the direction opposite to the resetting direction, the main lock is actuated to cause the deadbolt 8 backward through the connection bar 91 which moves together with the door handle 4. Thus, the door 1 is ready to open.

In this case, the driving cam 16 is turned by turning the door handle 4 in the opening direction, the cam end 96 is brought into engagement with the engagement arm 116 to push up the memory releasing link 113, the memory assembly 15 is pulled toward the link 113, the engagement between the terminal gear 66 and the button gear 34 is released, the engagement claw 129 is pulled out of the cutout groove part 73, and then, the same operation as the resetting operation as mentioned above is performed.

However, even if the gears 66, 34 are separated from each other, it is only small elasticity which is remained in the reset spring 86. This remaining small elasticity is not enough to turn the reset gear 43 and the terminal gear 66.

Thus, the gears 43, 66 cannot be turned, and the same state as that at the time of resetting, i.e., the password numbers as set originally are maintained, and the smooth opening operation of the door 1 or smooth unlocking operation is not jeopardized.

On the other hand, in case the door 1 is to be closed, the door handle 4 is turned in the closing direction, i.e., turned in the same direction as that at the time of resetting operation. At the time of closing the door 1, the latch trigger 9 is retracted to actuate the main lock, so that the deadbolt 8 is projected to lock.

Here again, although the same operation as the aforementioned resetting operation is made by the turning the door handle 4 in the closing direction, the gears 43, 66 cannot be turned by the same reason as mentioned above. Thus, the same state as that at the time of resetting, i.e., the password numbers as originally set or inputted are maintained, and the smooth opening operation of the door 1 or smooth unlocking operation is not jeopardized.

In case the door 1 is to be opened from the inner side, the door handle 5 may simply be turned in the opening direction.

That is, when the door handle 5 is turned in the opening direction, its inside connection bar 91 is moved together with the door handle 5 and the main lock is actuated by the bar 91 to cause the deadbolt 8 to move backward. Thus, the door 1 is ready to open.

In this case, since the other end of the connection bar 91 is non-engageable with the driving cam 16, the driving cam 16 is not turned by turning operation of the door handle 5 in the opening direction, and no resetting operation is made. The same is truth when the door 1 is to be closed from the inner side. That is, the main lock is actuated to project the deadbolt 8, thus making the door 1 ready to be closed.

Next, in case the button-operated lock 2 is used as the so-called empty lock, that is, in case the door 1 is to be opened/closed by turning operation of the door handle 4, 5 without the need of operating the buttons for unlocking, the changeover knob 6 is turned and the changeover shaft 123 which is directly linked to the changeover knob 6 is moved together with the changeover knob 6, the cam 125 on the long side is engaged with the inner surface of the engagement arm 117 to push up the memory releasing link 113 against the elasticity of the set spring 120, and this state is maintained.

By doing so, the memory releasing link 113 pulls the block main body 46 or block assembly 15 which forms the guide groove 59 which is in engagement with the pin 115, leftward in FIG. 17 against the elasticity of the shift spring 153 during the upward movement of the memory releasing link 113, the assembly 15 is separated from the button gear 34, the engagement between the button gear 34 and the terminal gear 66 is released, and the engagement claws 129 of the control plate 128 are pulled away from the respective cutout parts 73 of the block main body 46. That is, the same operating state as the resetting operation is realized through the operation of the changeover knob 6 while maintaining the password numbers.

By doing so, the control plate 128 is biased backward by the reset spring 137 in a state parallel to the plane of the door 1, the lock plate 140 is moved together with the control plate 124, the engagement part 144 and door suspending base position setting machine screw 144 become ready to engage each other, and the other end part becomes ready to engage the side wall of the case 14, so that the turning direction of the door handle 4 is restricted to one direction.

Accordingly, when the door handle 4 is turned in a predetermined direction, the main lock is actuated, and the deadbolt 8 is projected/retracted so that the door 1 becomes ready to open/close. The same is true with the inner side door handle 5.

In case the password numbers for the button-operated lock 2 in use are to be altered for the sake of security, alternation can be made safely, rationally and rapidly only if the password numbers before alternation are known.

For example, in case the password numbers "12345" of this embodiment are to be altered to "33357", in other words, in case the numerical figures at the respective digits of the passwords number after alternation are all larger than those of the password numbers before alternation (including a case wherein the difference between the numerical figures at some same digits is zero (0)), alternation can be made from the outer side of the door 1 easily and rapidly while holding the door 1 in a closed position.

That is, in this case, first, the door handle 4 is turned to make a resetting operation, so that any falsification applied to the button-operated door 2, erroneous depression of the control buttons 10, etc. are deleted and the password numbers before alternation are recovered. After resetting, the block assembly 15 is returned to its original position and the respective terminal gears 66 and the button gears 34 are engaged with each other so that the original state can be recovered.

Then, the password numbers before alternation are inputted to the respective control buttons 10, and the corresponding control buttons 10 are depressed by the number of the password numbers before alternation.

By doing so, the respective control buttons 10 are turned by an angle obtained by multiplying 45 degrees to the number of times of depression, and the terminal gears 66 engaged with the respective control buttons 10 are turned by the same angle in the opposite direction, so that the turning angle at the time of setting or inputting the password numbers can be offset and the original memory information can be deleted.

That is, the terminal gears 66 are all placed in a state in which the turning angle of the terminal gears 66 is zero (0), the respective control cams 65 or cutout grooves 73 are held in the state as shown in FIG. 26(*a*). In that state, the respective cutout grooves 73 become ready to engage the engagement claws 129 of the control plate 128.

Under the above circumstance, the control buttons 10 corresponding to the altered digits of all the password numbers after alternation, and the through-holes 12 are operated. That is, the control tool 154 is inserted into the corresponding through-holes 12 from the outer side of the door 1 and pushed therein against the elasticity of the set spring 67 so that the clutch shaft 67 is pushed down and the square shaft 79 is pushed out of the square hole 76 for releasing their engagement.

By doing so, the terminal gears 66 are turnably supported on the clutch shafts 67, the current turning angle of the cam shafts 80 and the control cams 65, i.e., memory information can be maintained, and the engagement relation among the terminal gears 66, the button gears 34 and the reset gears 43 can be maintained.

In this case, since each clutch shaft 67 is merely pushed down and not turned, the position of the cutout groove 72 of the cam shaft 80 or control cam 65 is held in the same position as that before the clutch shaft 67 is pushed down and the turning angle corresponding to the memory information before alternation is maintained.

And while maintaining the pushing state of the control tool 154, the corresponding control buttons 10 are depressed by the difference between before and after alternation of the numerical figures at respective digits of the password numbers.

For example, in case the password numbers "12345" before alternation of this embodiment is to be altered to "33357", the control button 10 of the digit of 10000-places, in other words, the control button 10 in the highest position is depressed twice which is equal to the difference between the numerical figures "1" and "3" before and after alternation.

By doing so, the button gear 34 corresponding to the control button 10 is turned by 90 degrees which correspond to 4-teeth, and then, the terminal gear 66 which is engaged with the button gear 34 and the reset gear 43 which is engaged with the gear 66 are turned, so that elasticity equal to the turning amount of the reset gear 43 is accumulated in the reset spring 86.

After the memory information of the control button 10 in the highest position is altered in the manner as just mentioned, the control tool 154 is pulled out of the through-hole 12, the clutch shaft 67 is projected forward, and the square shaft 79 is engaged with the square hole 76. In this way, the original state of this specific information altering unit 48 is recovered.

Then, for example, the control button 10 of the digit of 1000-places, in other words, the control button 10 in the second highest position is depressed once which is equal to the difference between the numerical figures "2" and "3" before and after alternation.

By doing so, the button gear 34 corresponding to the control button 10 is turned by 45 degrees which correspond to 2-teeth, and then, the terminal gear 66 which is engaged with the button gear 34 and the reset gear 43 which is engaged with the gear 66 are turned, so that elasticity equal to the turning amount of the reset gear 43 is accumulated in the reset spring 86.

After the memory information of the control button 10 in the second highest position is altered in the manner as just mentioned, the control tool 154 is pulled out of the through-hole 12, the clutch shaft 67 is projected forward, and the square shaft 79 is brought into engagement with the square hole 76. In this way, the original state of this specific information altering unit 48 is recovered.

Similarly, the control button 10 of the digit of 10-places, in other words, the control button 10 in the fourth highest position is depressed once which is equal to the difference between the numerical figures "4" and "5" before and after alternation, and the control button 10 in the digit of 1-place, in other words, the control button 10 in the lowest position 10 is depressed twice which is equal to the difference between the numerical figures "5" and "7" before and after alternation. By doing so the respective button gears 34 are turned by 45 degrees and 90 degrees.

Since the numerical FIG. 3 of the digit of 100-places is not altered, the corresponding control button 10 is not required to depress.

After the memory information of all the corresponding control buttons 10 is altered, the outer side door handle 4 is reset, the handle 4 is turned clockwise by approximately 90 degrees so that the driving cam 16 is turned together with the handle 4.

Thus, the cam end 96 is brought into engagement with the engagement arm 116 of the memory releasing link 113 to push up the link 113 against the elasticity of the set spring 120.

The memory releasing link 113 pulls the block main body 46 or block assembly 15 leftward in FIG. 17 through the guide groove 59 which is in engagement with the pin 115 against the elasticity of the shift spring 153 during the upward movement of the memory releasing link 113, the assembly 15 is separated from the button gear 34, the engagement between the button gear 34 and the terminal gear 66 is released, and the engagement claws 129 of the control plate 128 are pulled away from the respective cutout parts 73 of the block main body 46.

By doing so, the terminal gear 66 and the reset gear 43 become ready to turn, the reset gear 43 is turningly returned by the elasticity of the reset spring 86, in other words, the reset gear 43 is turned in the opposite direction to that at the time of depressing the control button 10, and the terminal gear 66 which is in engagement with the gear 43 is turned.

The turning direction of the terminal gear 66 is the same direction as the turning direction at the time of the pressing operation of the button gear 34, its turning angle is in proportion to the amount of elasticity accumulated in the reset spring 86, and its angle displacement is transmitted to the cam shaft 80 through the square shaft 79 which is fitted to the square hole 76 formed in the gear 66.

Thus, the cam shaft 80 is turned by approximately same angle as the terminal gear 66, and the control cam 55 fitted to the shaft 80 is moved together with the shaft 80, so that the cutout groove 72 formed in the cam 65 can be established.

That is, the cutout groove 72 or cam shaft 80 after alternation of the memory information is set to the position obtained by adding the turning angle caused by the memory information altering operation to the turning angle before alternation of the memory information.

As apparent from the above, at the time of alternation of the password numbers in which the memory information at the respective digits are increased, in other words, at the time of alternation of information in which the button gear 34 is turned in the same direction as that at the time of setting or inputting the information, the respective control buttons 10 are depressed by the number of times which is equal to the difference of the numerical figures before and after alternation of the respective digits from the outer side of the door 1 while closing the door 1.

That is, since alternation is made on the basis of the password numbers before alternation, the person who can perform the alternation operation is limited to the particular person(s) who know the password numbers. Thus, safety is ensured. Moreover, the number of times of depressing the control buttons 10 is decreased compared with the conventional technique in which the password numbers before alternation are once canceled and then the password numbers after alternation are newly set or inputted once again. Thus, the troublesome work is much lessened, and the alternation operation of the password numbers can be made simply and rapidly.

On the other hand, in case the password numbers "12345" are to be altered to "54321", in other words, in case a part of all of the numerical figures at the respective digits of the password numbers after alternation are smaller than those before alternation, that is, at the time of altering the information in which the button gear 34 is turned in the opposite direction to that at the time of setting or inputting the information, the password numbers can be altered safely and rapidly while opening the door 1.

In this case, in the same manner as in the above-mentioned operation for altering the numbers, first, the door handle 4 is turned to make a resetting operation, so that any falsification applied to the button-operated door 2, erroneous depression of the control buttons 10, etc. are deleted and the password numbers before alternation are recovered. After resetting, the block assembly 15 is returned to its original position and the respective terminal gears 66 and the button gears 34 are engaged with each other so that the original state can be recovered.

Then, the password numbers before alternation are inputted to the respective control buttons 10, and the corresponding control buttons 10 are depressed by the number of the password numbers before alternation. By doing so, the respective control buttons 10 are turned by an angle obtained by multiplying 45 degrees to the number of times of depression, and the terminal gears 66 engaged with the respective control buttons 10 are turned by the same angle in the opposite direction, so that the turning angle at the time of setting or inputting the password numbers can be offset and the original memory information can be deleted.

Under the above circumstance, the control buttons 10 corresponding to the altered digits of all the password numbers after alternation, and the through-holes 12 are operated. Of all the password numbers after alternation, the numerical figures "5" and "4" of the digits of 10000-places and 1000-places larger than those before alternation. Thus, as previously mentioned, the corresponding control buttons 10 are depressed by the number of times equal to the difference between the numerical figures at the digits before and after alternation, so that the elasticity is accumulated in the corresponding reset springs 86. Since the numerical figure "3" at the digit of 100-places is unchanged before and after alternation, no altering operation is required.

Next, since the numerical figures "2" and "1" of the digits of 10-places and 1-place are smaller than those before alternation, a different operation from that just mentioned is required.

That is, the changeover knob 6 is turned from the inner side of the door 1 to turn the changeover shaft 123 linked to the changeover knob 6, the cam 124 on the short side is brought into engagement with the inner surface of the engagement arm 117 to push up the memory releasing link 113, the block assembly 15 linked to the memory releasing link 113 is pulled toward the outer side, and the terminal gear 66 is pulled away from the button gear 34 to release the engagement therebetween.

In this case, since the push-up displacement of the memory releasing link 113 is smaller by the short portion compared with the cam 215, the movement displacement of the block assembly 15 is also small. Therefore, only the engagement between the terminal gear 66 and the button gear 34 is released but the engagement between the cutout groove 72 and the engagement claw 129 is maintained so that the memory information before alternation is maintained.

Under the above circumstance, the control tool 154 is inserted into the through-holes 12 corresponding to the digit of 10-places, i.e., the through-hole 12 in the fourth highest position and pushed therein against the elasticity of the set spring 67 so that the clutch shaft 67 is pushed down and the square shaft 79 is pushed out of the square hole 76 for releasing their engagement.

By doing so, since the terminal gears 66 are turnably supported on the clutch shafts 67, the reset gear 43 is turning returned by the elasticity accumulated in the reset spring 86 which elasticity corresponds to the memory information before alternation and the terminal gear 66 is turned following the motion of the reset gear 43, so that the accumulated elasticity is consumed.

Thereafter, the changeover knob 6 is reversely turned to reversely turn the changeover shaft 123 which is associated therewith, the memory releasing link 113 is pushed back by the elasticity of the set spring 120, the block assembly 15 is returned to the original position, the terminal gear 66 and the button gear 34 are engaged with each other, and the engagement claw 129 is engaged with the cutout groove 72.

After the memory information resetting operation is made with respect to the control button 10 corresponding to the digit of 10-places, the control tool 154 is inserted in the through-hole 12 and pushed further therein against the elasticity of the set spring 67, the clutch shaft 67 is pushed down to push the square shaft 79 out of the square hole 76, so that their engagement is released, and the terminal gear 66 is rotatably set to the clutch shaft 67.

And while maintaining the engagement released relation between the square shaft 79 and the square hole 76, the control button 10 in the fourth highest position corresponding to the digit of 10-places is depressed twice which corresponds to the memory information "2" after alternation, its button gear 34 is turned 90 degrees, and the terminal gear 66 and the reset gear 43 are operatively connected thereto, so that the corresponding amount of elasticity is accumulated in the reset spring 86.

Thereafter, the control tool 154 is pulled out of the through-hole 12, the square shaft 79 is fitted to the square hole 76 to integrally connect the clutch shaft 67 and the terminal gear 66 together. By doing so, the substantial memory information altering operation is finished with respect to the digit of 10-places.

Next, the memory information altering operation corresponding to the digit of 1-place is substantially same as the altering operation with respect to the digit of 10-places only except that the number of times of depressing the control button 10 is 1.

After the operation for altering the memory information of the respective digits is finished in the manner as mentioned above, the door handle 4 is turned for resetting operation to release the engagement between the button gears 34 and the terminal gears 66 once, the reset gears 43 are turningly returned by the elasticity accumulated in the respective reset springs 86, the terminal gears 66 are operatively connected thereto, so that the position of the clutch shaft 67 or control cam 65 is set to the memory information position after alternation. By doing so, a series of altering operation is completed.

As apparent, since the operation for altering the memory information requires to make operation of the changeover knob 6 or changeover shaft 123 from the indoor side, falsification, which would otherwise be possible as in the conventional technique in which the altering operation can be made from the outdoor side, can be prevented from occurring.

In the above-mentioned embodiment, 8 sorts of memory information 0 through 7 can be set or inputted to the control buttons 10, and in correspondence to this, square holes 76 and square shafts 79 each having an octagonal shape are formed at the terminal gear 66 and the clutch shaft 67. However, 10 sorts of memory information 0 through 10 or even larger sorts of memory information may be inputted by freely using setting information other than numerical figure, for example, alphabetical letters. In that case, the square hole 76 and the square shaft 79 may be formed in a polygonal shape having a larger number of sides and angles.

FIGS. 37 through 51 show other embodiments of the present invention. Corresponding component parts to those of the above-mentioned embodiment are denoted by same reference numeral. Of those Figures, FIGS. 37 through 50 show the second embodiment of the present invention which includes an improvement in design of the above-mentioned embodiment and some other improvements.

That is, the door handles 4, 5 are formed in a generally circular cylindrical shape or generally disc-like shape. Its mode of use is changed from a grip type to a handle type for the sake of easy turning operation. Moreover, the number of the control buttons 10 is changed from 5 to 4, and the button-operated lock 2 is made small in size and light in weight.

Of the two door handles 4, 5, the outer side door handle 4 is provided with a second safety mechanism for the button-operated lock 2, so that the door handle 4 and the inside mechanism of the lock linked to the handle 4 is protected from a thief trying to apply excessively large torque to the handle 4. In addition, the button-operated lock 2 is made small in size and light in weight and the structure is simplified.

That is, the door handle 4 includes thick grip parts 4*a*, 5*a* radially projecting from the outer surface of a disc-like handle main body, and a recessed hole 155 formed in its inner end face.

A pair of spring receiving holes 155 are formed in the bottom surface of the recessed hole 155. Set springs 157 are received in the spring receiving holes 156. The balls 158 are biased inward by the elasticity of the set springs 157 so that the balls 158 sit on a ball retainer 159.

The connection bolts 99 are biased outward by the elasticity of the set spring 157, and the head part 99*a* of the connection bolt 99 is engaged with the stepped part of the recessed hole 160. The driving cam 16 is capable of moving together with the door handle 4 by the engaging force, i.e., contact surface pressure between the connection bolt 99 and the recessed hole 160. The recessed hole 160 is circular, and the circular cylindrical head part 99*a* is turnably received in the recessed hole 160.

The ball retainer 159 is interposed between the recessed hole 155 and the recessed hole 107 of the case 14. The ball retainer 159 is formed in a thick generally disc-like shape from diecast zinc alloy. The ball retainer 159 has a passage hole 161 formed in its central area. This passage hole 161 is adapted to allow the connection bolt 99 to insert therein. A pair of engagement holes 162 are formed in the outer side of the passage hole 161.

Each engagement hole 162 is tapered such that the hole 162 is gradually enlarged in diameter toward the outer side. The ball 158 is engageably received in the tapered surface of the hole 162. The balls 158, 158 are larger in pitch than the conventional comparable balls and they are engaged with the engagement holes 162 with larger parts thereof projected from the holes 172, so that the balls 158 are readily escaped from the engagement holes 162 when excessively large torque of the door handle 4 acts thereon.

In the Figures, reference numeral 163 denotes a pair of locking projections arranged in their opposing relation and faced with the inner side opening edge of the passage hole 160, and the dog 103 is engaged therebetween so that the driving cam 16 and the ball retainer 159 can move together.

The two balls 158 are pressed against the engagement hole 162 of the ball retainer 159 by the set springs 157. The head part 99*a* of the connection bolt 99 is engaged with the stepped part of the recessed hole 160 by the elasticity of the set springs 157, and the driving cam 16 is made movable together with the door handle 4 by their engaging force.

Accordingly, when the button-operated lock 2 is in the unlocked position where the engagement between the engagement part 144 of the lock plate 140 and the suspending base position setting machine screw 143 is released and the driving cam 16 is turnable, the door handle 4 and the driving cam 16 are synchronously turned. At that time, the ball retainer 159 is also synchronously turned through the locking projection 163 which is engaged with the dog 103 of the driving cam 16.

On the other hand, when the button-operated lock 2 is in the locked position where the engagement part 144 of the lock plate 140 and the suspending base position setting machine screw 143 are engaged with each other and the driving cam 16 is non-turnable, if the door handle 4 is turned with excessively large torque by, for example, a thief, connection bolt 99 is turned with its head part 99*a* engaged with the stepped part of the recessed hole 160, and the door handle 4 is turned idly.

At that time, the ball 158 is engaged with the engagement hole 162 to enhance the idling turning of the door handle 4 while the spring receiving hole 156 and the engagement hole 162 are in opposing relation. When the spring receiving hole 156 is moved from the engagement hole 162, the ball 158 comes into engagement with the opening edge part of the spring receiving hole 156 and raked into the spring receiving hole 156 from the engagement hole 162.

When the spring receiving hole 156 and the engagement hole 162 are not aligned, the ball 158 in the spring receiving hole 156 is rollingly moved on the ball retainer 159 to enhance the idling turning of the door handle 4.

Thus, even in case the door handle 4 is subjected to excessively large torque, breakage of the door handle 4 and breakage of the inside mechanism of the button-operated lock 2 linked to the door handle 4 can be prevented from occurring, and safety thereof can be maintained.

Moreover, since the ball retainer 159 as an important member of the second safety mechanism is formed in a plate-like shape and compact compared with the conventional barrel shaped-one, a mechanism or button-operated lock 2 of this type can be made thin and compact.

The number of the balls 158 and the set springs 157 is reduced. Since the number of the component parts are reduced, the construction can be simplified. Moreover, the pitch of the balls 158 can be enlarged compared with the conventional ones, the door handle 4 can be increased in torque and made large in size, and its operability is enhanced.

Next, the guide grooves 59, 59 formed at the block main body 46 include generally chevron-like locking projections 164, 164 formed in same phase on one end part side thereof. At the time of locking of the button-operated lock 2, the projections 164, 164 are engageable with the pins 115, 115 projecting from the memory releasing link 113. The above arrangement constitutes the third safety mechanism for the button-operated lock 2.

Figure 44:
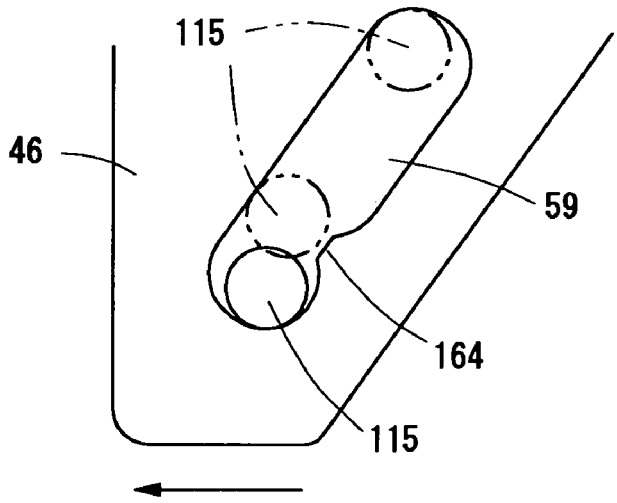
FIG. 44 is a front view showing an essential part of FIG. 43 on an enlarged basis.
Figure 45:
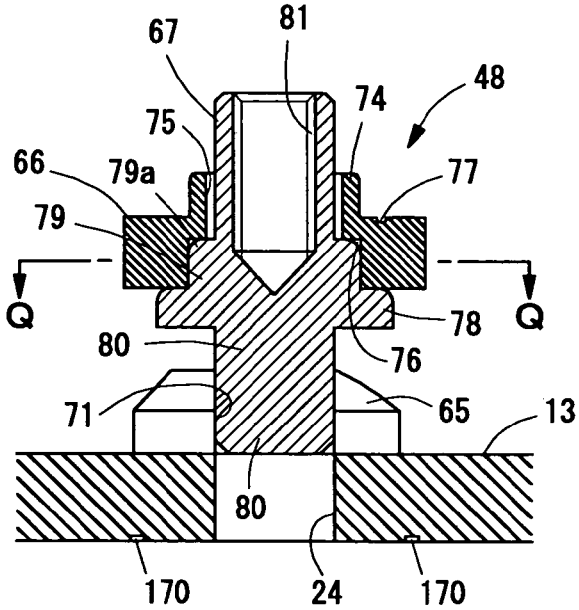
FIG. 45 is a sectional view showing an assembling state of an information altering unit which is applied to the second embodiment.
Figure 46:
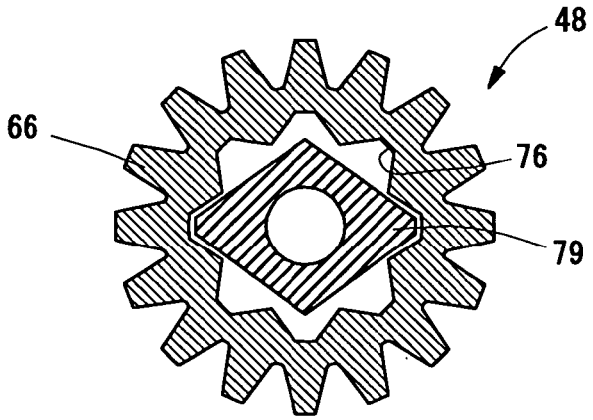
FIG. 46 is a sectional view taken on line Q-Q of FIG. 45.
Figure 47:
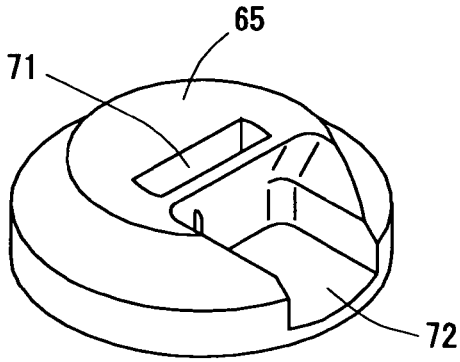
FIG. 47 is a perspective view showing a control cam which is applied to the second embodiment.
Figure 48:
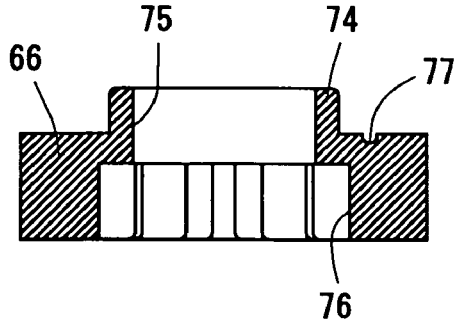
FIG. 48 is a sectional view of a terminal gear which is applied to the second embodiment.
Figure 49:
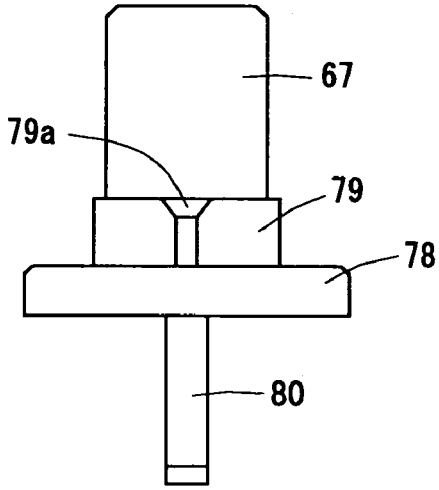
FIG. 49 is a front view showing a crutch shaft which is applied to the second embodiment.
Figure 50:
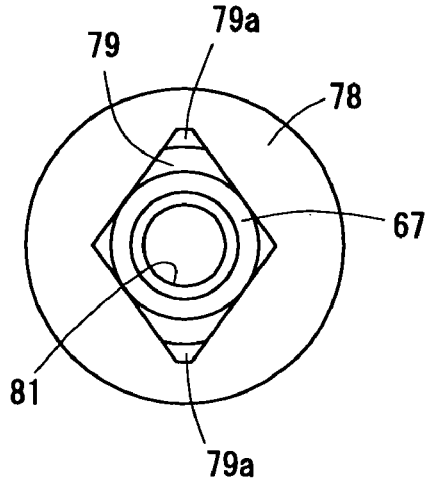
FIG. 50 is a plan view of FIG. 49.

That is, the locking projection 164, as shown in FIG. 44, is formed on one end part side, i.e., on the driving cam 16 side, of the guide groove 59. When the button-operated lock 2 is in the locked position, this projection 164 is engageable with the pin 115 located at one end part of the guide groove 59 and adapted to prohibit the pin 115 from moving upward. The locking projection 164 allows the pin 115 to move between its forward end part and the other side edge of the guide groove 59 Also, the locking projection 164 makes it possible to unlock the button-operated lock 2.

The third safety mechanism is functioned, for example, when a thief tries to make an abnormal unlocking operation without making a resetting operation, when the button-operated lock 2 is in the locked position where the pin 115 is positioned on one end part side of the guide groove 59 and engageable with the locking projection 164 and the pin 115 is prohibited from moving upward.

That is, when the button-operated lock 2 is in the locked position, if an attempt is made such that, for example, the control tool 154 or similar false tool is pushed in the through-hole 12 and further pushed in the input receiving part 82 of the information altering element 70 and swung leftward and rightward about the through-hole 12, so that the block assembly 15 or block main body 46 with the information altering element 70 built therein is separated from the button gear 34 against the elasticity of the shift spring 153, and in that condition, the control buttons 10 are properly depressed, there is a fear that the lock 2 is accidentally unlocked.

In that case, the block assembly 115 or block main body 46 is moved in the direction as indicated by an arrow of FIG. 44, the right side opening edge part of the guide groove 59 is engaged with the pin 115, and the pin 115 is engaged with the locking projection 164 so that the pin 115 or memory releasing link 113 is prohibited from moving upward. Accordingly, the block assembly 15 or block main body 46 and the button gear 34 are prohibited from being separated from each other, thereby prohibiting the button-operated lock 2 from being unlocked.

Moreover, as mentioned above, since the engagement element 151 at one end of the protection plate 146 is brought into engagement with the engagement stepped part 106*a* of the driving cam 46 to prohibit the driving cam 46 or door handle 4 from turning, the false unlocking operation can positively be prevented with the help of the above-mentioned arrangement. Thus, safety and security of the button-operated lock 2 is ensured for actual use.

On the other hand, when the button lock 2 is in the locked position, the block main body 46 is biased upward and rightward in FIG. 44, i.e., toward the control 128 side by the elasticity of the shift spring 153, and the left side opening edge part of the guide groove 59 is engaged with the pin 115 or becomes ready to engage the pin 115.

Thus, thereafter, when the resetting operation is made to turn the door handle 4 in the manner as already mentioned to normally unlock the button-operated lock 2, the pin 115 is moved upward as indicated by the imaginary lines in FIG. 44. The pin 115 passes through the side of the locking projection 164 and moves upward along the left side opening edge part of the guide groove 59.

That is, the memory releasing link 113 is moved upward without allowing the pin 115 to engage the locking projection 164, so that the block main body 46 is pulled leftward in FIG. 17 and the block main body 46 is separated from the button gear 34 to realize the previously-mentioned unlocked-state. Accordingly, the resetting operation is not interfered by the locking projection 164.

In this embodiment, a part of the construction of the preceding embodiment is improved. That is, the shape of the shaft hole 71 in plan view of the information altering cam 65 which constitutes the information altering unit 48 is formed into an elongate rectangular shape from the generally half-moon shape, and the sectional shape of the cam shaft 80 of the clutch shaft 67 inserted in the shaft hole 71 is formed in the same shape as the shaft hole 71.

The square shaft 79 projecting from the hook plate 78 of the clutch shaft 67 is formed into a generally diamond shape from the regular octagonal shape, an arcuate guide surface 79*a* is formed at each of the opposite end parts on the enlarged-diameter side of the square shaft 79 so as to facilitate the smooth engagement with the square hole 76 of the terminal gear 66, and the square hole 76 is formed into a generally gear-like shape having eight teeth from the regular octagonal shape.

In this case, although the opposite end parts on the enlarged-diameter side of the square shaft 79 is engaged with the square hole 76, only one end part of the enlarged-diameter side of the square shaft 79 may be engaged therewith.

The operation of the terminal gear 66, the clutch shaft 67 and the information altering cam 65 of this embodiment is substantially same as that of the preceding embodiment.

In this embodiment, a plurality of bending elements 165 are formed on one side of the protection plate 146, and machine screws 166 are screwed into the case 14 in the vicinity of the moving area of the bending elements 165 such that the side surfaces of the head parts 166*a* are ready to engage the bending elements 165. Owing to this arrangement, the protection plate 146 is restricted its swinging motion and the movement of the projection plate 146 can be made in a stable manner.

In the illustration, reference numeral 167 denotes the afore-mentioned cam spring; and 168 denotes setscrews which can be screwed into the threaded holes 109, 110. A hexagonal hole is formed at one end of each setscrew 168. One end of a pipe shaft 169 is screwed into the setscrew 168, and a fixing machine screw (not shown) for the use of connection is screwed into the other end of the setscrew 168.

Reference numeral 170 denotes a check mark shaped in a recessed-shape at the opening part of the elongate hole 24. Four check marks 170 are arranged at equal angular positions (90 degrees), so that the position (angle) of the clutch shaft 80 exposed to the outside of the elongate hole 24 can reliably and easily be confirmed. In this way, since the memory numbers or memory information of the control buttons 10 can be known correctly, information can be set or altered reliably and easily.

Moreover, since the sectional shape of the clutch shaft 80 is formed in an elongate rectangular shape in this embodiment, the position of the shaft 80 can be confirmed correctly.

Figure 51:
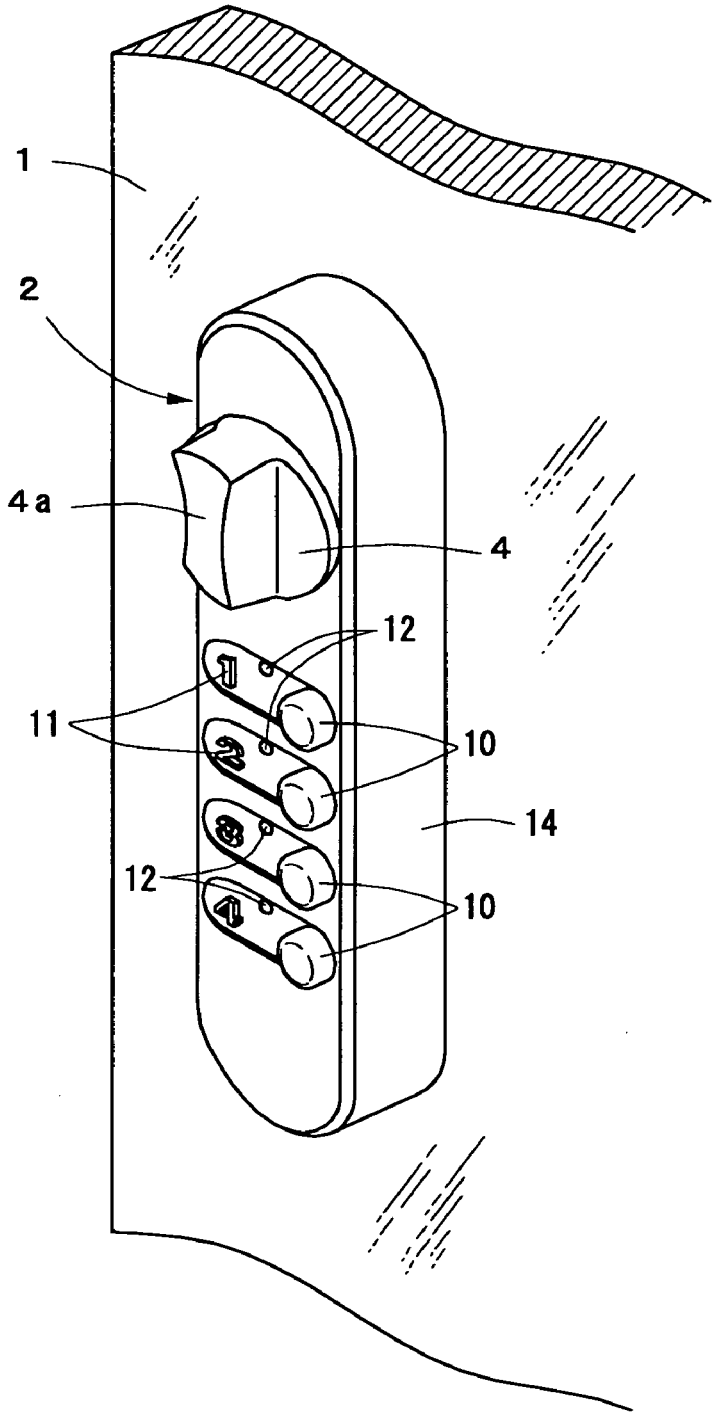
FIG. 51 is a perspective view showing a button-operated lock according to the third embodiment of the present invention, in which the button-operated lock is attached to a kitchen door.

FIG. 51 is the third embodiment of the present invention, showing another mode of use in which the button-operated lock 2 according to the second embodiment is modified so as to be suited to apply to the kitchen door instead of the entrance door 1.

This embodiment is obtained by symmetrically constructing the button-operated lock 2 according to the second embodiment by 180 degrees. Specifically, the inner and outer door handles 4, 5 are arranged at the upper side of the case 14 or seat plate 3, the control buttons 10 are arranged at the right side of the case 14 when viewed in the direction of the front surface of the case 14, the button indication part 11 is arranged at the left side, and the respective control holes 12 are arranged slantwise upward of the corresponding control buttons 10.

In this embodiment, the various component parts are substantially same as the second embodiment and they can be commonly used. The manner for assembling and attaching them is also substantially same as in the second embodiment.

However, in case a main lock (not shown) to be attached to the kitchen door is different from the main lock for use of the entrance door 1, the attaching manner is, as a matter of course, different, depending on the type of the main lock.

As apparent from the above, the button-operated lock 2 according to this embodiment can be obtained by symmetrically constructing the lock 2 of the second embodiment by 180 degrees while commonly using the component parts. Moreover, its design or outer appearance can selectively and easily be changed in accordance with the conditions of attaching the lock 2 and the circumstance under which the lock 2 is used.

Industrial Applicability

A button-operated lock according to the present invention is capable of increasing a setting amount of information in response to operation of a control button, obtaining a large setting amount and a wide-range of selection thereof, enhancing safety performance, simplifying the structure and achieving a small size and a light-weight, thereby achieving a low manufacturing cost, executing such various operations as setting or inputting information and altering thereof correctly, safely, easily and rationally, and preventing decoding or perceiving of preset or inputted information so that any third party is prevented from making a falsification and/or conversion of this device.

The invention claimed is:

1. A button-operated lock, comprising:

a plurality of control buttons axially displaced and capable of setting or inputting a predetermined information;

a control plate for allowing an unlocking procedure at the time of setting or inputting the predetermined information by said control buttons;

a driving cam linked to said control plate and capable of being operatively connected to a pair of door handles;

a lock element linked to said driving cam; and a control means for linking the information to be set or inputted with the number of control by said control buttons;

said control means having a button gear, intermittently rotatable for each of said control buttons, capable of setting or inputting said plurality of same or different information, and capable of setting or inputting said plurality of information for said control buttons, wherein;

said button gear is coaxially arranged with said control buttons, said button gear and said control buttons are engaged with each other and provided so as to coaxially move, said control means has a gear train in which said button gear includes a plurality of teeth on an outer periphery, said control means has a terminal gear and a reset gear of engaged with each other, the shaft cores of the gears are arranged with space there between in a direction perpendicular to the shaft cores, and the teeth of the gears are arranged roughly in the same plane-shape, said terminal gear arranged to be engageable with said button gear, and the reset gear arranged to be engageable with said terminal gear, said reset gear is biased in such a manner as to be able to rotationally return in accordance with a rotation angle displacement thereof, said terminal gear is provided with an engagement hole engageable with an engagement shaft and having a flat polygonal cross-section, a clutch shaft being provided with an engagement hole engageable with the engagement shaft and having a flat polygonal cross-section which is engageable with and disengageable from said engagement hole, and said engagement shaft being biased for engagement with said engagement hole.

2. A button-operated lock according to claim 1, wherein a plurality of engagement parts engageable with said engagement shaft are formed at said engagement hole, and the number of said engagement parts is set to be equal to an amount of information which can be set or inputted by only one control button.

3. A button-operated lock according to claim 1, wherein a plurality of control holes are formed in a surface of a case which is exposed to the outside, so that a control tool can be inserted in said control holes, and one end part of said clutch shaft is faced with an inner side opening part of said control hole.

4. A button-operated lock according to claim 3, wherein said clutch shaft is axially displaceable through said control tool, so that the engagement between said engagement shaft and said engagement hole can be released, and said terminal gear is rotatably supported by said clutch shaft.

5. A button-operated lock according to claim 3, wherein a cam shaft is projected from the other end of said clutch shaft, a control cam is attached to said cam shaft such that said control cam is simultaneously movable with said cam shaft, an engagement claw of said control plate is engagement and removably received in a cutout groove formed in said control cam, and said engagement claw is biased such that said engagement claw is engageable with and disengageable from said cutout groove.

6. A button-operated lock according to claim 5, wherein a plurality of passage holes are formed in a back plate, which is attached to a back part of said case, in such a manner as to face with an end part of said cam shaft, and a plurality of check marks are arranged on the outside of said passage holes in isometric positions.

7. A button-operated lock according to claim 3, wherein at the time of setting or inputting information through said control buttons, said cutout grooves are directed toward said engagement claw side and positioned in the same phase as said engagement claw, and said engagement claws are brought into engagement with said cutout grooves, respectively, so that said control plate can allow an unlocking procedure.

8. A button-operated lock according to claim 3, wherein at the time of setting or inputting illegal information through said control buttons, said engagement claws are brought into engagement with said control cam and prohibited from being engaged with said cutout grooves, so that said control plate is unable to allow an unlocking procedure.

9. A button-operated lock according to claim 3, wherein a block main body on which said terminal gear and said reset gear can be mounted is provided, a memory releasing link, is engaged with said block main body, said block main body is biased in such a manner as to be able to move toward said control button side, so that said terminal gear and said button gear can be engaged with each other, one end part of said memory releasing link is engaged with said driving cam, so that said block main body is brought away from said control button side through the turning motion of said driving cam, thereby allowing said terminal gear and said button gear to be disengaged from each other.

10. A button-operated lock according to claim 3 or 9, wherein said case is provided at an inner side surface side thereof with a protection plate such that said protection plate can move along said control holes, and a plurality of trough-holes, which can communicate with said control holes, are formed in said protection plate, such that one end of said protection plate can engage said driving cam.

11. A button-operated lock according to claim 9, wherein said block main body is provided with a guide groove, said memory releasing link is provided with a pin projecting therefrom and engageable with said guide groove, said pin is positioned such that it can normally engage one side edge of said guide groove, said guide groove is provided at the other end edge thereof with a locking projection engageable with said pin, and at the time of engagement between said pin and said locking projection, operation of said memory releasing link is prohibited and engagement between said terminal gear and said button gear is prohibited from releasing.

12. A button-operated lock according to claim 9, wherein said memory releasing link is turnably provided at the other end side thereof with a changeover shaft which is linked to a changeover knob on the indoor side, said changeover shaft is provided, with two cams, which are different in length, and said two cams, are selectively engageable with the other end part of said memory releasing link.

13. A button-operated lock according to claim 12, wherein the separation distance between said block main body and said control button is made different in accordance with the lengths of said two cams, said two cams are each capable of releasing engagement between said terminal gear and said button gear, at the time of engagement with said long side cam, engagement between said engagement claw and said cutout groove of said control cam can be released, and at the time of engagement with said short side cam, engagement between said engagement claw and said cutout groove can be maintained.

14. A button-operated lock according to claim 12, wherein engagement between said terminal gear and said button gear is released through turning operation of said door handles or said changeover shaft, and said terminal gear is turned by elastic force of a rest spring which is formed after said information is set or imputed, so that said control cam or its cutout groove can he returned to its original position.

15. A button-operated lock according to claim 14, wherein after said control cam or its cutout groove is returned to its original position, current information of said control button is set or imputed to turn said button gear by an amount of the set or inputted information, said terminal gear and said reset gear are moved in operative connection to the turning motion of said button gear, said terminal gear is biased to return to its original position by an amount of the set or inputted information, the engagement between said terminal gear and said button gear is released through the turning operation of said door handles, said terminal gear is reversely turned for offset by an amount of the set or inputted information, thereby releasing the set or inputted current information so that said lock can be unlocked.

16. A button-operated lock according to claim 14, wherein after said control cam or its cutout groove is returned to its original position, said terminal gear is rotatably supported on said clutch shaft through said control tool, and the engagement between said engagement shaft and said engagement hole is released, so that the original position of said control cam or its cutout groove can be maintained.

17. A button-operated lock according to claim 14, wherein after the original position of said control cam or its cutout groove is maintained through said control tool, at the time for altering information where said button gear is turned in the same direction as at the setting or inputting time of information, said control button is operated by an amount equal to the difference between the turning angles of said button gear before and after the alternation of information, then said terminal gear and said reset gear are operatively connected thereto, said terminal gear is biased such that it can turningly return by an amount equal to the difference between said turning angles, said engagement shaft and said engagement hole are engaged with each other after said button gear is turned, and the original position of said control cam or its cutout groove is linked to said terminal gear, the engagement between said terminal gear and said button gear is released through turning operation of said door handles, said terminal gear is turned by an amount equal to the elasticity of said reset spring formed after the alternation of information, and an amount equal to the turning angle of said terminal gear is added to the position of said control cam or its cutout groove, so that the setting or inputting information can be altered.

18. A button-operated lock according to claim 17, wherein the number of times of operation of said control button is a quotient obtained by dividing the difference of turning angles of said button gear before and after the alternation of information by a unit operation turning angle of said turning button.

19. A button-operated lock according to claim 14, wherein when altering information:

said button gear is turnable in a reverse direction to the direction for setting or inputting information, said changeover shaft is turnable to bring said cam on its short side into engagement with an end part of said memory releasing link and to release the engagement between said terminal gear and said button gear, the engagement between said cutout groove and said engagement claw is maintainable to maintain the original position of said control cam or its cutout groove, said terminal gear is turnably supportable on said clutch shaft through said control tool, said terminal gear is turningly returnable by an amount of elasticity of said reset spring equal to the amount of elasticity necessary for forming the original position, after the original position of said control cam or its cutout groove is released, said changeover shaft is turningly returnable to the original position to bring said terminal gear into engagement with said button gear, said button gear is turnable by an amount equal to the amount of angle of the alternation of information by operating said control button through said control cool, then said terminal gear and said reset gear are operatively connectable thereto, whereby said terminal gear is biasable such that it is turningly returnable by an amount equal to the difference between said turning angles, said engagement shaft and said engagement hole are engageable with each other after said button gear is turned, said clutch shaft is linkable to said terminal gear for releasing the engagement between said terminal gear and said button gear through turning operation of said door handles, said terminal gear is turnable by an amount equal to elasticity of said reset spring formed after the alternation of information, the position of said control cam or its cutout groove is resetable by an amount equal to the turning angle of said terminal gear, whereby the setting or inputting information is alterable.

* * * * *